US010093118B2

(12) United States Patent
Kumagai et al.

(10) Patent No.: US 10,093,118 B2
(45) Date of Patent: Oct. 9, 2018

(54) RECORDING APPARATUS

(71) Applicant: SEIKO EPSON CORPORATION, Tokyo (JP)

(72) Inventors: Katsunari Kumagai, Okaya (JP); Makoto Sato, Matsumoto (JP); Satoshi Nakata, Matsumoto (JP); Tatsuya Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/441,057

(22) Filed: Feb. 23, 2017

(65) Prior Publication Data

US 2017/0246891 A1 Aug. 31, 2017

(30) Foreign Application Priority Data

Feb. 26, 2016 (JP) ..... 2016-035331
Feb. 26, 2016 (JP) ..... 2016-035332
Feb. 26, 2016 (JP) ..... 2016-035340

(51) Int. Cl.
*B41J 25/308* (2006.01)
*B41J 19/20* (2006.01)
*B41J 19/30* (2006.01)

(52) U.S. Cl.
CPC ..... *B41J 25/3088* (2013.01); *B41J 19/207* (2013.01); *B41J 19/305* (2013.01)

(58) Field of Classification Search
CPC ..... B41J 25/3088
See application file for complete search history.

(56) References Cited

U.S. PATENT DOCUMENTS

2004/0041860 A1* 3/2004 Takahashi ..... B41J 25/308 347/8

FOREIGN PATENT DOCUMENTS

| | | |
|---|---|---|
| JP | 2005-081691 | 3/2005 |
| JP | 2006-062305 | 3/2006 |
| JP | 2010-194827 | 9/2010 |
| JP | 2014-104588 | 6/2014 |

* cited by examiner

*Primary Examiner* — Julian Huffman
(74) *Attorney, Agent, or Firm* — Workman Nydegger

(57) ABSTRACT

A recording apparatus includes: a carriage that has a recording head which performs recording on a medium; and a gap adjusting unit that causes the carriage to shift in a direction in which a gap between a medium and the recording head changes depending on rotation of a cam. In a state in which the carriage is positioned at an end portion in a moving range in the first direction, at least a part of the carriage and at least a part of the cam overlap in a moving direction of the carriage. In the state in which the carriage is positioned at the end portion in the moving range in the first direction, the cam does not project with respect to the carriage in the first direction.

13 Claims, 39 Drawing Sheets

RECORDING APPARATUS

BACKGROUND

1. Technical Field

The present invention relates to a recording apparatus that performs recording on a medium.

2. Related Art

As an ink jet printer as an example of a recording apparatus, there is a so-called serial printer having a configuration in which a liquid (ink as an example thereof) is discharged on a medium from the recording head while a carriage, on which a recording head is mounted, reciprocates in a main-scanning direction, and recording is performed.

In addition, the medium as a recording target has various thicknesses, and thus a gap adjusting unit that adjusts a gap between a medium and a recording head is provided in order to cope with the thicknesses in some cases. The gap adjusting unit may be configured to include a cam at an end portion of a guiding shaft that guides a carriage and to cause the cam (carriage guiding shaft) to rotate, and thereby to adjust the gap. An example of a configuration of such a printer is disclosed in JP-A-2006-062305.

In general, a carriage is configured to reciprocate with a driving motor as a power source in which power is transmitted to the carriage via an endless belt. The carriage is guided to a carriage guiding shaft via a bearing (slide bearing) so as to reciprocate in an axial direction (main-scanning direction) (for example, JP-A-2014-104588). A recording apparatus disclosed in JP-A-2014-104588 includes a support frame above the guiding shaft, in addition to the guiding shaft. The carriage is to rotate around the guiding shaft due to the own weight thereof; however, the support frame stops the rotation, and a posture of the carriage is regulated. Hence, the support frame can be referred to as a posture regulating member that regulates a posture of the carriage.

In addition, there has been known a method using a linear scale as a unit that detects a position of a carriage in the main-scanning direction. The linear scale has a length over an entire region of the carriage in a movement direction, and the carriage is provided with an optical sensor that detects the linear scale. Examples of a configuration of such a printer are disclosed in JP-A-2005-081691 and JP-A-2010-194827.

In recent years, there is a demand for a much smaller recording apparatus. Since the printer disclosed in JP-A-2006-062305 includes the cam, which adjusts the gap, at an end portion of the carriage on one side in the movement direction, the width of the apparatus increases in size due to a region occupied by the cam.

In addition, when, in the configuration disclosed in JP-A-2014-104588, the size of the apparatus is reduced in a height direction, the following negative effects arise. Hereinafter, the description is provided with reference to FIG. 39. Reference sign 200 in FIG. 39 represents a carriage. Similarly, reference sign 201 represents an ink cartridge, reference sign 202 represents a recording head, reference sign 203 represents a cap, and reference sign 204 represents a guiding shaft. In addition, reference sign 205 represents a guiding target portion, and reference sign 206 represents a support frame.

Rotation of the carriage 200 around the guiding shaft 204 includes not only the rotation in an arrow b direction due to the own weight of the carriage, but also rotation in an arrow a direction opposite to the arrow b direction. Specifically, the cap 203, which seals the recording head 202, pushes up the recording head 202 in an arrow F direction, and thereby the carriage 200 rotates.

The support frame 206 is formed to have a shape so as to interpose the guiding target portion 205 that configures a part of the carriage 200, such that a guiding surface 206*a* stops rotation of the carriage 200 in the arrow b direction and a guiding surface 206*b* stops rotation of the carriage 200 in the arrow a direction.

Normally, in this state, the rotation of the carriage 200 in the arrow b direction due to the own weight is stopped by the guiding surface 206*a*, and a gap d is formed between the guiding surface 206*b* and the guiding target portion 205. When the cap 203 pushes up the recording head 202, the carriage 200 rotates until the guiding target portion 205 comes into contact with the guiding surface 206*b*, that is, the gap d becomes zero.

Here, when a size H is reduced in order to decrease the apparatus in size, more specifically, to achieve a low profile, a rotating amount of the carriage 200 increases until the guiding target portion 205 comes into contact with the guiding surface 206*b*, that is, the gap d becomes zero. In this manner, since a floating amount S of the top portion of the ink cartridge 201 also increases, a space to an equivalent extent needs to be considered, and thus it is difficult to decrease the size of the apparatus.

In addition, since the printer disclosed in JP-A-2005-081691 has a configuration in which a belt that pulls the carriage and the linear scale overlap in an apparatus-height direction, it is difficult to decrease the size of the apparatus in the apparatus-height direction. In particular, in a printer in which a position of a recording head (carriage) in height changes depending on a thickness of a sheet, the size thereof in the apparatus-height direction needs to much more increase such that an up-and-down moving range of the belt in addition to the linear scale overlap in the apparatus-height direction.

In addition, the printer disclosed in JP-A-2010-194827 includes the linear scale disposed on an inner side of a timing belt formed to have a loop shape; however, in this configuration, a pulley, around which the timing belt loops, increases in diameter, and it is also difficult to reduce the size thereof in the apparatus-height direction. Then, required driving torque increases due to the increase of the diameter of the pulley, and thus there is a shortcoming of an increase in driving motor.

SUMMARY

An advantage of some aspects of the invention is to more reduce a size of a recording apparatus including a cam for adjusting a gap, a recording apparatus including a carriage, and a recording apparatus including an endless belt and a linear scale.

According to a first aspect of the invention, there is provided a recording apparatus including: a carriage that has a recording head which performs recording on a medium and that is movable in a first direction and a second direction opposite to the first direction; and a gap adjusting unit that causes the carriage to shift in a direction in which a gap between a medium and the recording head changes depending on rotation of a cam. In a state in which the carriage is positioned at an end portion in a moving range in the first direction, at least a part of the carriage and at least a part of the cam overlap in a moving direction of the carriage.

In this configuration, since at least a part of the carriage and at least a part of the cam overlap in the moving direction of the carriage, the region occupied by the carriage and the region occupied by the cam do not overlap entirely in the moving direction of the carriage such that it is possible to decrease the apparatus in size in the moving direction of the carriage.

In the recording apparatus according to a second aspect of the invention, in the state in which the carriage is positioned at the end portion in the moving range in the first direction, the cam may not project with respect to the carriage in the first direction.

In this configuration, since the cam does not project with respect to the carriage in the first direction in the state in which the carriage is positioned at the end portion in the moving range in the first direction, the apparatus does not increase in size in the moving direction of the carriage due to the region occupied by the cam such that it is possible to decrease the apparatus in size in the moving direction of the carriage.

According to a third aspect of the invention, the recording apparatus may further include a guiding shaft that guides the carriage in the moving direction. The cam may have a shape in which a distance from the rotating center to an outer circumference changes in a circumferential direction, and is provided at an end portion of the guiding shaft, the gap adjusting unit may have a cam follower that comes into contact with an outer circumferential surface of the cam, and, in the state in which the carriage is positioned at the end portion in the moving range in the first direction, the cam follower may not project with respect to the carriage in the first direction.

In this configuration, since the cam follower does not project with respect to the carriage in the first direction in the state in which the carriage is positioned at the end portion in the moving range in the first direction, the apparatus does not increase in size in the moving direction of the carriage due to the region occupied by the cam follower such that it is possible to decrease the apparatus in size in the moving direction of the carriage.

In the recording apparatus according to a fourth aspect of the invention, the gap adjusting unit may have a gear group that transmits rotational torque of a power source to the cam, and, in the state in which the carriage is positioned at the end portion in the moving range in the first direction, the gear group may not project with respect to the carriage in the first direction.

In this configuration, since the gear group does not project with respect to the carriage in the first direction in the state in which the carriage is positioned at the end portion in the moving range in the first direction, the apparatus does not increase in size in the moving direction of the carriage due to the region occupied by the gear group such that it is possible to decrease the apparatus in size in the moving direction of the carriage.

In the recording apparatus according to a fifth aspect of the invention, the cam may not project with respect to the top portion of the carriage in the direction in which the gap changes.

In this configuration, since the cam does not project with respect to the top portion of the carriage in the direction in which gap changes, the apparatus does not increase in size due to the cam in the direction in which the gap changes such that it is possible to decrease the apparatus in size in the direction in which the gap changes.

In the recording apparatus according to a sixth aspect of the invention, the cam may be positioned to be closer to an end portion in the moving range of the carriage on the second direction side, and, in the state in which the carriage is positioned at the end portion in the moving range in the second direction, the cam may not project with respect to the carriage in the second direction.

In this configuration, since the cam does not project with respect to the carriage in the second direction in the state in which the carriage is positioned at the end portion in the moving range in the second direction, it is possible to decrease the apparatus in size in the moving direction of the carriage, in the configuration in which the cams are provided on both end sides of the carriage in the moving range.

According to a seventh aspect of the invention, the recording apparatus may further include a power transmitting mechanism that transmits power of a driving source to a transport unit that transports a medium is disposed on an end portion side in the second direction in the moving range of the carriage. In the state in which the carriage is positioned at the end portion in the moving range in the second direction, the power transmitting mechanism may not project with respect to the carriage in the second direction.

In this configuration, since the power transmitting mechanism does not project with respect to the carriage in the second direction in the state in which the carriage is positioned at the end portion in the moving range in the second direction, the apparatus does not increase in size in the moving direction of the carriage due to the region occupied by the power transmitting mechanism such that it is possible to decrease the apparatus in size in the moving direction of the carriage.

In the recording apparatus according to an eighth aspect of the invention, the carriage may have a plurality of ink cartridges that contain liquids that are discharged from the recording head, and the plurality of ink cartridges may be arranged in the carriage in a direction intersecting with the moving direction of the carriage.

In this configuration, since the plurality of ink cartridges are arranged in the carriage in a direction intersecting with the moving direction of the carriage, it is possible to decrease the carriage in size in the moving direction of the carriage, and further it is possible to decrease the apparatus in size in the moving direction of the carriage.

According to a ninth aspect of the invention, the recording apparatus may further include a press unit that engages with the carriage and presses the carriage downward in a state in which the gap is at least larger than the smallest gap.

In this configuration, since the recording apparatus further includes the press unit that engages with the carriage and presses the carriage downward in the state in which the gap is at least larger than the smallest gap, upward rotation of the carriage is regulated by the press unit such that a space for the upward rotation of the carriage does not need to be secured or it is possible to decrease the space. As described above, it is possible to decrease the apparatus in size.

In the recording apparatus according to a tenth aspect of the invention, the press unit may engage with the carriage when the carriage is positioned outside a recording region in which the recording head performs recording on a medium.

In this configuration, since the press unit engages with the carriage when the carriage is positioned outside the recording region in which the recording head performs recording on a medium, the press unit does not have a bad effect on a recording quality and thus it is possible to maintain a good recording quality.

In the recording apparatus according to an eleventh aspect of the invention, the press unit may engage with an end portion of the carriage on a side apart from the guiding shaft.

In this configuration, since the press unit engages with the end portion of the carriage on the side apart from the guiding shaft, it is possible to reduce the floating of the carriage with a smaller force.

According to a twelfth aspect of the invention, there is provided a recording apparatus including: a carriage that has a recording head which performs recording on a medium and that is movable in a direction intersecting with a medium transport direction; a driving belt that pulls the carriage in a moving direction; and a linear scale that configures a position detecting unit which detects a position of the carriage and that is provided to extend in the moving direction of the carriage. At least a part of the linear scale and at least a part of a region occupied by the driving belt overlap in an apparatus-height direction.

In this configuration, since at least a part of the linear scale and at least a part of a region occupied by the driving belt overlap in the apparatus-height direction, the region occupied by the linear scale and the region occupied by the driving belt do not overlap entirely in the apparatus-height direction such that it is possible to decrease the size in the apparatus-height direction.

In the recording apparatus according to a thirteenth aspect of the invention, the linear scale in a direction intersecting with the moving direction of the carriage may be positioned on a main body side of the carriage with respect to the driving belt.

According to a fourteenth aspect of the invention, the recording apparatus may further include a guiding shaft that guides the carriage in the moving direction. The linear scale and the driving belt may be positioned to interpose the central position of the guiding shaft therebetween in a direction intersecting with the moving direction of the carriage.

In the recording apparatus according to a fifteenth aspect of the invention, the linear scale may overlap the guiding shaft in the direction intersecting with the moving direction of the carriage.

In this configuration, since the linear scale overlaps the guiding shaft in the direction intersecting with the moving direction of the carriage, the region occupied by the linear scale and the region occupied by the guiding shaft do not overlap in the direction intersecting with the moving direction of the carriage such that it is possible to decrease the apparatus in size in the direction intersecting with the moving direction.

According to a sixteenth aspect of the invention, the recording apparatus may further include a cap that comes into press contact with the recording head from below and seals the recording head. The press unit may engage with the carriage in the moving direction of the carriage in a range in which the cap comes into press contact with the recording head.

In this configuration, since the press unit engages with the carriage in the moving direction of the carriage in a range in which the cap comes into press contact with the recording head, a position of the carriage to which the cap applies an external force is coincident with or close to a position of the carriage to which the press unit applies an external force in the moving direction of the carriage. In this manner, it is possible to prevent or reduce a tilt of the carriage.

In the recording apparatus according to a seventeenth aspect of the invention, the press unit may engage with the carriage when the gap is the largest gap.

In this configuration, since the press unit engages with the carriage when the gap is the largest gap, it is possible to prevent or reduce the floating of the carriage with a gap with which the floating of the carriage has the highest effect on the size (height) of the apparatus such that it is possible to reliably decrease the apparatus in size.

According to an eighteenth aspect of the invention, the recording apparatus may further include a control unit that controls the carriage. The control unit may be capable of executing a position detecting operation of detecting a position of the carriage by causing the carriage to come into bump contact with an end portion in the moving direction, and the position detecting operation may be performed with a gap other than the gap with which the press unit engages with the carriage.

In this configuration, since the position detecting operation may be performed with the gap other than the gap with which the press unit engages with the carriage, during the position detecting operation, the press unit can avoid having a bad effect on determination in the position detecting operation.

According to a nineteenth aspect of the invention, the recording apparatus may further include a support portion that supports the carriage from below when the carriage is positioned outside a recording region in which the recording head performs recording on a medium.

For example, when a falling impact is applied to the carriage during transportation thereof, the posture regulating member receives the impact. Thus, there is a concern that the posture regulating member will be deformed. However, in this configuration, since the recording apparatus may further include a support portion that supports the carriage from below when the carriage is positioned outside the recording region in which the recording head performs recording on a medium, the support portion receives the impact, and thereby it is possible to prevent or reduce the deformation of the posture regulating member.

In the recording apparatus according to a twentieth aspect of the invention, the carriage may include a sensor that detects the linear scale and configures the position detecting unit, and a surrounding portion that surrounds the sensor and the linear scale and is open in the moving direction of the carriage.

In this configuration, since the carriage includes the sensor that detects the linear scale and configures the position detecting unit, and the surrounding portion that surrounds the sensor and the linear scale and is open in the moving direction of the carriage, it is possible to reduce an occurrence of a problem in that the linear scale is detached from the sensor when a user touches the linear scale.

In the recording apparatus according to a twenty first aspect of the invention, the surrounding portion may cover the sensor and the linear scale from the right, left, top and bottom thereof when viewed in the moving direction of the carriage.

In this configuration, since the surrounding portion may cover the sensor and the linear scale from the right, left, top and bottom thereof when viewed in the moving direction of the carriage, it is possible to more reliably reduce the occurrence of the problem in that the linear scale is detached from the sensor, and it is difficult for the user to touch the sensor such that it is possible to protect the sensor.

In the recording apparatus according to a twenty second aspect of the invention, the surrounding portion may be integrally formed with the main body of the carriage.

In this configuration, since the surrounding portion is integrally formed with the main body of the carriage, it is possible to configure the surrounding portion at low costs.

According to a twenty third aspect of the invention, the recording apparatus may further include a belt grip portion gripping the driving belt in the carriage, which is integrally formed with the surrounding portion.

In this configuration, since the belt grip portion is integrally formed with the surrounding portion, it is possible to configure the belt grip portion with low costs.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail with reference to the figures. Note that, the same reference signs are assigned to the same configurations in Examples, thus only a first example is described, and description of the configurations in the other examples is omitted.

Figure 1:
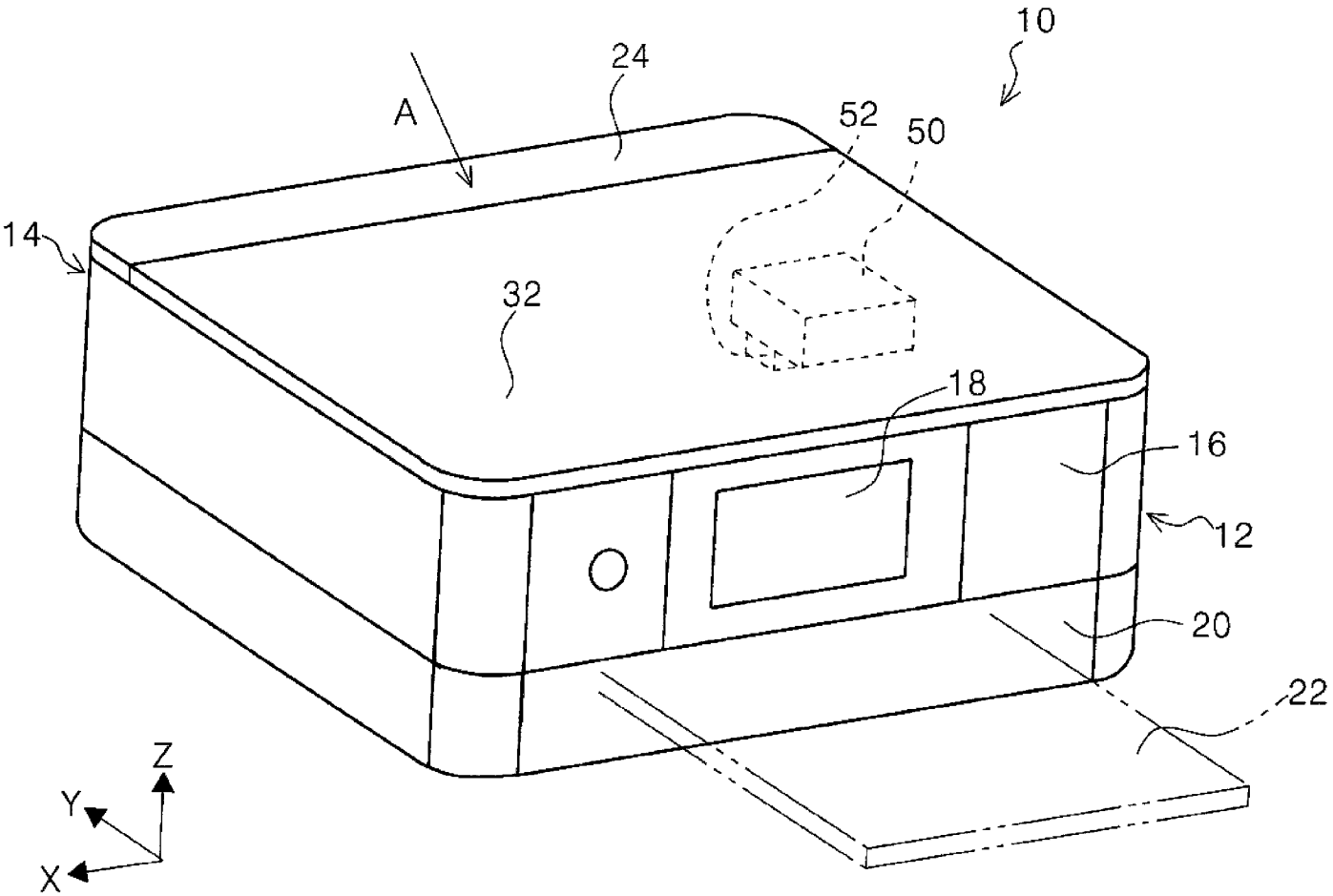
FIG. 1 is a perspective view illustrating the external appearance of a printer according to the invention.
Figure 2:
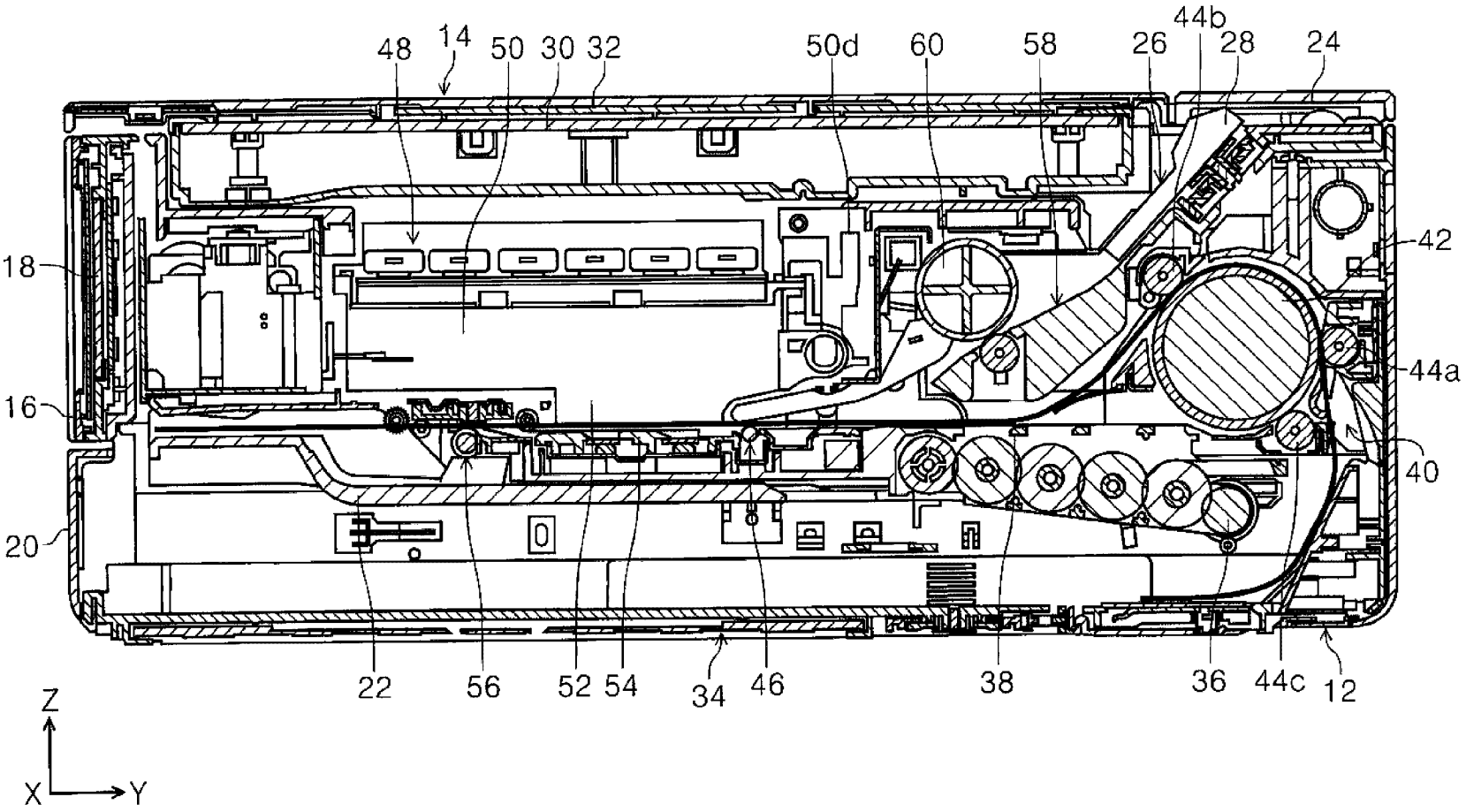
FIG. 2 is a sectional side view illustrating a medium transport route in the printer according to the invention.
Figure 3:
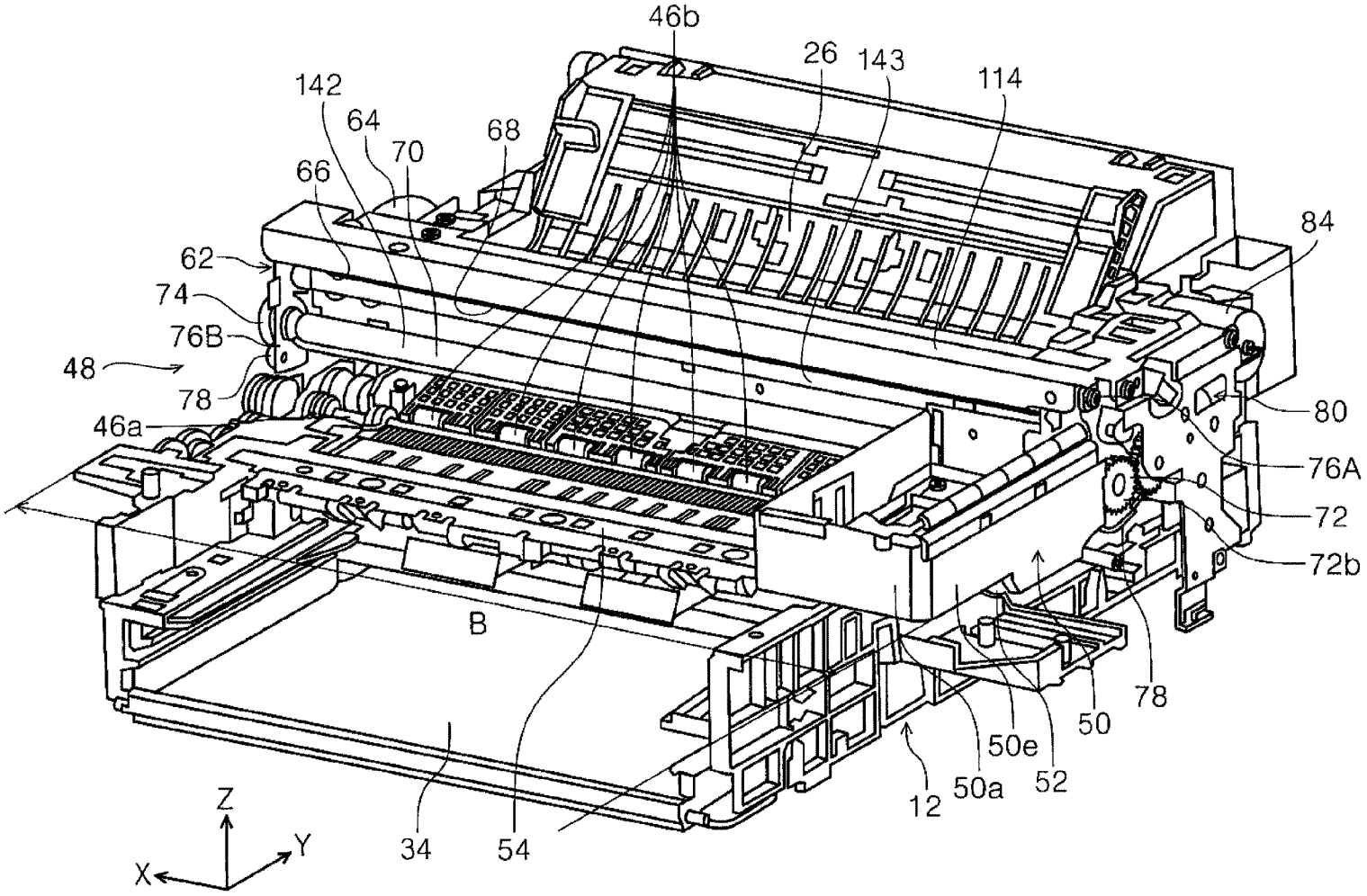
FIG. 3 is a perspective view illustrating an apparatus main body of the printer according to the invention.
Figure 4:
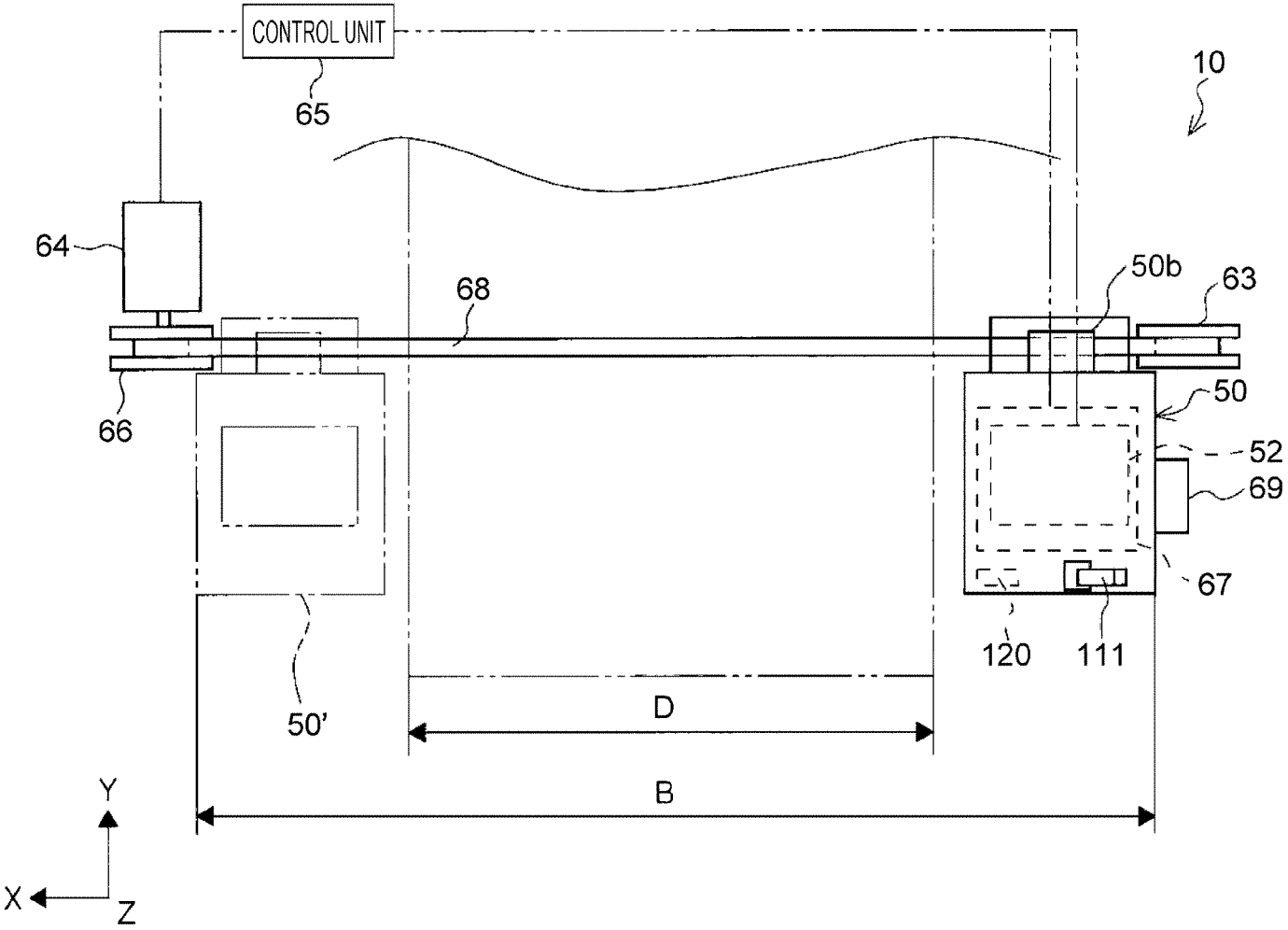
FIG. 4 is a schematic diagram illustrating a relationship between a recording region and a moving range of a carriage according to an example.
Figure 5:
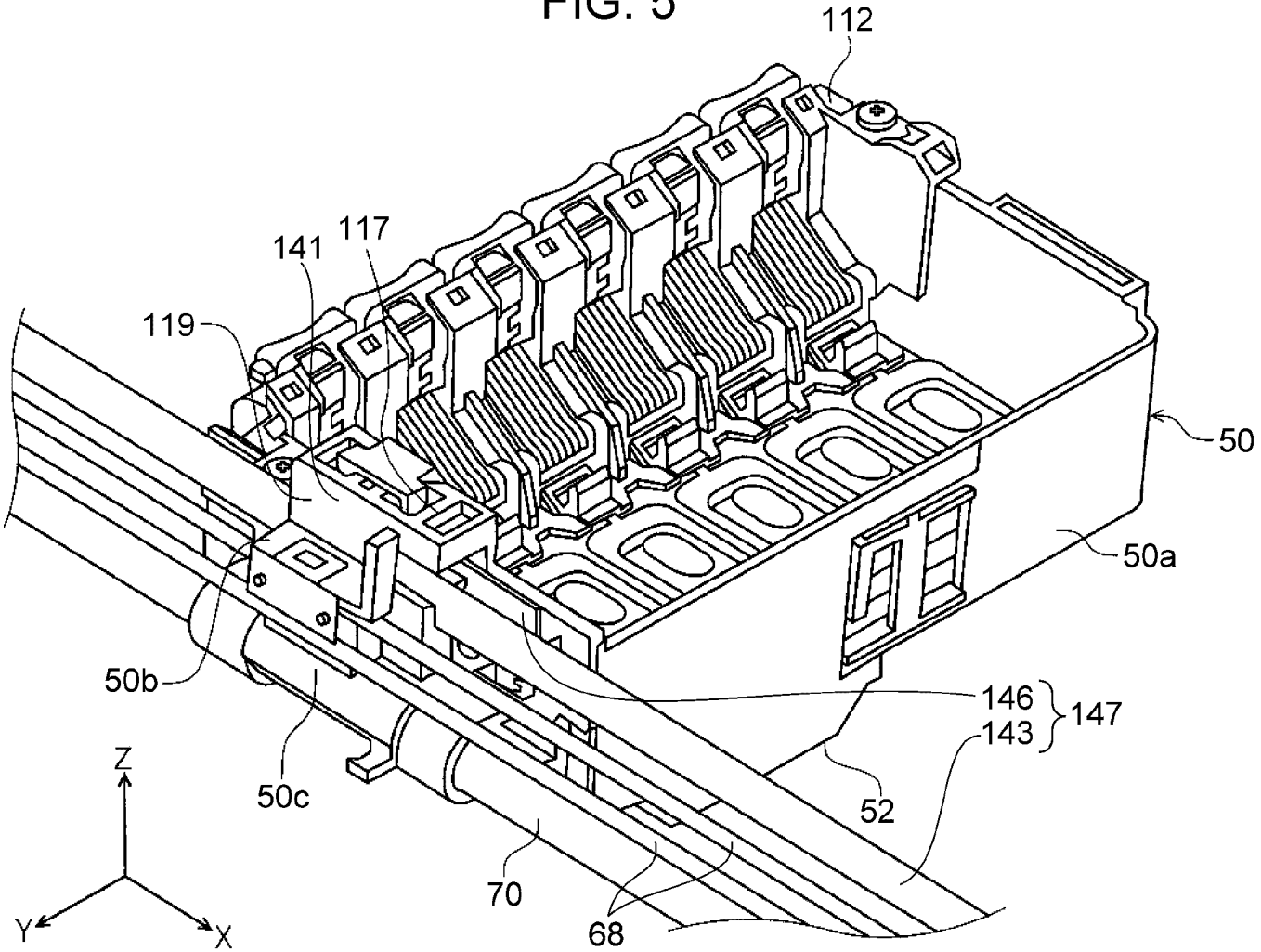
FIG. 5 is a perspective view illustrating the carriage according the example when viewed from a rear surface side.
Figure 6:
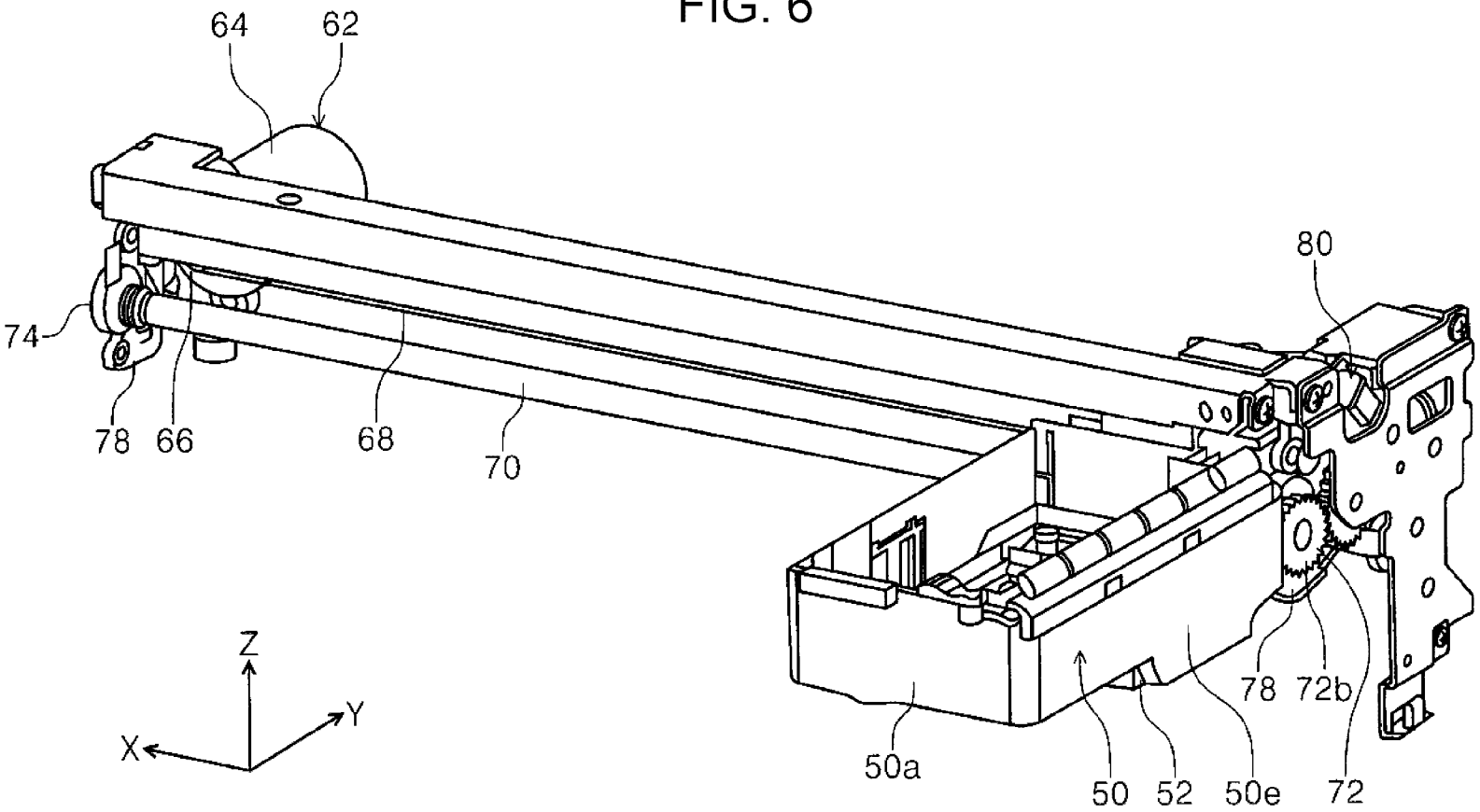
FIG. 6 is a perspective view illustrating the carriage and a carriage driving unit.
Figure 7:
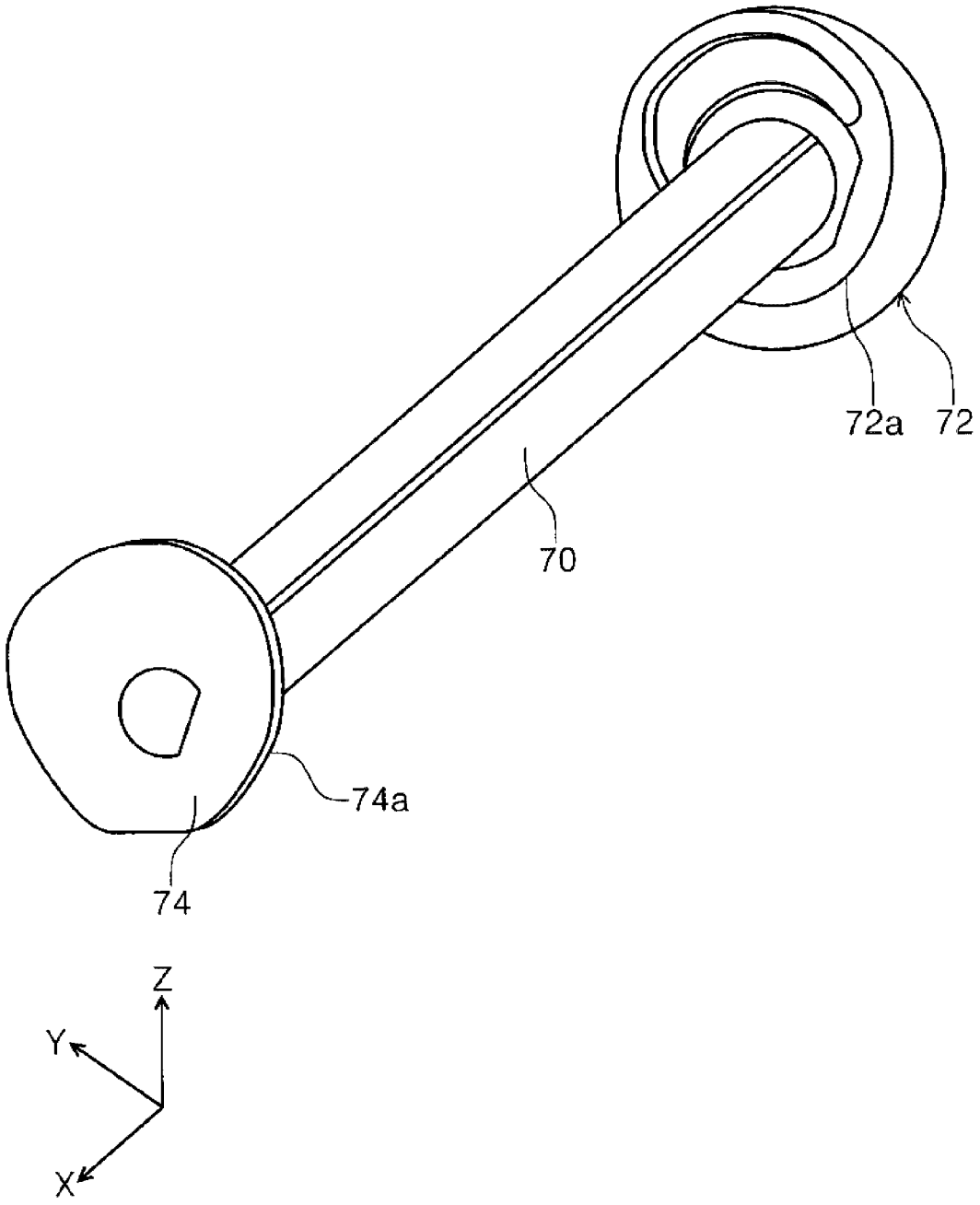
FIG. 7 is a perspective view illustrating a configuration of a guiding shaft.
Figure 8:
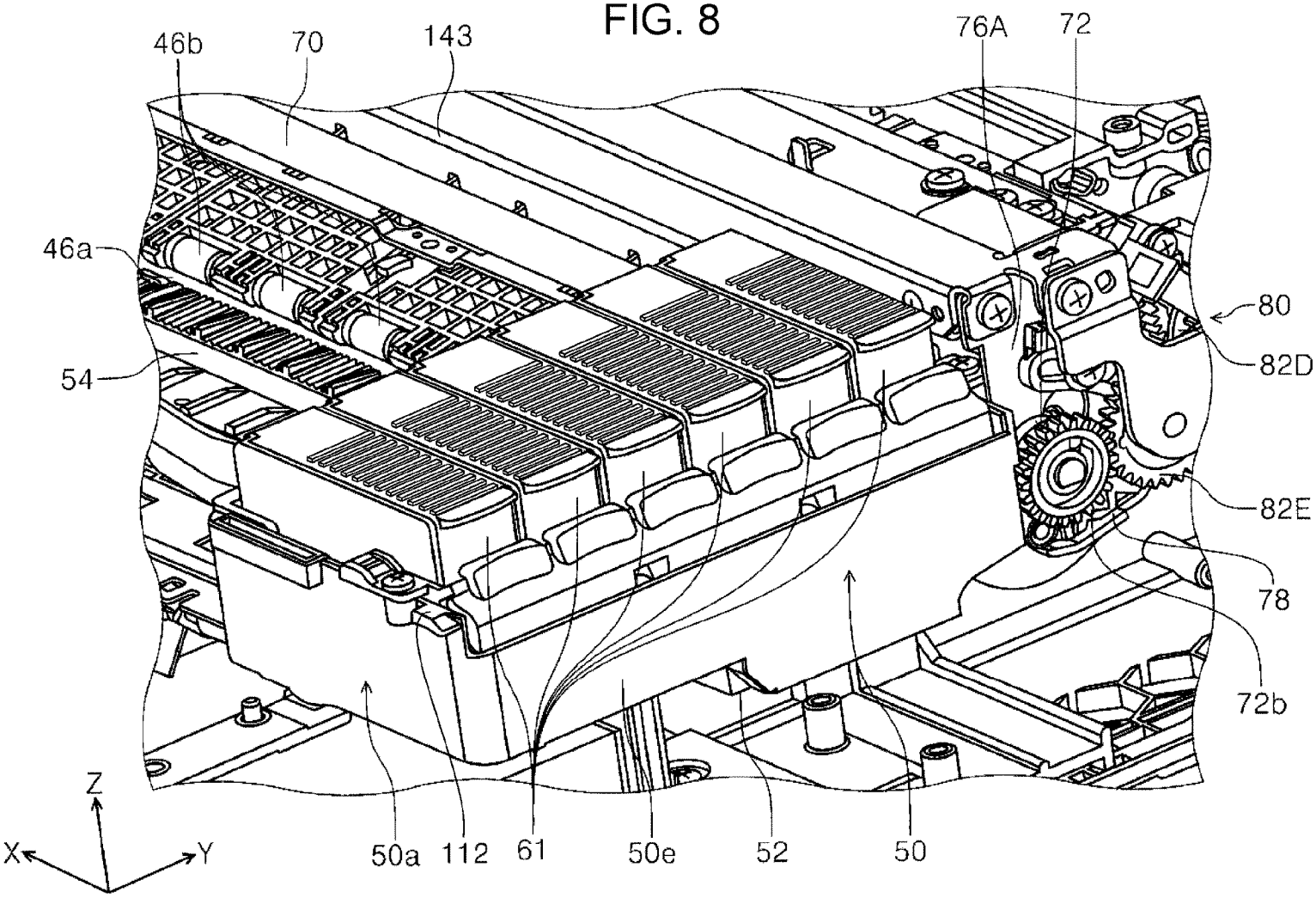
FIG. 8 is a perspective view illustrating a state in which the carriage is positioned in an end portion in the apparatus main body on a right side in an apparatus-width direction.

FIG. 1 is a perspective view illustrating the external appearance of a printer according to the invention. FIG. 2 is a sectional side view illustrating a medium transport route in the printer according to the invention. FIG. 3 is a perspective view illustrating an apparatus main body of the printer according to the invention. FIG. 4 is a diagram illustrating a relationship between a recording region and a moving range of a carriage according to an example. FIG. 5 is a perspective view illustrating the carriage according the example when viewed from a rear surface side. FIG. 6 is a perspective view illustrating the carriage and a carriage driving unit. FIG. 7 is a perspective view illustrating a configuration of a guiding shaft. FIG. 8 is a perspective view illustrating a state in which the carriage is positioned in an end portion in the apparatus main body on a right side in an apparatus-width direction.

Figure 9:
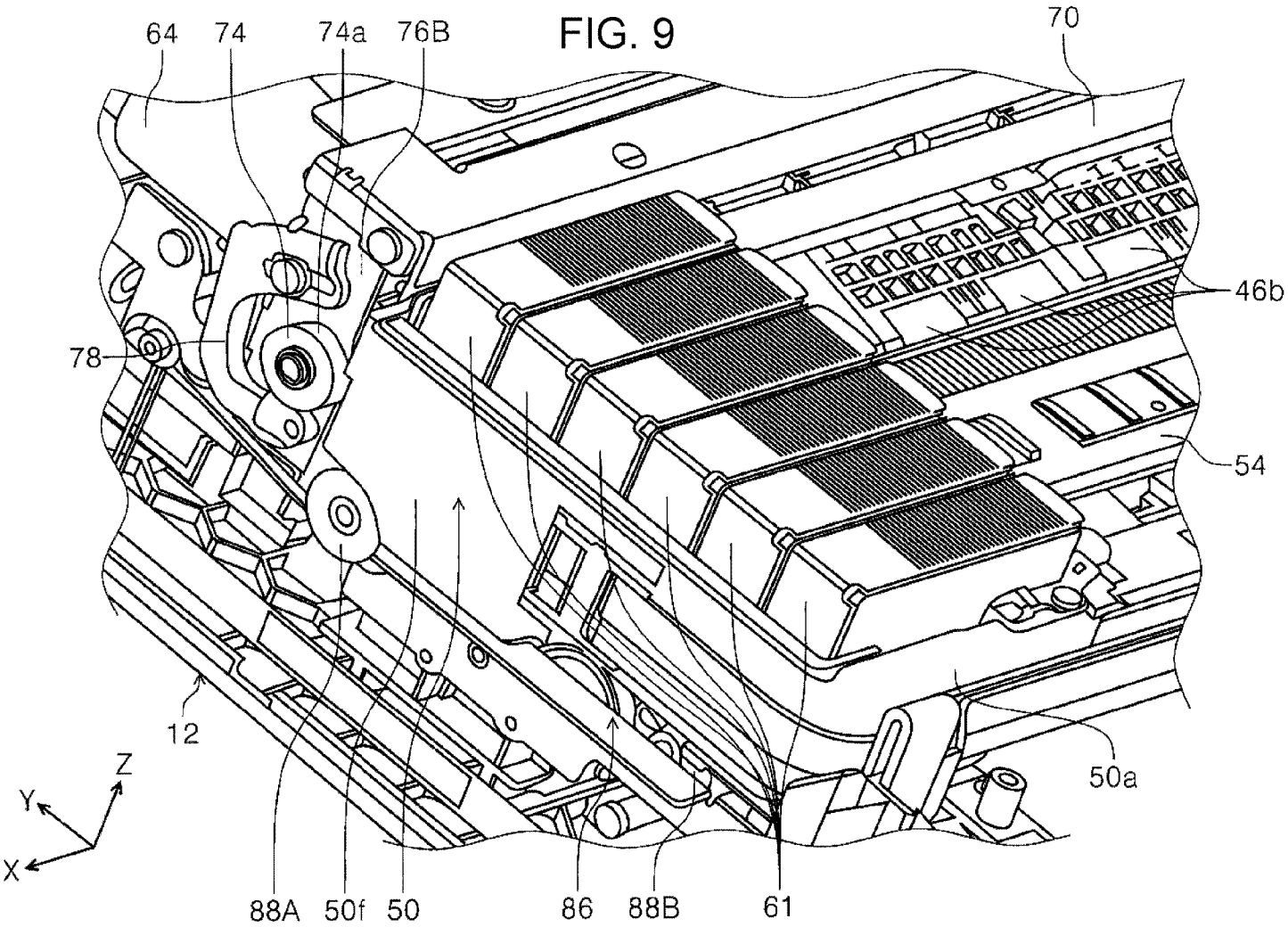
FIG. 9 is a perspective view illustrating a state in which the carriage is positioned in an end portion in the apparatus main body on a left side in an apparatus-width direction.
Figure 10:
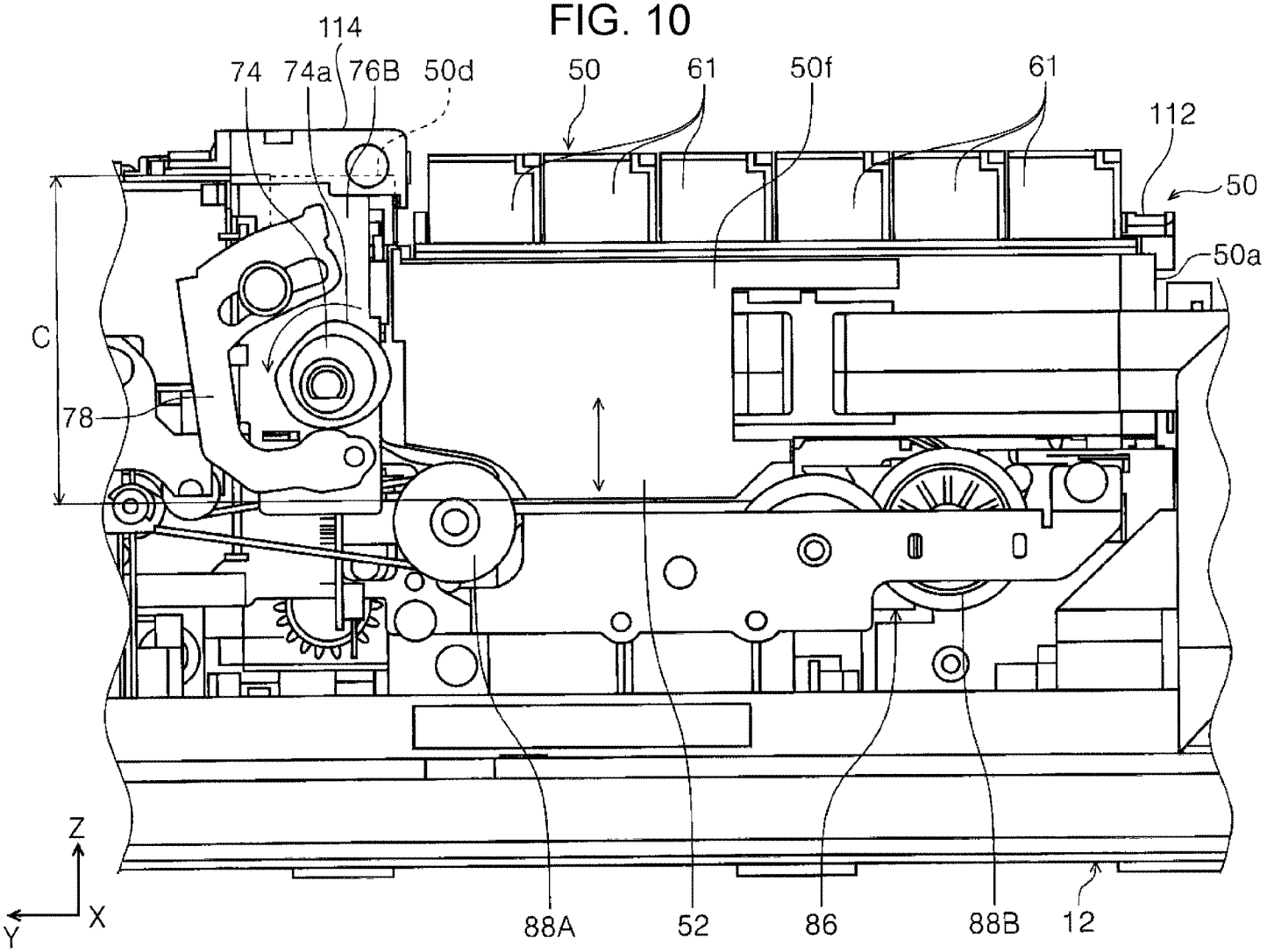
FIG. 10 is a side view illustrating the state in which the carriage is positioned in the end portion in the apparatus main body on the left side in the apparatus-width direction.
Figure 11:
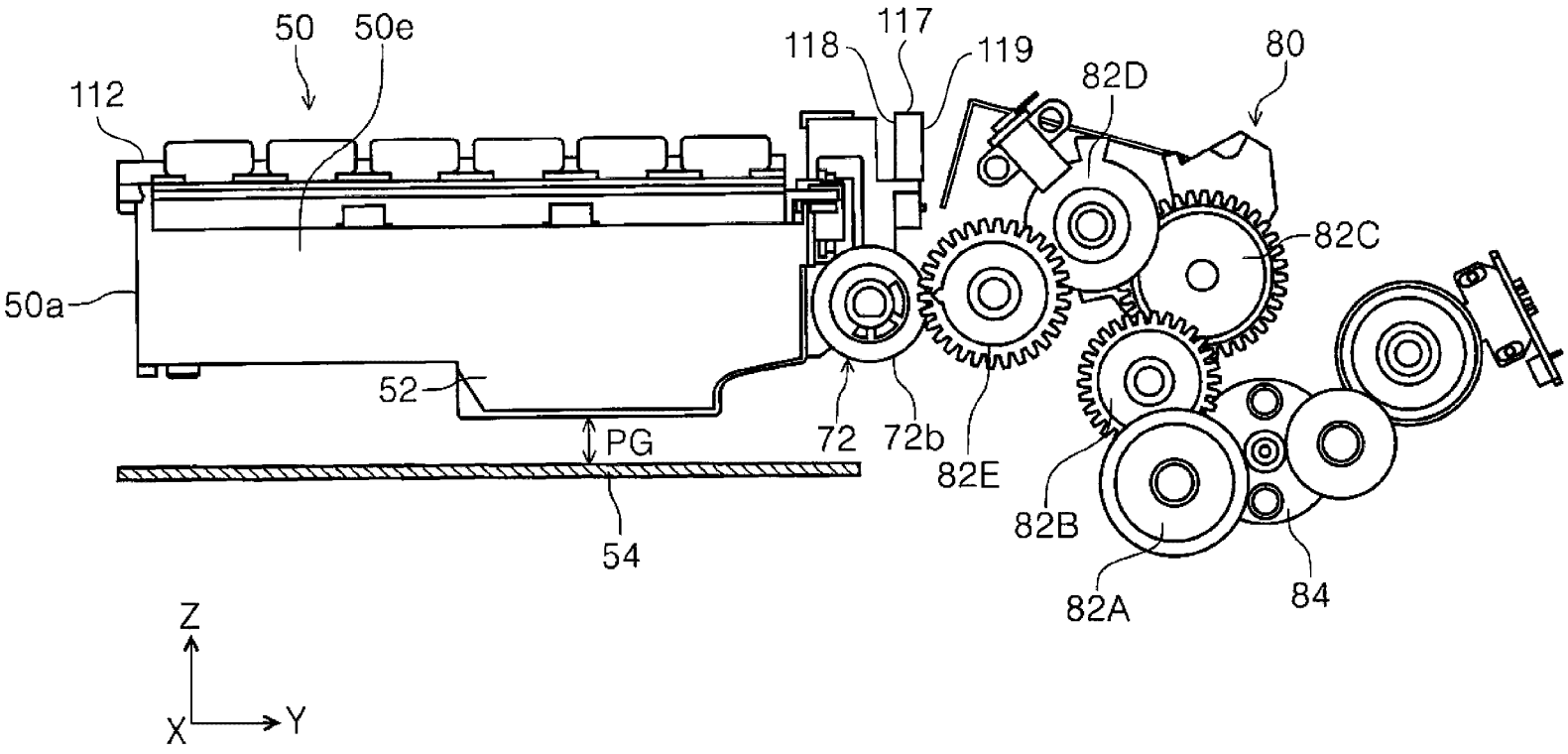
FIG. 11 is a side view of a gap adjusting unit according to a first example.
Figure 12:
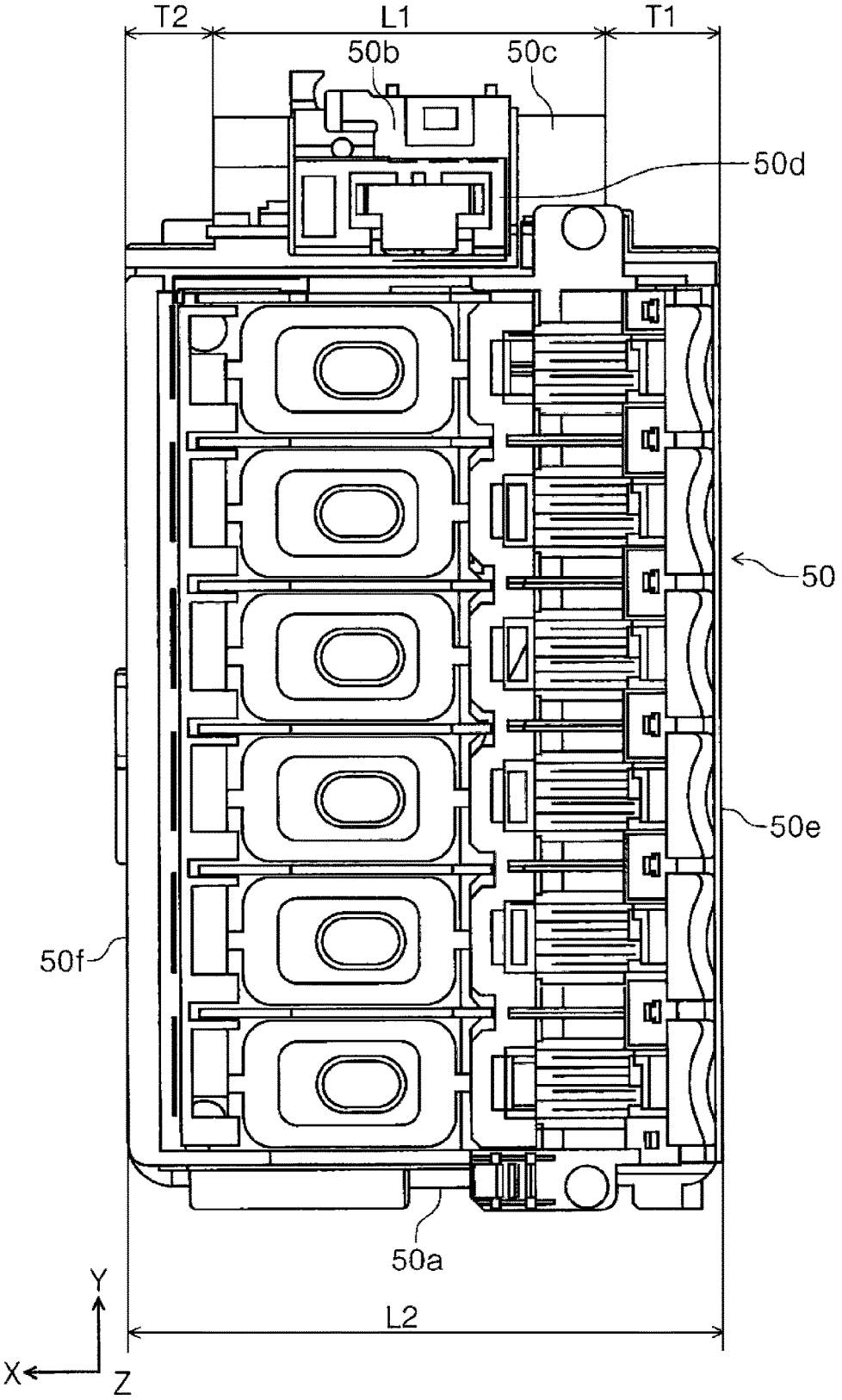
FIG. 12 is a plan view of the carriage according to the invention.
Figure 13:
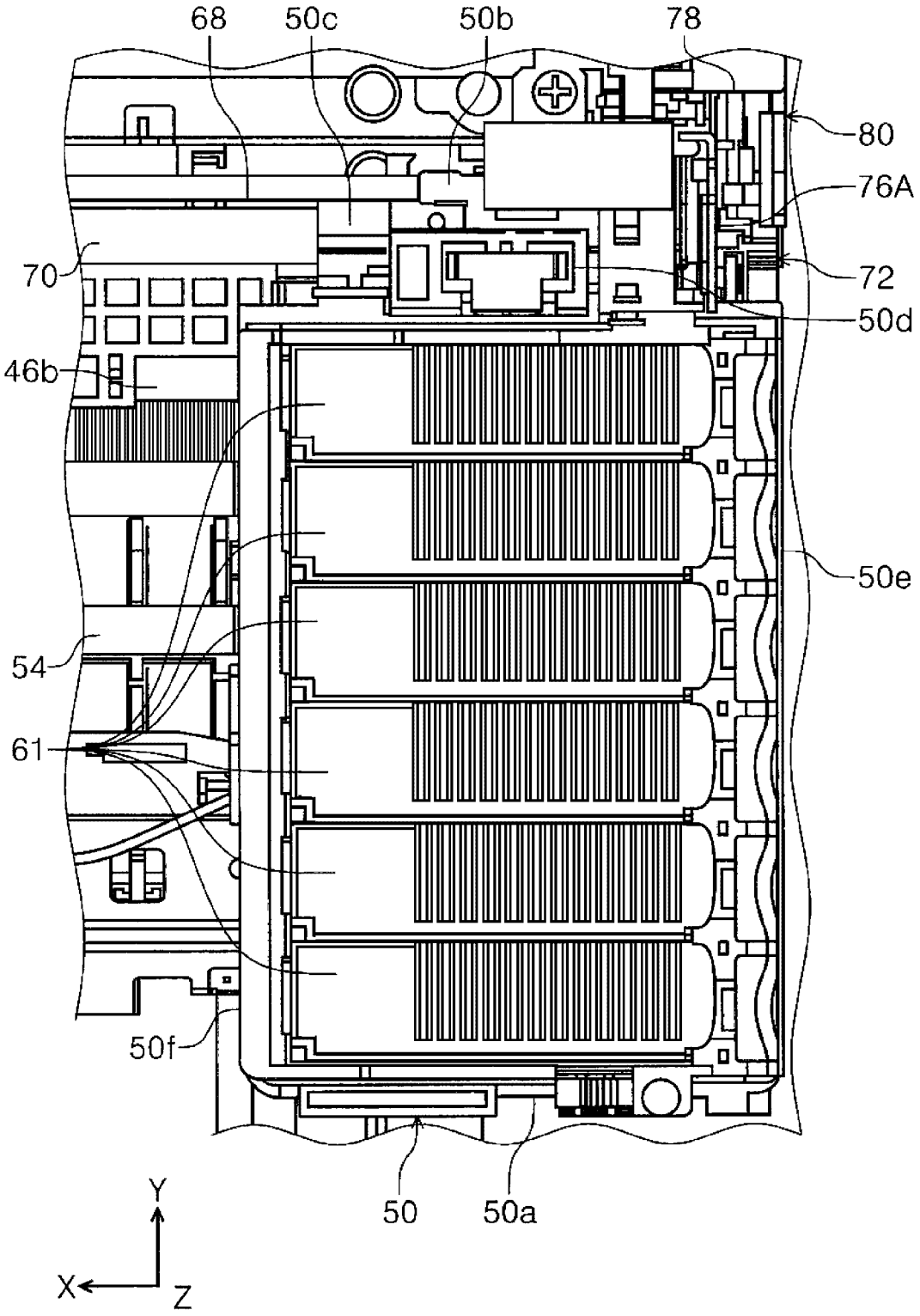
FIG. 13 is a plan view illustrating the state in which the carriage is positioned in the end portion in the apparatus main body on the right side in the apparatus-width direction.
Figure 14:
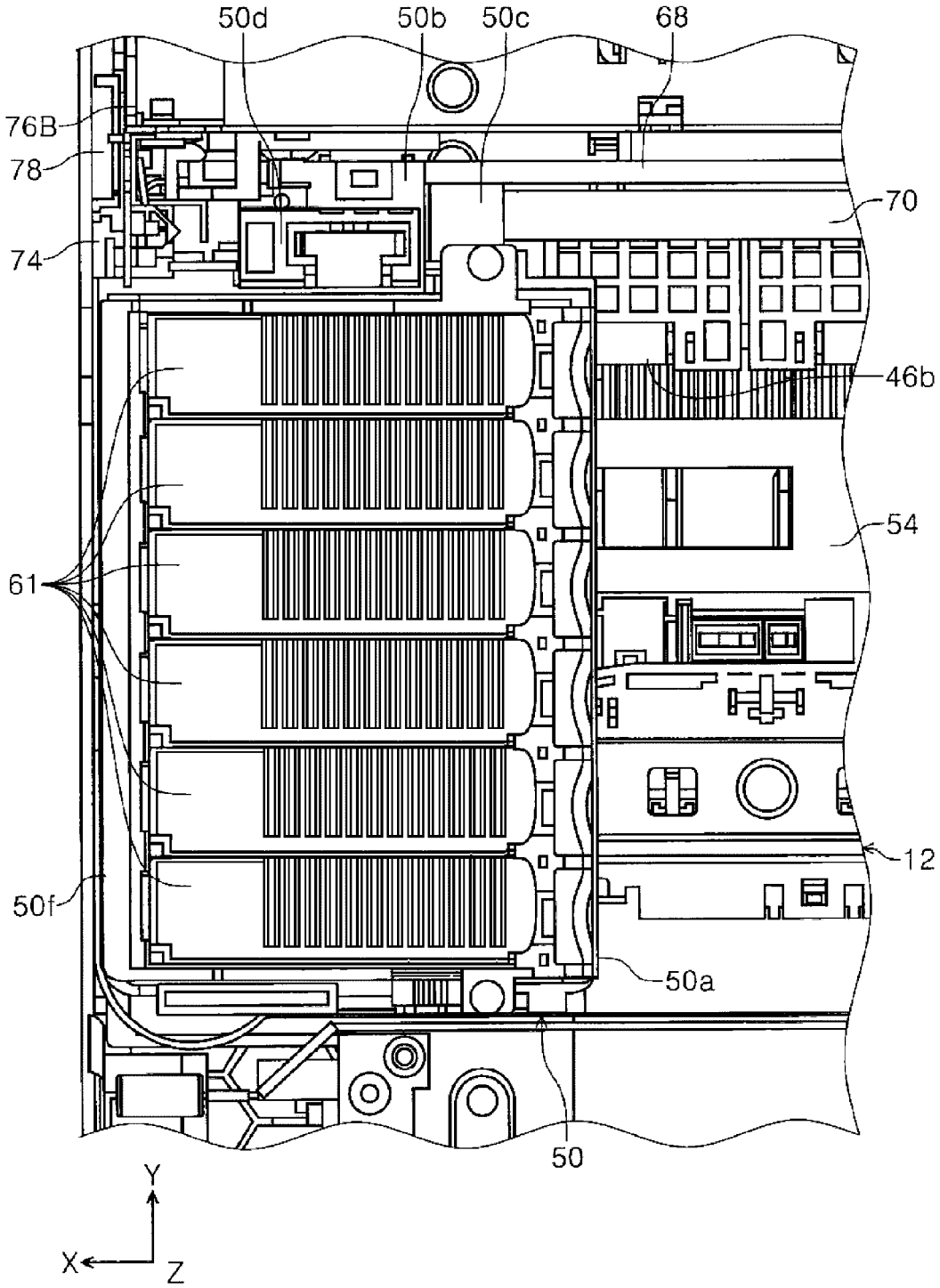
FIG. 14 is a plan view illustrating the state in which the carriage is positioned in the end portion in the apparatus main body on the right side in the apparatus-width direction.

FIG. 9 is a perspective view illustrating a state in which the carriage is positioned in an end portion in the apparatus main body on a left side in an apparatus-width direction. FIG. 10 is a side view illustrating the state in which the carriage is positioned in the end portion in the apparatus main body on the left side in the apparatus-width direction. FIG. 11 is a side view of a gap adjusting unit according to a first example. FIG. 12 is a plan view of the carriage according to the invention. FIG. 13 is a plan view illustrating the state in which the carriage is positioned in the end portion in the apparatus main body on the right side in the apparatus-width direction. FIG. 14 is a plan view illustrating the state in which the carriage is positioned in the end portion in the apparatus main body on the right side in the apparatus-width direction.

Figure 15:
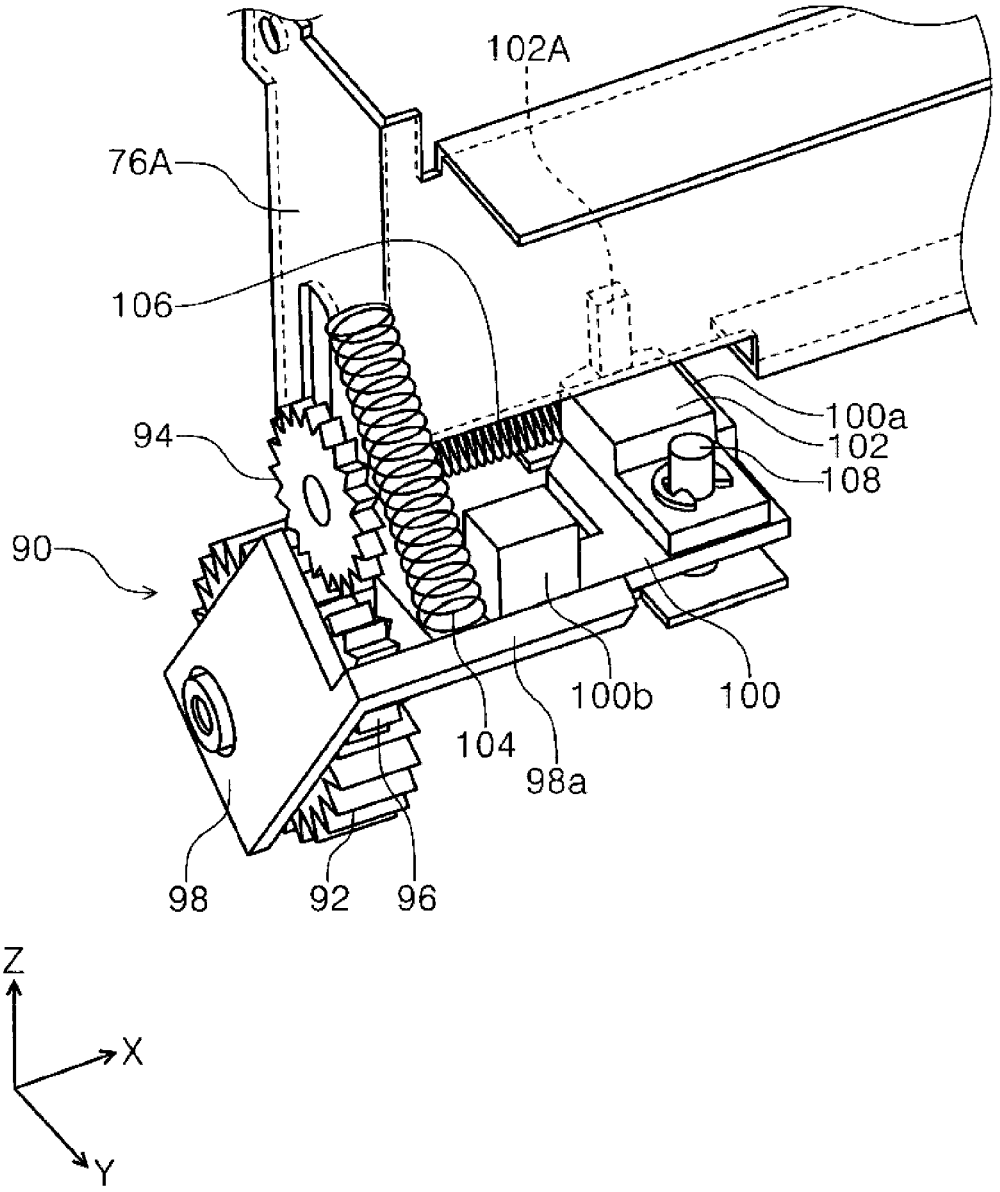
FIG. 15 is a perspective view illustrating a first state in the gap adjusting unit according to a second example when viewed from the rear side.
Figure 16:
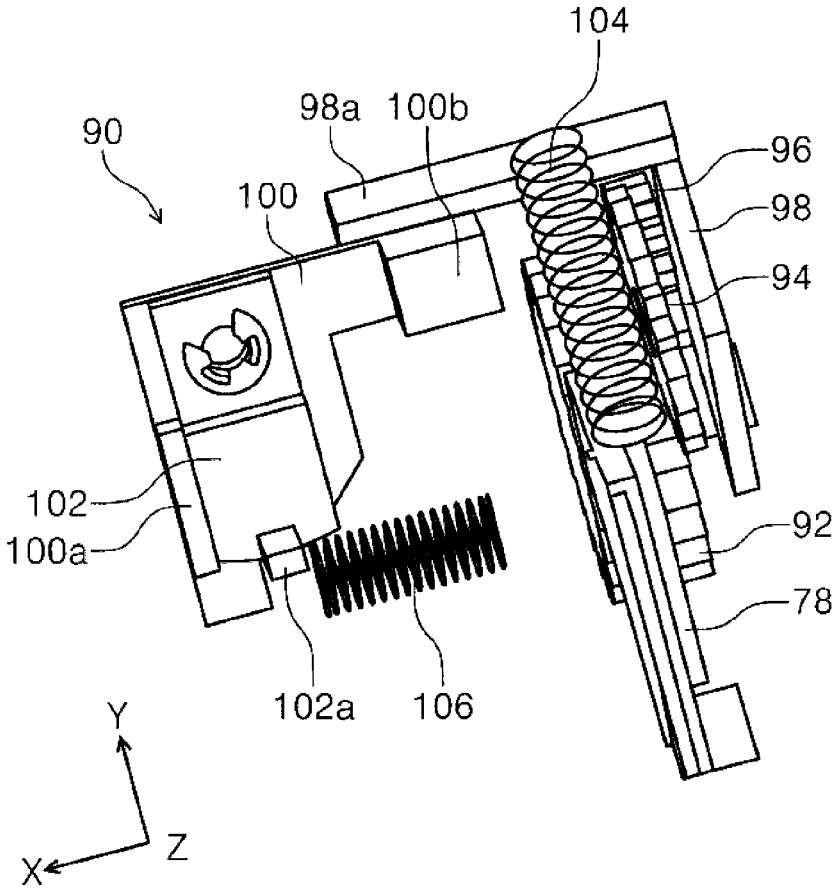
FIG. 16 is a plan view illustrating the first state in the gap adjusting unit according to the second example when viewed from above.
Figure 17:
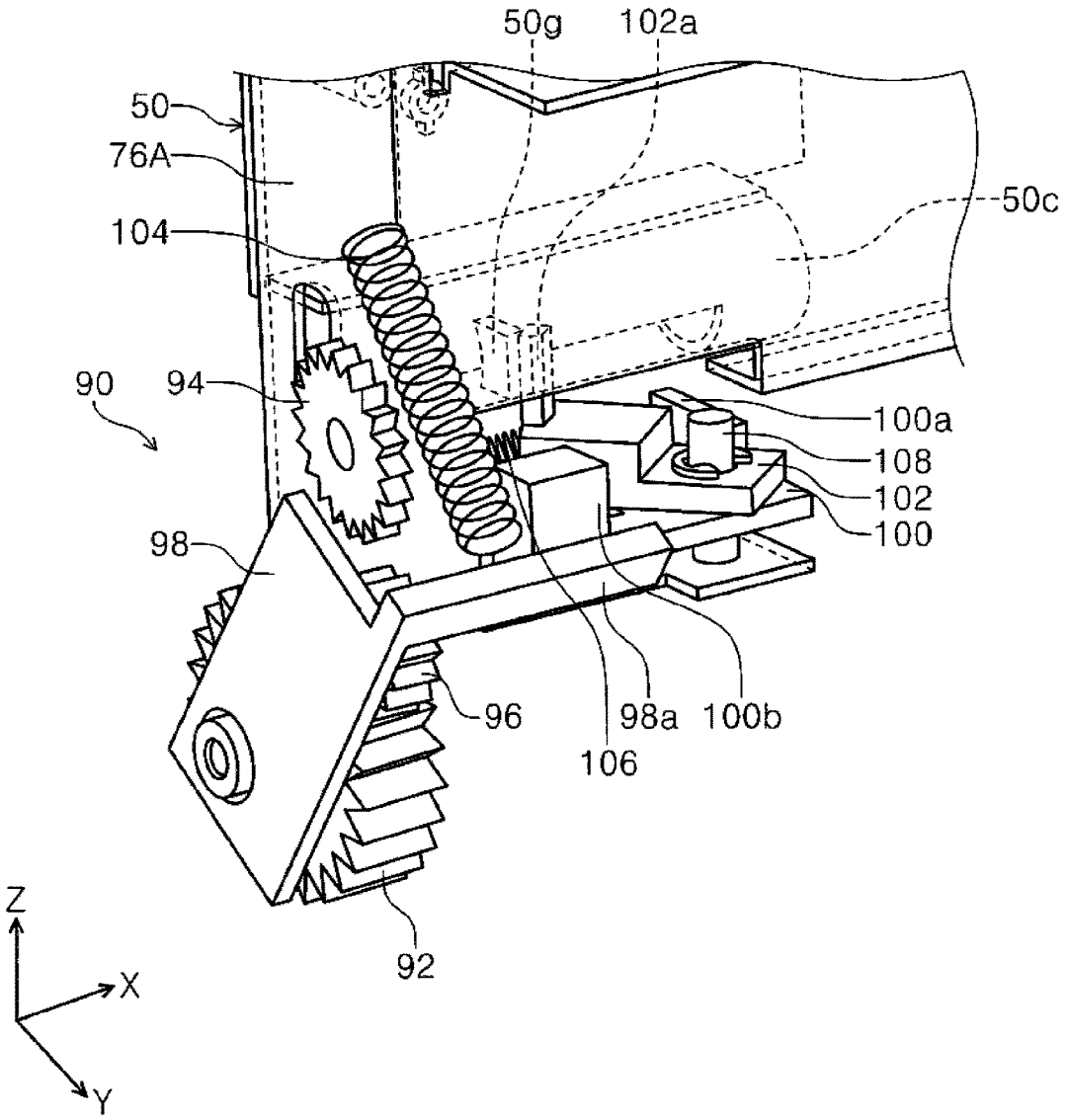
FIG. 17 is a perspective view illustrating a second state in the gap adjusting unit according to the second example when viewed from the rear side.
Figure 18:
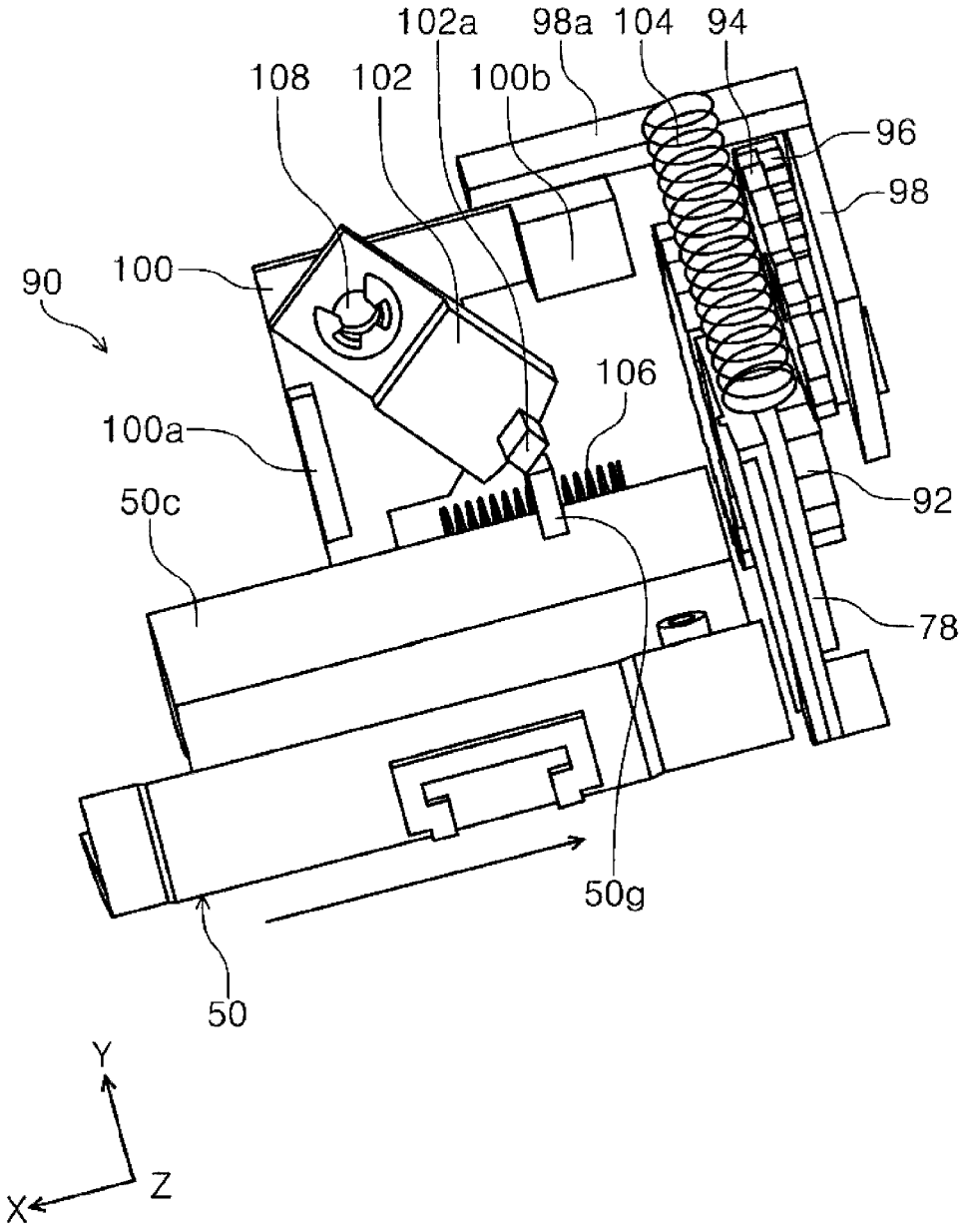
FIG. 18 is a plan view illustrating the second state in the gap adjusting unit according to the second example when viewed from above.
Figure 19:
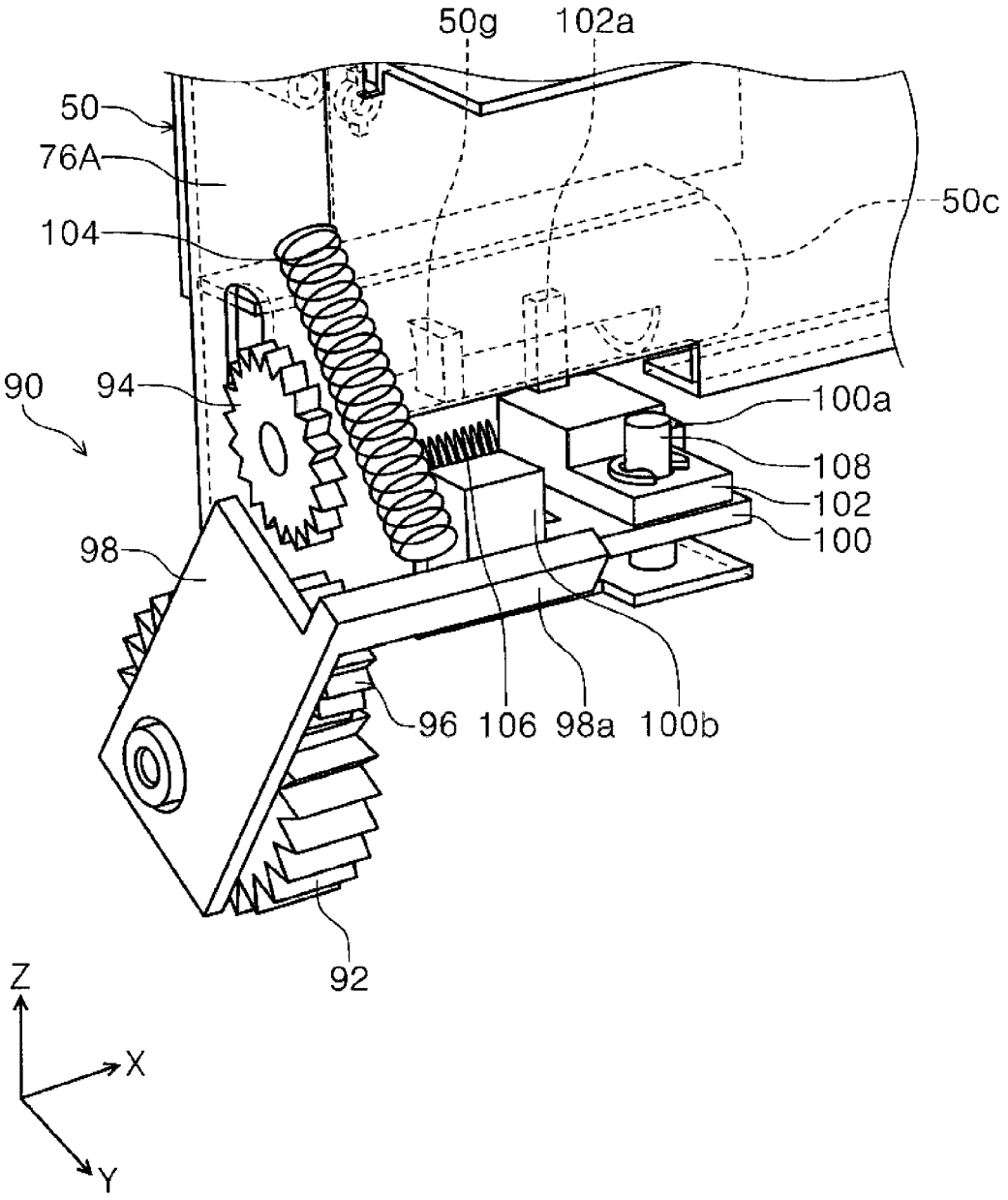
FIG. 19 is a perspective view illustrating a third state in the gap adjusting unit according to the second example when viewed from the rear side.
Figure 20:
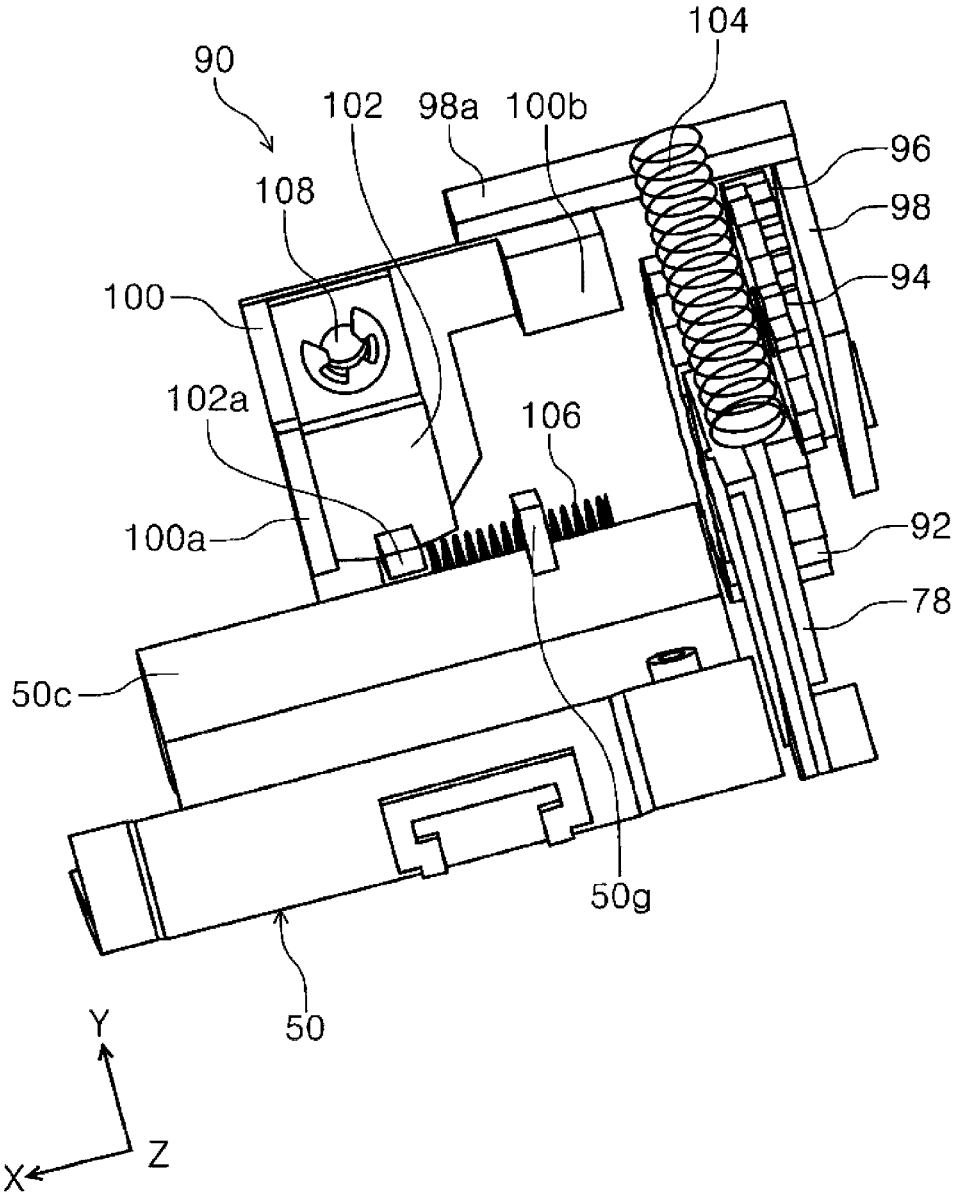
FIG. 20 is a plan view illustrating the third state in the gap adjusting unit according to the second example when viewed from above.

FIG. 15 is a perspective view illustrating a first state in the gap adjusting unit according to a second example when viewed from the rear side. FIG. 16 is a plan view illustrating the first state in the gap adjusting unit according to the second example when viewed from above. FIG. 17 is a perspective view illustrating a second state in the gap adjusting unit according to the second example when viewed from the rear side. FIG. 18 is a plan view illustrating the second state in the gap adjusting unit according to the second example when viewed from above. FIG. 19 is a perspective view illustrating a third state in the gap adjusting unit according to the second example when viewed from the rear side. FIG. 20 is a plan view illustrating the third state in the gap adjusting unit according to the second example when viewed from above.

Figure 21:
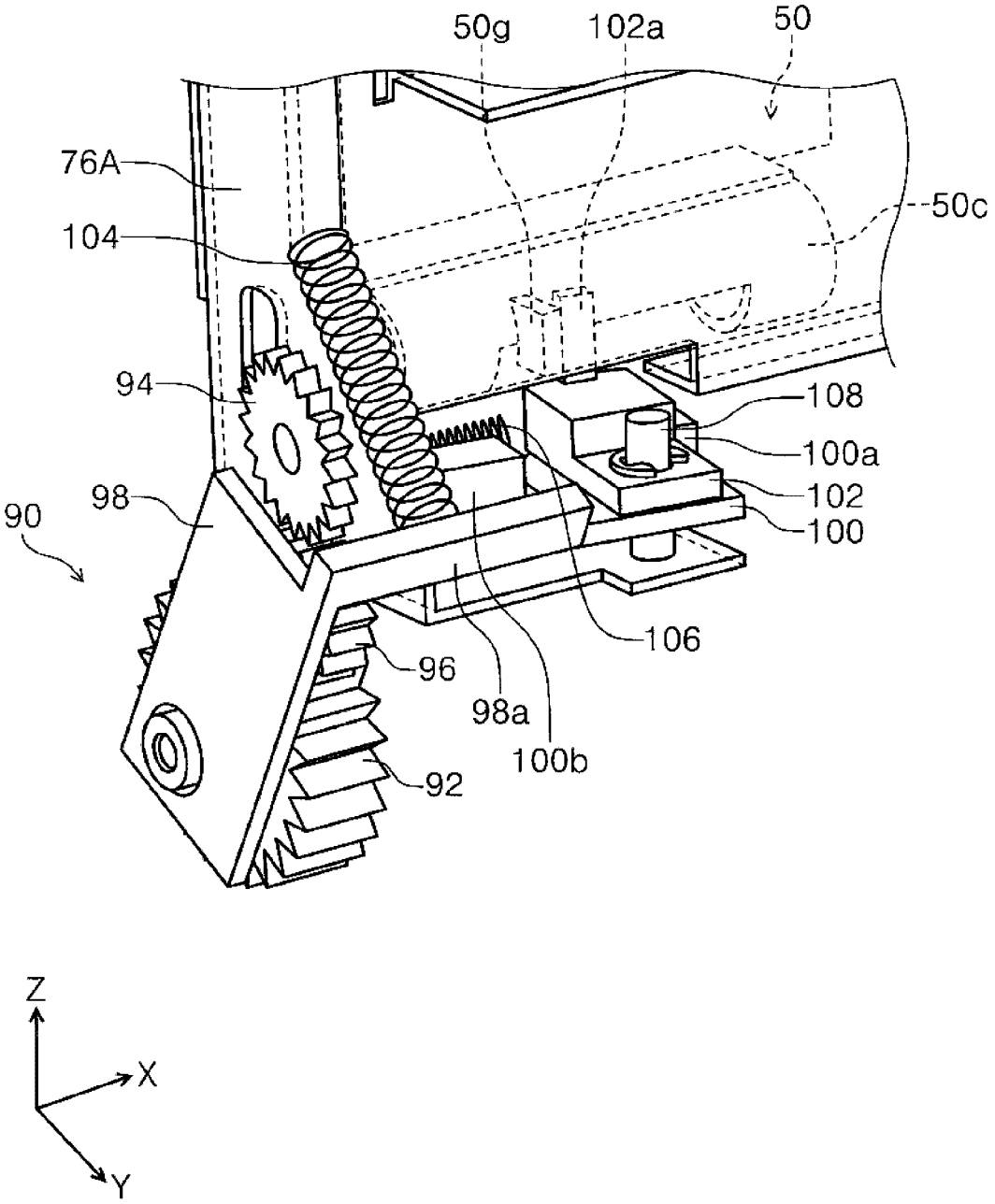
FIG. 21 is a perspective view illustrating a fourth state in the gap adjusting unit according to the second example when viewed from the rear side.
Figure 22:
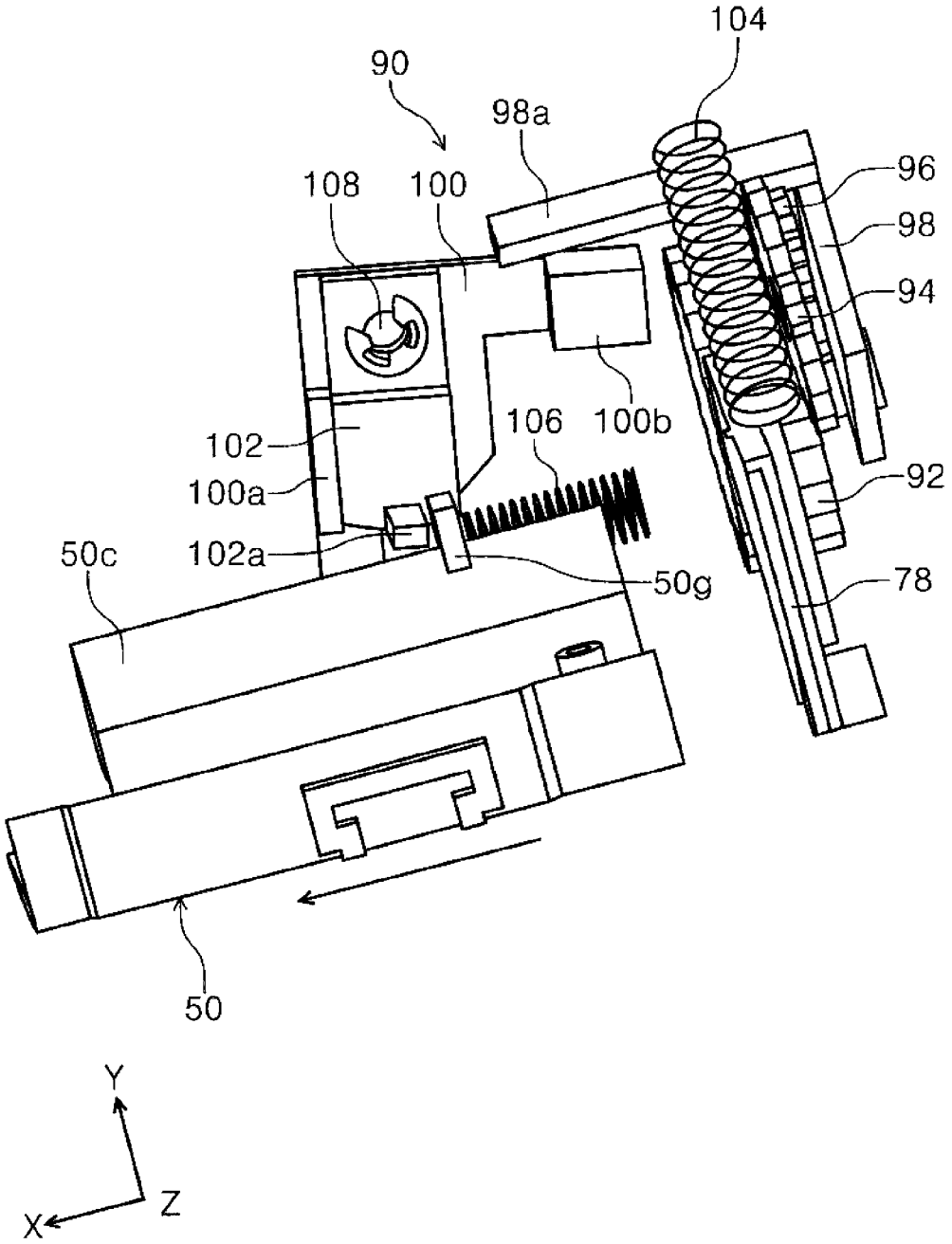
FIG. 22 is a plan view illustrating the fourth state in the gap adjusting unit according to the second example when viewed from above.
Figure 23:
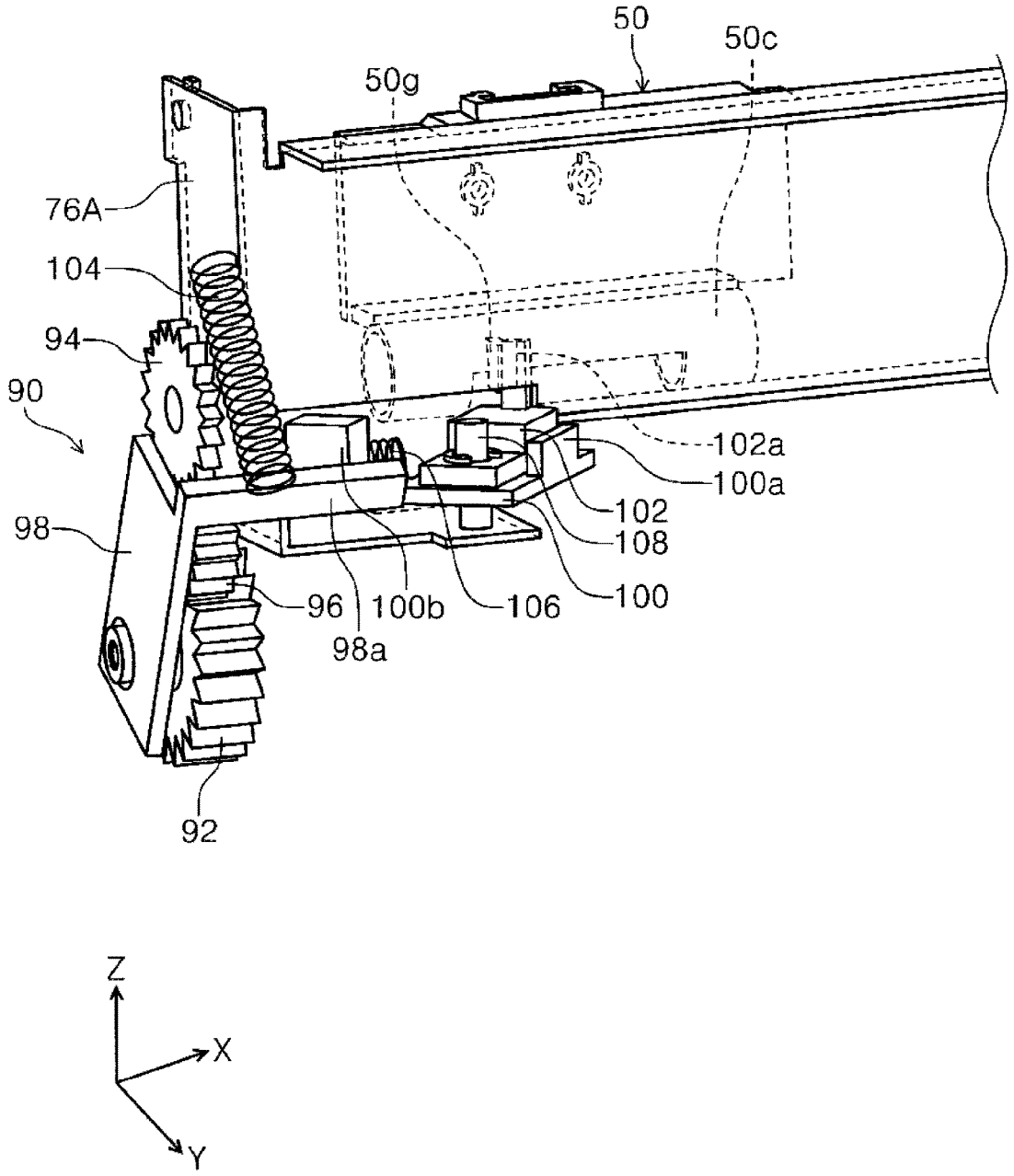
FIG. 23 is a perspective view illustrating a fifth state in the gap adjusting unit according to the second example when viewed from the rear side.
Figure 24:
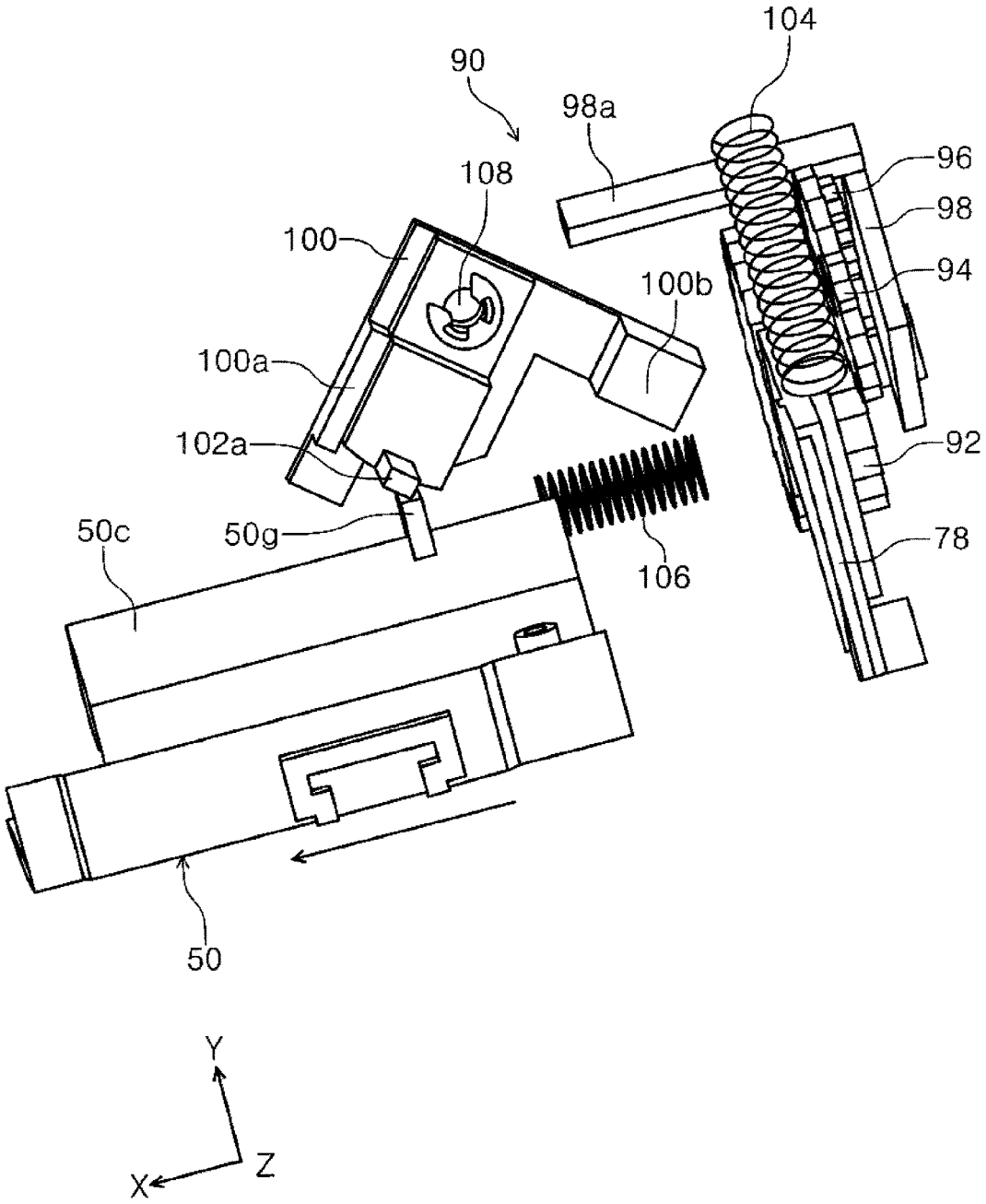
FIG. 24 is a plan view illustrating the fifth state in the gap adjusting unit according to the second example when viewed from above.

FIG. 21 is a perspective view illustrating a fourth state in the gap adjusting unit according to the second example when viewed from the rear side. FIG. 22 is a plan view illustrating the fourth state in the gap adjusting unit according to the second example when viewed from above. FIG. 23 is a perspective view illustrating a fifth state in the gap adjusting unit according to the second example when viewed from the rear side. FIG. 24 is a plan view illustrating the fifth state in the gap adjusting unit according to the second example when viewed from above.

In addition, in an X-Y-Z coordinate system illustrated in the figures, an X direction represents a main-scanning direction (moving direction) of the carriage, that is, a width direction of the recording apparatus, a Y direction represents a depth direction of the recording apparatus, and a Z direction represents the apparatus-height direction. Note that, in the figures, a +X direction side as a "second direction" is the left side of the apparatus, a −X direction side as a "first direction" is the right side of the apparatus, a −Y direction is the front side of the apparatus, a +Y direction side is the rear side of the apparatus, a +Z-axial direction side is the upper side of the apparatus, and a −Z-axial direction side is the lower side of the apparatus.

First Example

Overview of Printer

With reference to FIG. 1, the printer 10 includes an apparatus main body 12 and a scanner unit 14 provided above the apparatus main body 12. An operating unit 16 is provided on an apparatus-front side of the apparatus main body 12 so as to be movable with respect to the apparatus main body 12. The operating unit 16 is provided with a display portion 18 such as a display panel.

A cover 20 is attached below the operating unit 16 on the apparatus-front side of the apparatus main body 12 so as to be movable with respect to the apparatus main body 12. In addition, the apparatus main body 12 is provided with a copy-receiving tray 22. The copy-receiving tray 22 is configured to be switchable between a state of being accommodated in the apparatus main body 12 and a state (refer to a portion in a two-dot chain line in FIG. 1) of being extended to the apparatus-front side of the apparatus main body 12.

In addition, a cover 24 is attached to be rotatable in an upper portion of the apparatus main body 12 on the rear side. The cover 24 is configured to be switchable between a closing state with respect to the apparatus main body 12 illustrated in FIG. 1 and an opening state (not illustrated) with respect to the apparatus main body 12. When the cover 24 is in the opening state with respect to the apparatus main body 12, a feeding port 28 (refer to FIG. 2) of a medium guiding route 26 to be described below is exposed. It is possible to insert a medium into the feeding port 28 in an arrow A direction illustrated in FIG. 1. The medium inserted into the apparatus main body 12 in the arrow A direction is guided to the inclined medium guiding route 26 illustrated in FIG. 3 and is fed to the downstream side in a transport direction.

In addition, as illustrated in FIG. 2, the scanner unit 14 is provided above the apparatus main body 12. The scanner unit 14 is provided with a platen 30. The platen 30 is formed of a glass plate as an example and is configured to have a top surface on which an original document is mountable.

In addition, the scanner unit 14 is provided with a cover 32 that is opened and closed in an upper portion of the scanner unit 14. The cover 32 covers the platen 30 in the closing state (refer to FIGS. 1 and 2) and exposes the platen 30 in the opening state (not illustrated). In other words, the cover 32 is caused to rotate with respect to the platen 30 so as to be in the opening state, the platen 30 is exposed, the original document is set on the top surface thereof, and the cover 32 is closed. In this manner, it is possible to read the original document on the platen 30. Note that a reading unit (not illustrated) that is capable of reading the original document set on the platen 30 is provided below the platen 30.

Overview of Medium Transport Route

Subsequently, a transport route of the medium in the printer 10 will be described with reference to FIG. 2. A medium accommodating unit 34, in which the medium is accommodated, is provided in a lower portion of the apparatus main body 12. In the example, the medium accommodating unit 34 is configured to be attachable to and detachable from the apparatus main body 12 from the apparatus-front side by opening the cover 20 with respect to the apparatus main body 12.

A pick-up roller 36 is provided on an upper side of the medium accommodating unit 34 in the apparatus main body 12 on the rear side thereof. The pick-up roller 36 is configured to be rotatable around a rotary shaft 38 as the rotation center. The pick-up roller 36 is in contact with the medium accommodated in the medium accommodating unit 34, thereby transporting the uppermost medium of the media accommodated in the medium accommodating unit 34 along the medium transport route 40 to the downstream side in the transport direction. Note that a bold line in FIG. 2 represents a route of the medium that is transported along the medium transport route 40.

A reverse roller 42 is provided on the medium transport route 40 on the downstream side of the pick-up roller 36. Driven rollers 44*a*, 44*b*, and 44*c* are provided on the periphery of the reverse roller 42 so as to be driven and rotatable with respect to the reverse roller 42.

The medium fed by the pick-up roller 36 is fed via the reverse roller 42 and the driven rollers 44*a* and 44*b* to a transport roller pair 46 as a "transport unit" provided on the downstream side in the transport direction. As illustrated in FIG. 3, the transport roller pair 46 in the example includes a transport driving roller 46*a* that receives a driving force from a driving source (not illustrated) and a transport driven roller 46*b* that is driven to rotate with respect to the transport driving roller 46*a*.

In addition, a recording unit 48 is provided on the downstream side of the transport roller pair 46 in the transport direction. The recording unit 48 is provided above the medium accommodating unit 34 in an apparatus-height direction. The recording unit 48 in the example includes a carriage 50, a recording head 52, a medium guiding member 54, and a carriage driving unit 62 (refer to FIG. 4). The carriage 50 in the example is configured to be capable of reciprocating in the apparatus-width direction. The recording head 52 (refer to FIG. 2) is provided in a lower portion of the carriage 50. In the example, the recording head 52 is configured to discharge inks as "liquids" toward the lower side in the apparatus-height direction.

In addition, as illustrated in FIG. 3, the medium guiding member 54 is provided below the recording head 52 in a region facing the recording head 52. The medium guiding member 54 is disposed to face the recording head 52 with a gap from the recording head 52. In other words, there is a gap PG (refer to FIG. 11) defined between the recording head 52 and the medium guiding member 54. The gap PG in the example is adjustable in the apparatus-height direction depending on the thickness of the medium that is transported to the recording unit 48.

The medium guiding member 54 supports the reverse (a surface on a side opposite to the recording surface) of the medium that is transported and reaches, by the transport roller pair 46, the region facing the recording head 52. The recording head 52 discharges the inks to the medium supported by the medium guiding member 54 and performs the recording on the recording surface of the medium.

The medium, on which the recording is performed, is nipped by the discharge roller pair 56 as a "transport unit" provided on the downstream side of the recording unit 48 in the transport direction, and is received in the copy-receiving tray 22 (refer to FIG. 1) that projects to the apparatus-front side.

In addition, when the cover 24 provided on the rear side of the apparatus main body 12 has an opening posture, the feeding port 28 of the medium guiding route 26 is exposed. The medium guiding route 26 includes a guiding portion 58 and a feed roller 60. The medium guiding route 26 in the example is provided between the reverse roller 42 and the transport roller pair 46 in an apparatus-depth direction.

The medium guiding route 26 is configured to feed, by the feed roller 60, the medium inserted into the feeding port 28, between the reverse roller 42 and the transport roller pair 46 in the medium transport route 40.

The medium guided between the reverse roller 42 and the transport roller pair 46 in the medium transport route 40 is transported to the recording unit 48 by the transport roller pair 46, recording is performed on the medium in the recording unit 48, and the medium is discharged by the discharge roller pair 56 toward the copy-receiving tray 22.

In addition, after the recording is performed on a first surface (recording surface) of the medium in the recording unit 48, the transport driving roller 46*a* (refer to FIG. 3) is reversed and the medium is transported to the upstream side in the transport direction in a case where recording is to be performed on a second surface (the reverse) on the side opposite to the first surface. The medium, which is transported to the upstream side in the transport direction, is nipped between the reverse roller 42 and the driven roller 44*c* through the lower side of the guiding portion 58. The first surface and the second surface of the medium are reversed from each other by the reverse roller 42, and the medium is again transported to the recording unit 48, the recording is performed on the second surface in the recording unit 48, and then the medium is discharged toward the copy-receiving tray 22.

Overview of Carriage and Carriage Driving Unit

With reference to FIGS. 3 to 6, 13, and 14, the carriage 50 includes a box-shaped housing 50*a* as a "main body of the carriage 50", a grip portion 50*b*, a bearing 50*c*, and a surrounding portion 141, as illustrated in FIG. 5. The housing 50*a* in the example is open upward and a plurality of ink cartridges 61 are detachably attached to the housing 50*a*. The ink cartridges 61 in the example are arranged in the apparatus-depth direction in a direction intersecting with the apparatus-width direction as the moving direction of the carriage 50. The grip portion 50*b* and the bearing 50*c* are provided on the rear side of the housing 50*a*.

As illustrated in FIG. 4, the carriage driving unit 62 is provided in the apparatus main body 12 on the rear side of the carriage 50. In the example, the carriage driving unit 62 includes a carriage driving motor 64 as an example, a driving pulley 66, a driven pulley 63, and a driving belt 68. In the example, the carriage driving motor 64 is provided on an apparatus-left side in the apparatus-width direction. The driving pulley 66 is attached to the carriage driving motor 64. In addition, the driven pulley 63 is disposed on an apparatus-right side with a gap from the driving pulley 66 in the apparatus-width direction.

In the example, the carriage driving motor 64 is provided on the apparatus-left side of the apparatus main body 12 in the apparatus-width direction. In other words, the carriage driving motor 64 is attached to an end portion of a frame member 142 the left side in the apparatus-width direction. The driving pulley 66 is attached to the carriage driving motor 64. In addition, the driven pulley 63 is disposed on the apparatus-right side of the apparatus main body 12 with the gap from the driving pulley 66 in the apparatus-width direction.

The driving belt 68 is looped around the driving pulley 66 and the driven pulley 63. In addition, the grip portion 50*b* provided on the rear side of the carriage 50 grips at least a part of the driving belt 68. When a control unit 65 drives and rotates the carriage driving motor 64, the driving pulley 66 is also driven and rotated in a rotating direction of the carriage driving motor 64. The driving belt 68 is also driven in the same rotating direction. As a result, the carriage 50 is caused to move in the apparatus-width direction by the carriage driving unit 62. In the example, the carriage 50 is capable of reciprocating within a moving range B illustrated in FIGS. 3 and 4 in the apparatus-width direction. The moving range B is provided in a region between the end portion on the right side and the end portion on the left side in the apparatus-width direction. In other words, the carriage 50 is movable in the apparatus-width direction from a state in a two-dot chain line which is assigned with reference sign 50' positioned on the left side in the apparatus-width direction in FIG. 4 to a state in a solid line which is assigned with reference sign 50 on the right side in the apparatus-width direction. The moving range B in the apparatus-width direction is provided with a recording region D in which the recording head 52 performs recording on the medium transported to the recording unit 48.

In addition, as illustrated in FIG. 4, in the example, a home position of the carriage 50 in the moving range B in the apparatus-width direction is set at the end portion of the apparatus main body 12 on the apparatus-right side, that is, at a position outside the recording region D. In other words, the state in which the carriage 50 is positioned at the end portion of the apparatus main body 12 on the apparatus-right side means that the carriage 50 is disposed at the home position.

In addition, the control unit 65 in the example causes the carriage 50 to come into bump contact with the end portion on the right side in the apparatus-width direction in the moving range B, and thereby it is possible to perform a position detecting operation of detecting a position of the carriage 50 in the moving range B. As an example, a positioning portion 69 is provided to come into contact with at least a part of the carriage 50 at the home position of the carriage 50.

When the control unit 65 causes the carriage 50 to move from the left side toward the right side in the moving range B in the apparatus-width direction, the carriage 50 comes into contact with the positioning portion 69. As a result, the positioning portion 69 regulates movement of the carriage 50 to the right side in the apparatus-width direction. When the movement of the carriage 50 is regulated, a current value of the carriage driving motor 64 increases. The control unit 65 detects an increase in the current value of the carriage driving motor 64 and detects that the carriage 50 is positioned at the home position.

Note that the home position detecting operation is set to be performed in a state other than a state in which the gap PG to be described below is the maximum.

In addition, when the carriage 50 is positioned at the home position, a cap 67 is provided at a position facing the recording head 52 on the lower side from the recording head 52. When the carriage 50 is positioned at the home position, the cap 67 faces the recording head 52, is pressed by the recording head 52, and seals a nozzle-formed surface provided on an underside of the recording head 52 such that it is possible to prevent inks from drying.

Figure 27:
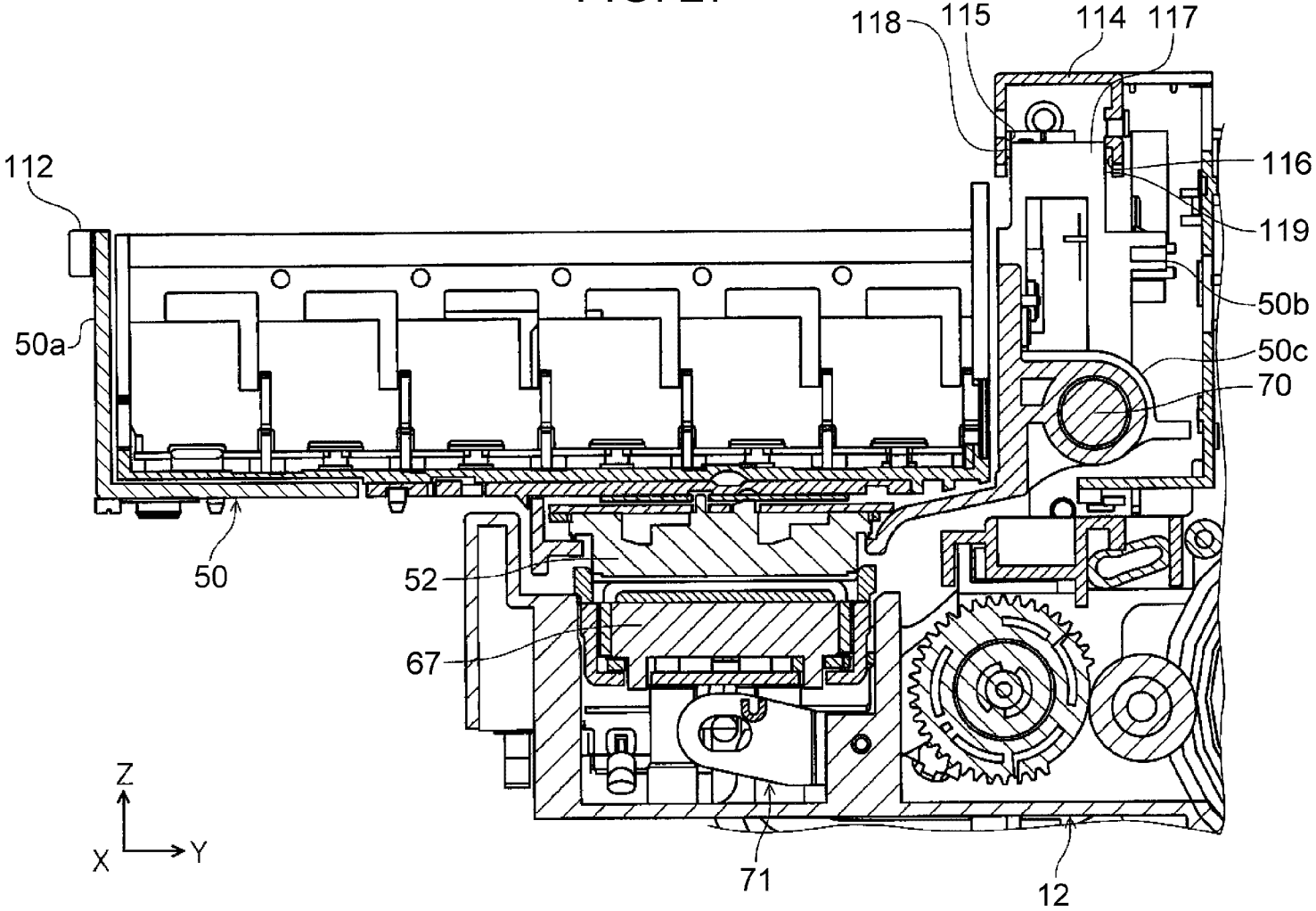
FIG. 27 is a sectional side view illustrating a state immediately before the carriage is capped in a case where a gap PG has a reference distance.

Here, with reference to FIG. 27, the cap 67 is configured to be movable up and down in the apparatus-height direction by a cap driving unit 71. In this manner, the cap 67 is switchable between a state (refer to FIG. 27) of being separated from the recording head 52 of the carriage 50 positioned at the home position and a state (refer to FIG. 28) of coming into contact with the recording head 52.

Regarding Guide Shaft and Gap Adjusting Cam

In addition, the recording unit 48 is provided with a guiding shaft 70 extending in the apparatus-width direction. In the example, the guiding shaft 70 is inserted into the bearing 50*c* (refer to FIG. 5) provided on the rear side of the carriage 50. When the carriage 50 moves in the apparatus-width direction, the guiding shaft 70 guides the carriage 50.

In addition, as illustrated in FIG. 7, gap adjusting cams 72 and 74 are provided as "cams" at both end portions of the guiding shaft 70. The gap adjusting cams 72 and 74 in the example are provided with cam surfaces 72*a* and 74*a* on outer circumferential portions thereof, respectively. The cam surfaces 72*a* and 74*a* are formed to have a shape having a distance from the rotating center of the gap adjusting cams 72 and 74 to the cam surfaces, which changes in the circumferential direction. In other words, the gap adjusting cams 72 and 74 are configured as eccentric cams. In the example, the gap adjusting cams 72 and 74 are attached to the guiding shaft 70 such that the cam surfaces 72*a* and 74*a* are synchronized with each other. In addition, the gap adjusting cam 72 is provided with a gear 72*b* (refer to FIG. 8).

Here, as illustrated in FIGS. 3, 4, 8, 9, and 10, the apparatus main body 12 is provided with frame members 76A and 76B at both end portions thereof in the apparatus-width direction. The frame members 76A and 76B in the example are provided with elongate holes formed to extend in the apparatus-height direction, and the guiding shaft 70 penetrates through the elongate holes. The gap adjusting cams 72 and 74 are disposed on outer sides of the frame members 76A and 76B in the apparatus-width direction.

In addition, cam followers 78 are attached to the frame members 76A and 76B. As illustrated in FIGS. 8 to 10, the cam followers 78 come into contact with the cam surfaces 72*a* and 74*a* of the gap adjusting cams 72 and 74 so as to support the gap adjusting cams 72 and 74. In other words, when the guiding shaft 70 rotates, the gap adjusting cams 72 and 74 also rotate, and the position of the central axis of the guiding shaft 70 moves up and down with respect to the cam followers 78 in the apparatus-height direction.

In addition, with reference to FIG. 10, the gap adjusting cam 74 and the cam follower 78 are positioned below the top portion 50*d* of the carriage 50 in the apparatus-height direction. Note that FIG. 10 illustrates a case of the minimum gap PG. In a case where the gap PG increases, the carriage 50 shifts upward in the apparatus-height direction from the state illustrated in FIG. 10. In other words, even when the gap PG increases, the gap adjusting cam 74 and the cam follower 78 are positioned below the top portion 50*d* of the carriage 50 in the apparatus-height direction.

In addition, in the example, since the gap adjusting cam 74 and the cam follower 78 are disposed to be positioned in a region occupied by the carriage 50 (within a range region of C illustrated in FIG. 10, that is, a range from the recording head 52 to the top portion 50*d* of the carriage 50), the gap adjusting cam 74 and the cam follower 78 do not project more than the top portion 50*d* of the carriage 50 in the apparatus-height direction, and thus it is possible to decrease the apparatus in size in the apparatus-height direction.

Regarding Gap Adjusting Unit

In addition, as illustrated in FIGS. 3 and 6, a gap adjusting unit 80 is provided at the end portion of the apparatus main body 12 on the right side in the apparatus-width direction. With reference to FIG. 11, the gap adjusting unit 80 in the example includes gears 82A, 82B, 82C, 82D, and 82E and a gap-adjusting-unit driving motor 84. In the example, a rotation driving force of the gap-adjusting-unit driving motor 84 is transmitted to the gears 82A, 82B, 82C, 82D, and 82E, which mesh with each other, in this order. A planetary gear (not illustrated) is provided between the gear 82C and the gear 82D, and the planetary gear is configured to be switchable between a state of meshing with the gear 82D and the state of being separated from the gear 82D.

When the planetary gear meshes with the gear 82D, rotation of the gear 82D is transmitted to the gear 82E. Here, the gear 82E meshes with the gear 72*b* provided in the gap adjusting cam 72. Hence, rotation of the gear 82E is transmitted to the gear 72*b* and the gap adjusting cam 72, and further the guiding shaft 70 rotate. In this manner, the position of the central axis of the guiding shaft 70 moves up and down with respect to the cam followers 78 in the apparatus-height direction, that is, the carriage 50 moves up and down with respect to the medium guiding member 54 and the gap PG changes.

Note that the gap PG in the example, that is, a distance between the recording head 52 an the medium guiding member 54, as an example, is set to be adjustable at four levels depending on a thickness of the medium that is transported to the recording unit 48.

Regarding Relationship Between Carriage and Gap Adjusting Unit in Apparatus-Width Direction With reference to FIG. 12, a length L1 of the bearing 50*c* of the carriage 50 in the apparatus-width direction is set to be smaller than a length L2 of the housing 50*a*. The bearing 50*c* is disposed at the central portion of the housing 50*a* in the apparatus-width direction. In other words, regions T1 and T2 are provided on both sides of the bearing 50*c* in the apparatus-width direction. On the rear side of the housing 50*a* in the example, the region T1 is formed on the right side from the bearing 50*c* in the apparatus-width direction and the region T2 is formed on the left side from the bearing 50*c* in the apparatus-width direction.

As illustrated in FIG. 13, when the carriage 50 is caused to move to the right end of the moving range B (refer to FIGS. 3 and 4) of the carriage 50 in the apparatus-width direction, the carriage 50 is positioned at the end portion of the apparatus main body 12 on the right side in the apparatus-width direction. In this state, the gap adjusting cam 72 and the cam follower 78 enter the region T1 on the rear side of the carriage 50. In other words, at least a part of the carriage 50 and at least a part of the gap adjusting cam 72 overlap each other, that is, are disposed at the same position in the apparatus-width direction.

In addition, in FIGS. 12 and 13, when a side of the housing 50*a* of the carriage 50 on the right side in the apparatus-width direction is referred to as a side 50*e*, in the apparatus-width direction, the gap adjusting cam 72 and the cam follower 78 are configured not to project more to the right side in the apparatus-width direction than the side 50*e*.

In addition, a gear group that configures the gap adjusting unit 80, that is, the gears 82A, 82B, 82C, 82D, and 82E, also enters the region T1 on the rear side of the carriage 50 in the apparatus-width direction. In the apparatus-width direction, the gears 82A, 82B, 82C, 82D, and 82E are configured not to project more to the right side in the apparatus-width direction than the side 50*e* on.

In other words, in the apparatus-width direction, since the carriage 50, the gap adjusting cam 72, the cam follower 78, and the gap adjusting unit 80 are configured to overlap, it is possible to decrease the apparatus in size in the apparatus-width direction, or it is possible to achieve reduction in the size of the apparatus.

Here, with reference to FIGS. 9 and 10, a power transmitting mechanism 86 is provided at an end portion of the apparatus main body 12 in the apparatus-width direction. The power transmitting mechanism 86 is configured to transmit a driving force from the driving source (not illustrated) provided in the apparatus main body 12, for example, to the transport driving roller 46*a* and the discharge roller pair 56.

As an example, a gear 88A is attached to a rotary shaft of the transport driving roller 46*a*, and the gear 88A and the transport driving roller 46*a* are configured to rotate in the same direction. The power transmitting mechanism 86 is configured to transmit the driving force from the driving source (not illustrated) to the gear 88A. In addition, a gear 88B is configured to rotate and drive a driving roller (not illustrated) in the discharge roller pair 56. The gear 88A and the gear 88B are configured to transmit the driving force via a plurality of gears.

Subsequently, in FIGS. 12 and 14, a side of the housing 50*a* of the carriage 50 on the left side in the apparatus-width direction is referred to as a side 50*f*. As illustrated in FIG. 14, when the carriage 50 is caused to move to the left end of the moving range B (refer to FIGS. 3 and 4) of the carriage 50 in the apparatus-width direction, the carriage 50 is positioned at the end portion of the apparatus main body 12 on the left side in the apparatus-width direction.

In this state, the gap adjusting cam 74 and the cam follower 78 enter the region T2 on the rear side of the carriage 50. In other words, at least a part of the carriage 50 and at least a part of the gap adjusting cam 74 overlap, that is, are disposed at the same position in the apparatus-width direction. In the example, in the apparatus-width direction, the gap adjusting cam 74 and the cam follower 78 are configured not to project more to the left side in the apparatus-width direction than the side 50*f*.

In addition, in the state in which the carriage 50 is positioned at the end portion of the apparatus main body 12 on the left side in the apparatus-width direction, the power transmitting mechanism 86 is disposed to be positioned below the carriage 50 as illustrated in FIGS. 9 and 10. In other words, as illustrated in FIG. 14, the power transmitting mechanism 86 is disposed not to project more to the left side in the apparatus-width direction than the side 50*f* of the carriage 50 in the apparatus-width direction.

In the example, in the apparatus-width direction, since the carriage 50, the gap adjusting cam 74, the cam follower 78, and the power transmitting mechanism 86 are configured to overlap, it is possible to decrease the apparatus in size in the apparatus-width direction, or it is possible to achieve reduction in the size of the apparatus.

Modification Example of First Example (1) The example has the configuration in which the scanner unit 14 is provided; however, instead of the configuration, the cover 32 may be attached to be rotatable in the upper portion of the apparatus main body 12 without the scanner unit 14 provided.

(2) The example has the configuration in which the gap adjusting unit 80 is provided at the end portion of the apparatus main body 12 on the right side in the apparatus-width direction and the power transmitting mechanism 86 is provided at the end portion thereof on the left side in the apparatus-width direction; however, instead of the configuration, a configuration, in which the gap adjusting unit 80 is provided at the end portion of the apparatus main body 12 on the left side in the apparatus-width direction and the power transmitting mechanism 86 is provided at the end portion thereof on the right side in the apparatus-width direction, may be employed.

Second Example

Subsequently, a second example of the gap adjusting unit will be described with reference to FIGS. 15 to 24. With reference to FIGS. 15 and 16, the gap adjusting unit 90 is configured to include a first gear 92, a second gear 94, a planetary gear 96, a first member 98, a second member 100, a switching-lever member 102, a first bias member 104, and a second bias member 106.

Note that the first bias member 104 and the second bias member 106 in the example are configured to be a tension spring. Note that a frame of the apparatus main body 12 and the gap adjusting cam 72 are omitted in FIGS. 16, 18, 20, 22, and 24, only a part of the carriage 50 is illustrated in FIGS. 17 to 24, and thus the guiding shaft 70 is omitted in the figures.

In the example, a driving force from the gap-adjusting-unit driving motor 84 is transmitted to the first gear 92. In addition, the first member 98 is attached to the rotary shaft of the first gear 92 so as to be rotatable with respect to the first gear 92. The planetary gear 96 is attached to the first member 98. The planetary gear 96 meshes with the first gear 92 and is configured to be rotatable around the first gear 92. In addition, the first member 98 is provided with an engagement portion 98*a* projecting in the apparatus-width direction. One end of the first bias member 104 is attached to the engagement portion 98*a*. Although not illustrated, the other end of the first bias member 104 is attached to the apparatus main body 12 side. The first bias member 104 biases the first member 98 to the frame member 76A side.

In addition, the second gear 94 is rotatably attached to the frame member 76A. The second gear 94 is disposed to mesh with the gear 72*b* of the gap adjusting cam 72. In the example, the planetary gear 96 is configured to be switchable between a state of being separated from the second gear 94 as illustrated in FIG. 15 and a state of meshing with the second gear 94 as illustrated in FIG. 21 and transmitting the driving force from the gap-adjusting-unit driving motor 84 to the gear 72*b* of the gap adjusting cam 72.

The second member 100 and the switching-lever member 102 are both rotatably attached to a shaft 108 provided at a projecting portion of the frame member 76A which extends to the left side in the apparatus width direction. The second member 100 is provided with a touch portion 100*a* and an engagement target portion 100*b*. One end of the second bias member 106 is attached to the second member 100, and the other end thereof is attached to the frame member 76A. The second bias member 106 biases the second member 100 to the frame member 76A side.

In the state in FIGS. 15 and 16, the engagement target portion 100*b* of the second member 100 is in a state of being in contact with the engagement portion 98*a* of the first member 98. The second member 100 causes the planetary gear 96 and the second gear 94 to be separated from each other against a bias force from the first bias member 104 in this state.

The switching-lever member 102 includes a lever 102*a*. A torsion spring (not illustrated) is provided between the switching-lever member 102 and the second member 100. The torsion spring biases the switching-lever member 102 in a direction in which the switching-lever member 102 comes into contact with the touch portion 100*a* of the second member 100.

With reference to FIGS. 17 and 18, when the carriage 50 moves to the right side in the apparatus-width direction, a contact portion 50*g* provided in the bearing 50*c* of the carriage 50 comes into contact with the lever 102*a* of the switching-lever member 102 from the left side in the apparatus-width direction. The contact portion 50*g* presses the lever 102*a* to the right side in the apparatus-width direction as the moving direction of the carriage 50.

In this manner, the switching-lever member 102 rotates to the right side in the apparatus-width direction against the bias force of the torsion spring (not illustrated). The switching-lever member 102 is separated from the touch portion 100*a*. Note that, in this state, since the second member 100 does not rotate, a contact state of the engagement portion 98*a* with the engagement target portion 100*b* is maintained.

With reference to FIGS. 19 and 20, when the carriage 50 moves to the end portion on the right side in the apparatus-width direction, the contact portion 50*g* of the carriage 50 and the lever 102*a* are released from the contact state. The switching-lever member 102 rotates to the left side in the apparatus-width direction due to the bias force of the torsion spring (not illustrated), and returns to the state of being contact with the touch portion 100*a* of the second member 100. Even in this state, since the second member 100 does not rotate, the contact state of the engagement portion 98*a* with the engagement target portion 100*b* is maintained.

Next, with reference to FIGS. 21 and 22, the carriage 50 is caused to move toward the left side in the apparatus-width direction from the state of being positioned at the end portion on the right side in the apparatus-width direction. As a result, the contact portion 50*g* of the carriage 50 comes into contact with the lever 102*a* of the switching-lever member 102 from the right side in the apparatus-width direction. The contact portion 50*g* presses the lever 102*a* to the left side in the apparatus-width direction as the moving direction of the carriage 50.

As a result, the switching-lever member 102 is caused to rotate in the clockwise direction in FIG. 22. At this time, the switching-lever member 102 presses the touch portion 100*a* of the second member 100. In this manner, the second member 100 rotates along with the switching-lever member 102 in the clockwise direction in FIG. 22 against the bias force of the second bias member 106. This movement causes the engagement target portion 100*b* of the second bias member 106 to be separated from the engagement portion 98*a* of the first member 98.

As a result, the first member 98 is biased to the frame member 76A side by the first bias member 104. The first member 98 rotates around the first gear 92 so as to approach the second gear 94. As a result, the planetary gear 96 enters a state of meshing with the second gear 94. In this manner, the gap adjusting unit 90 enters a state of transmitting the driving force from the gap-adjusting-unit driving motor 84 to the gear 72*b* of the gap adjusting cam 72. In other words, it is possible to change the gap PG.

With reference to FIGS. 23 and 24, when the carriage 50 moves to the left side in the apparatus-width direction, the contact portion 50*g* of the carriage 50 passes over the lever 102*a* of the switching-lever member 102 as illustrated in FIG. 24. To this state, since the engagement target portion 100*b* of the second bias member 106 is separated from the engagement portion 98*a* of the first member 98, the state in which the planetary gear 96 meshes with the second gear 94, that is, the state in which the driving force from the gap-adjusting-unit driving motor 84 is transmitted to the gear 72*b* of the gap adjusting cam 72, is maintained.

When the carriage 50 moves from the state illustrated in FIG. 24 to the left side in the apparatus-width direction, the contact portion 50*g* of the carriage 50 passes over the lever 102*a* of the switching-lever member 102. As a result, the contact portion 50*g* of the carriage 50 and the lever 102*a* of the switching-lever member 102 are released from the contact state, and the second member 100 rotates along with the switching-lever member 102 in the counterclockwise direction in FIG. 24 due to the bias force from the second bias member 106. The engagement target portion 100*b* of the second bias member 106 comes into contact with the engagement portion 98*a* of the first member 98, and the engagement portion 98*a* is pressed in the direction of being separated from the second gear 94.

As a result, the planetary gear 96 is separated from the second gear 94. In this manner, the driving force from the gap-adjusting-unit driving motor 84 is stopped from being transmitted to the gear 72*b* of the gap adjusting cam 72. In other words, the state returns to the state illustrated in FIGS. 15 and 16.

In the example, since a position in a lever motion of changing the gap PG is disposed within the moving range B (refer to FIG. 3) of the carriage 50, a region of the lever motion of changing the cap PG is not provided outside the moving range B of the carriage 50. Therefore, it is possible to decrease the apparatus in size in the apparatus-width direction.

To summarize the description above, the printer 10 includes: the carriage 50 that has the recording head 52 which performs recording on the medium and that is movable to the right side in the apparatus-width direction as the first direction and to the left side in the apparatus-width direction as the second direction opposite to the first direction; and the gap adjusting units 80 and 90 that cause the carriage 50 to shift in the apparatus-height direction as the direction in which the gap PG between the medium and the recording head 52 changes depending on the rotation of the gap adjusting cam 72. In the state in which the carriage 50 is positioned at the end portion in the moving range B on the right side in the apparatus-width direction, at least a part of the carriage 50 and at least a part of the gap adjusting cam 72 overlap in the apparatus-width direction as the moving direction of the carriage 50.

In the configuration, since at least a part of the carriage 50 and at least a part of the gap adjusting cam 72 overlap in the apparatus-width direction as the moving direction of the carriage 50, the region occupied by the carriage 50 and the region occupied by the gap adjusting cam 72 do not overlap entirely in the apparatus-width direction as the moving direction of the carriage 50 such that it is possible to decrease the apparatus in size in the apparatus-width direction as the moving direction of the carriage 50.

In the state in which the carriage 50 is positioned at the end portion in the moving range B on the right side in the apparatus-width direction, the gap adjusting cam 72 does not project with respect to the carriage 50 in a direction to the right side in the apparatus-width direction. In the configuration, the apparatus does not increase in size in the apparatus-width direction as the moving direction of the carriage 50 due to the region occupied by the gap adjusting cam 72 such that it is possible to decrease the apparatus in size in the apparatus-width direction as the moving direction of the carriage 50.

The printer 10 includes the guiding shaft 70 that guides the carriage 50 in the moving direction. The gap adjusting cam 72 has the shape in which the distance from the rotating center to an outer circumference changes in the circumferential direction, that is, has the cam surface 72*a*, and is provided at the end portion of the guiding shaft 70. The gap adjusting units 80 and 90 have the cam follower 78 that comes into contact with the cam surface 72*a* as the outer circumferential surface of the gap adjusting cam 72. In the state in which the carriage 50 is positioned at the end portion in the moving range B on the right side in the apparatus-width direction, the cam follower 78 does not project with respect to the carriage 50 to the right side in the apparatus-width direction. In the configuration, the apparatus does not increase in size in the apparatus-width direction as the moving direction of the carriage 50 due to the region occupied by the cam follower 78 such that it is possible to decrease the apparatus in size in the apparatus-width direction as the moving direction of the carriage 50.

The gap adjusting unit 80 has the group of gears 82A, 82B, 82C, 82D, and 82E that transmits rotational torque from the gap-adjusting-unit driving motor 84 to the gap adjusting cam 72. In the state in which the carriage 50 is positioned at the end portion in the moving range B in the apparatus-width direction, the group of gears 82A, 82B, 82C, 82D, and 82E does not project with respect to the carriage 50 in the apparatus-width direction. In the configuration, the apparatus does not increase in size in the apparatus-width direction as the moving direction of the carriage 50 due to the region occupied by the group of gears 82A, 82B, 82C, 82D, and 82E such that it is possible to decrease the apparatus in size in the apparatus-width direction as the moving direction of the carriage 50.

The gap adjusting cam 72 does not project with respect to the top portion 50*d* of the carriage 50 in the apparatus-height direction as the direction in which the gap PG changes. In the configuration, the apparatus does not increase in size in the apparatus-height direction as the direction, in which the gap PG changes, due to the gap adjusting cam 72 such that it is possible to decrease the apparatus in size in the apparatus-height direction as the direction in which the gap PG changes.

The gap adjusting cam 74 is positioned to be closer to the end portion in the moving range B of the carriage 50 on the left side in the apparatus-width direction as the second direction. In the state in which the carriage 50 is positioned at the end portion in the moving range B on the left side in the apparatus-width direction, the gap adjusting cam 74 does not project with respect to the carriage 50 to the left side in the apparatus-width direction. In the configuration in which the gap adjusting cams 72 and 74 are provided on both sides in the moving range B of the carriage 50, it is possible to decrease the apparatus in size in the apparatus-width direction as the moving direction of the carriage 50.

The power transmitting mechanism 86, which transmits power from the driving source to the transport driving roller 46*a* and the discharge roller pair 56, is disposed on the end portion side in the moving range B of the carriage 50 on the left side in the apparatus-width direction as the second direction. In the state in which the carriage 50 is positioned at the end portion in the moving range B on the left side in the apparatus-width direction, the power transmitting mechanism 86 does not project with respect to the carriage 50 to the left side in the apparatus-width direction. In the configuration, the apparatus does not increase in size in the apparatus-width direction as the moving direction of the carriage 50 due to the region occupied by the power transmitting mechanism 86 such that it is possible to decrease the apparatus in size in the apparatus-width direction as the moving direction of the carriage 50.

The carriage 50 has the plurality of ink cartridges 61 that contain inks that are discharged from the recording head 52, and the plurality of ink cartridges 61 are arranged in the carriage 50 in the apparatus-depth direction as the direction intersecting with the apparatus-width direction as the moving direction of the carriage 50. In the configuration, it is possible to decrease the carriage 50 in size in the apparatus-width direction as the moving direction of the carriage 50, and further it is possible to decrease the apparatus in size in the apparatus-width direction as the moving direction of the carriage 50.

Figure 25:
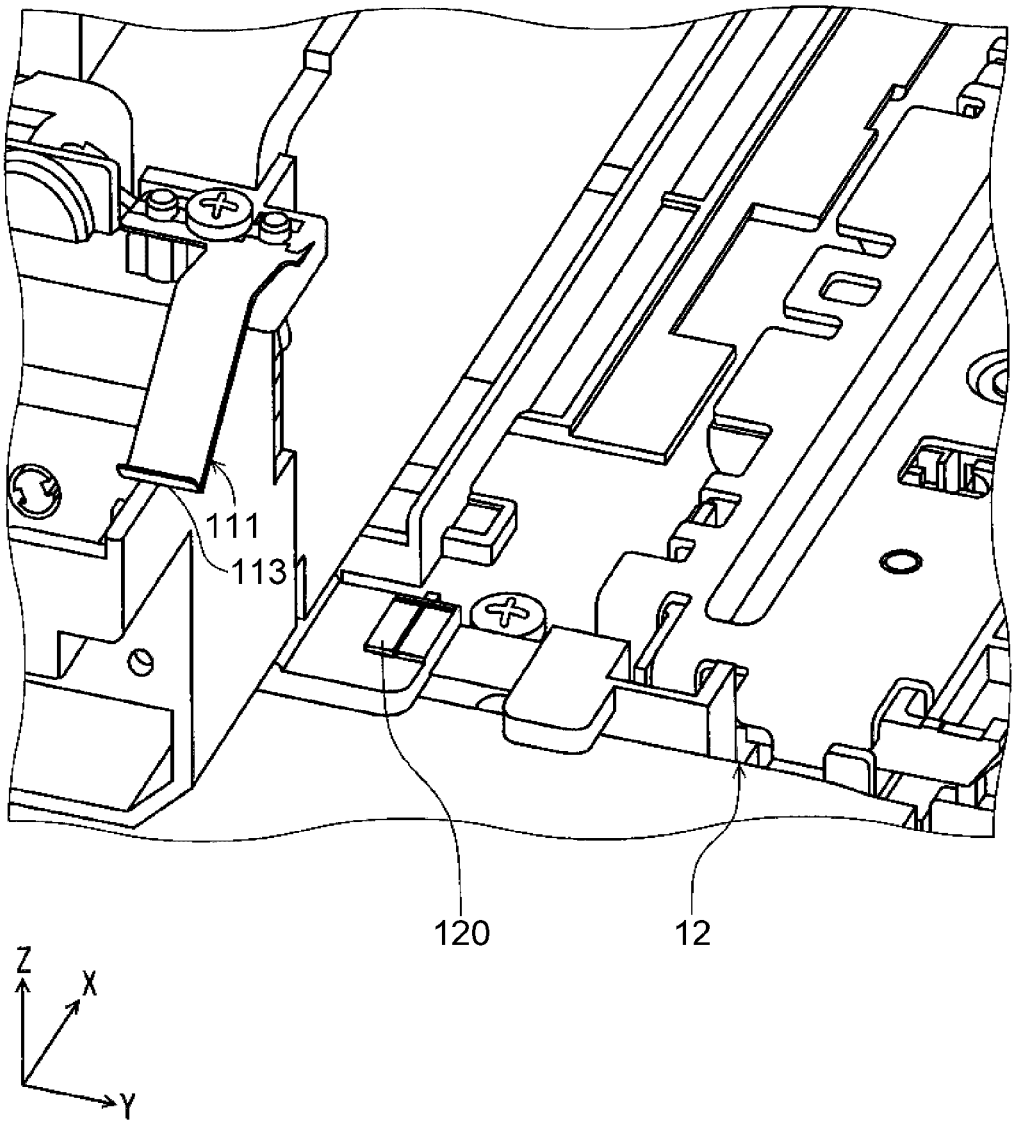
FIG. 25 is a perspective view illustrating a press unit and a support portion according to the example.
Figure 26:
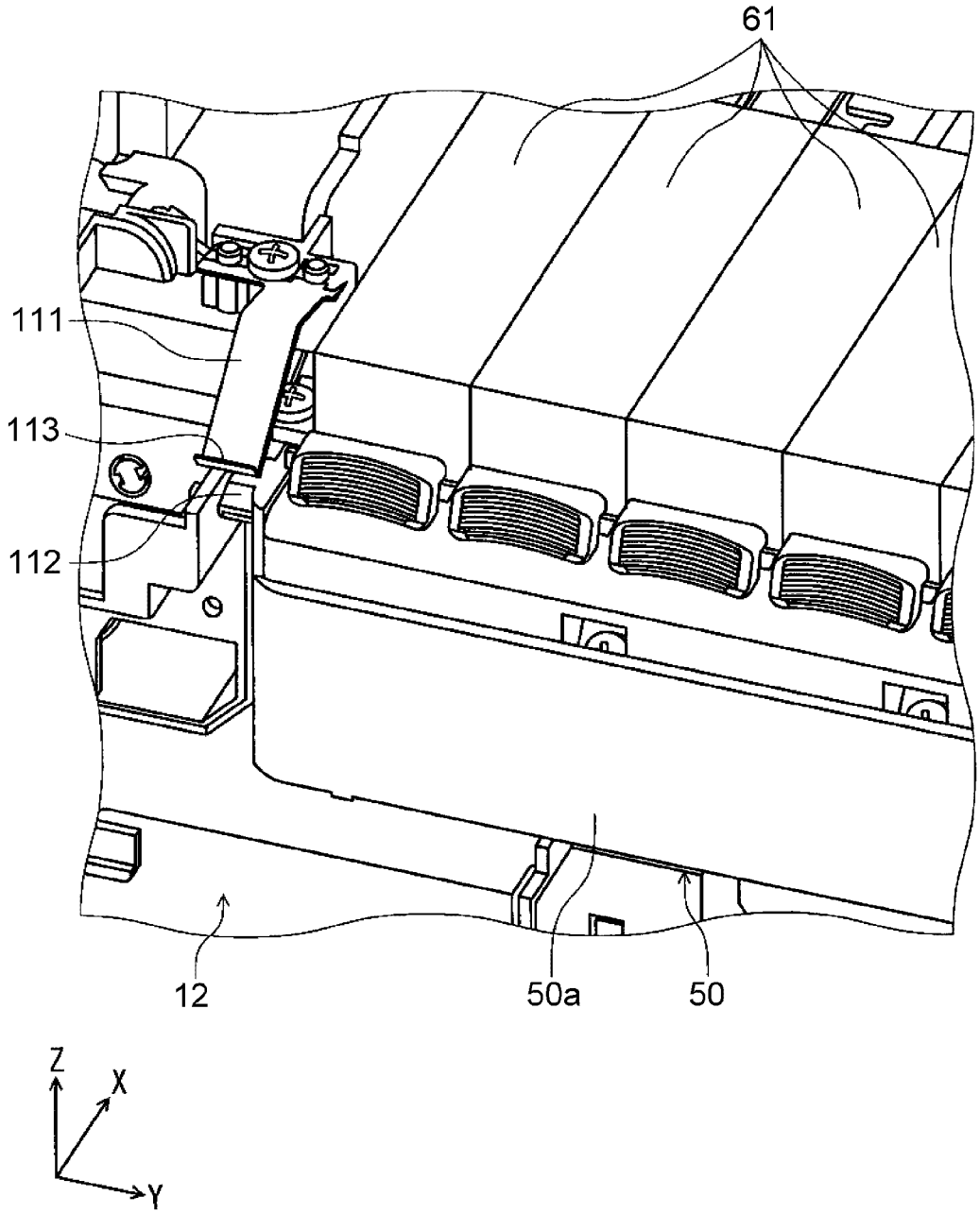
FIG. 26 is a perspective view illustrating a state in which the carriage is pressed by the press unit according to the example.
Figure 28:
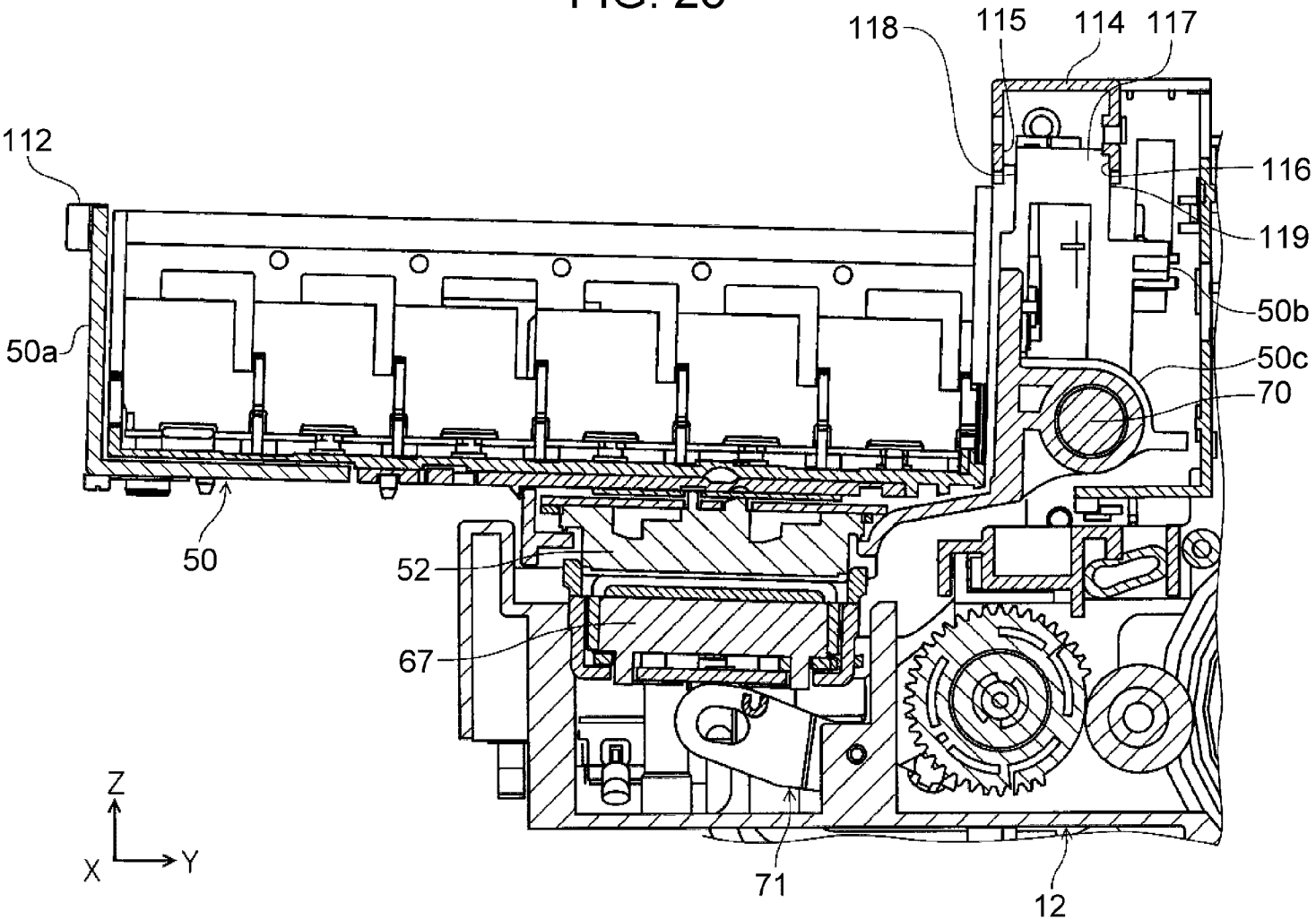
FIG. 28 is a sectional side view illustrating a state after the carriage is capped in the case where a gap PG has a reference distance.
Figure 29:
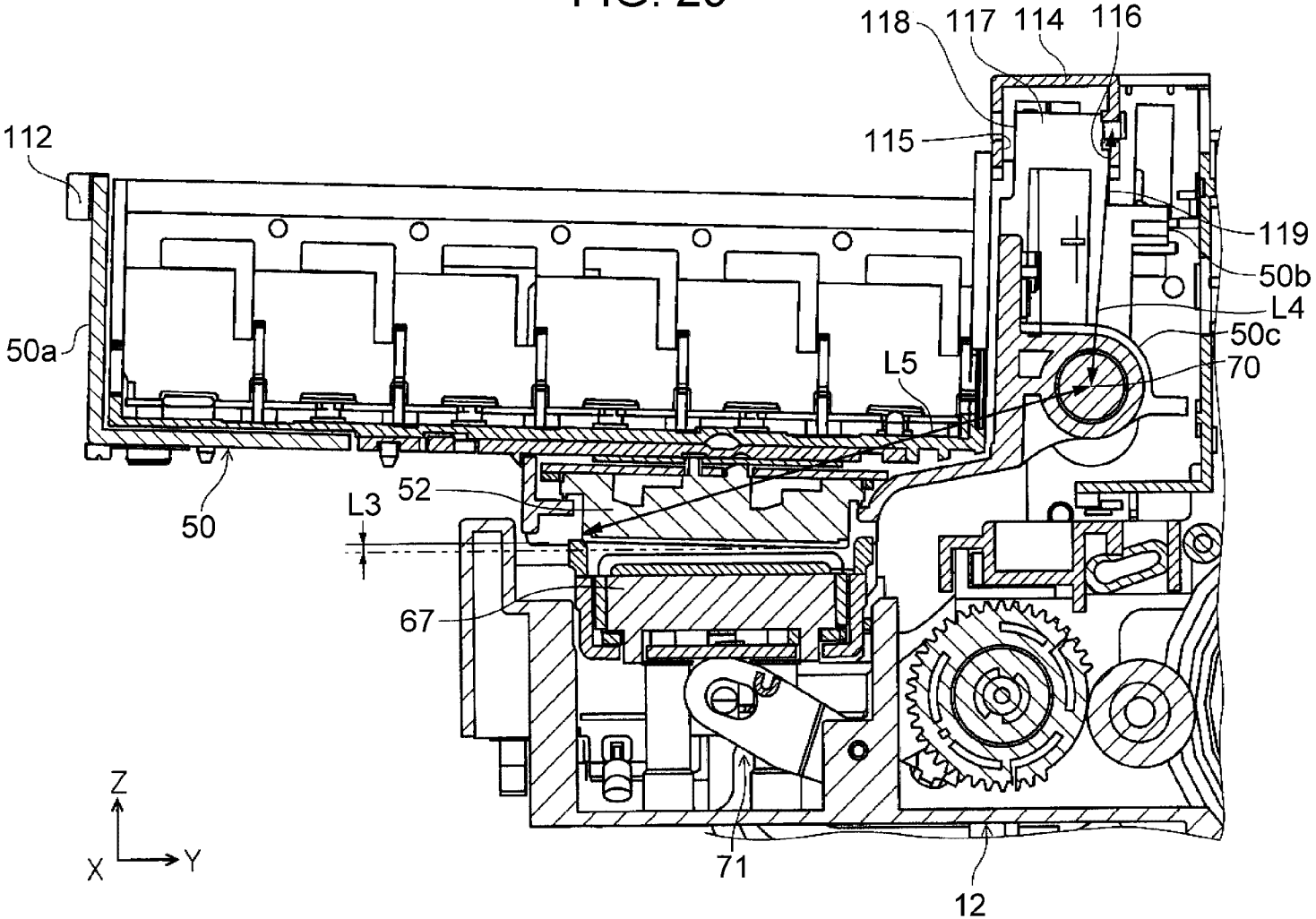
FIG. 29 is a sectional side view illustrating a state in which the press unit does not press the carriage, but the carriage is capped in the case where a gap PG has the maximum distance.

FIG. 25 is a perspective view illustrating a press unit and a support portion according to the example. FIG. 26 is a perspective view illustrating a state in which the carriage is pressed by the press unit according to the example. FIG. 27 is a sectional side view illustrating a state immediately before the carriage is capped in a case where a gap PG has a reference distance. FIG. 28 is a sectional side view illustrating a state after the carriage is capped in the case where a gap PG has a reference distance. FIG. 29 is a sectional side view illustrating a state in which the press unit does not press the carriage, but the carriage is capped in the case where a gap PG has a reference distance.

Figure 30:
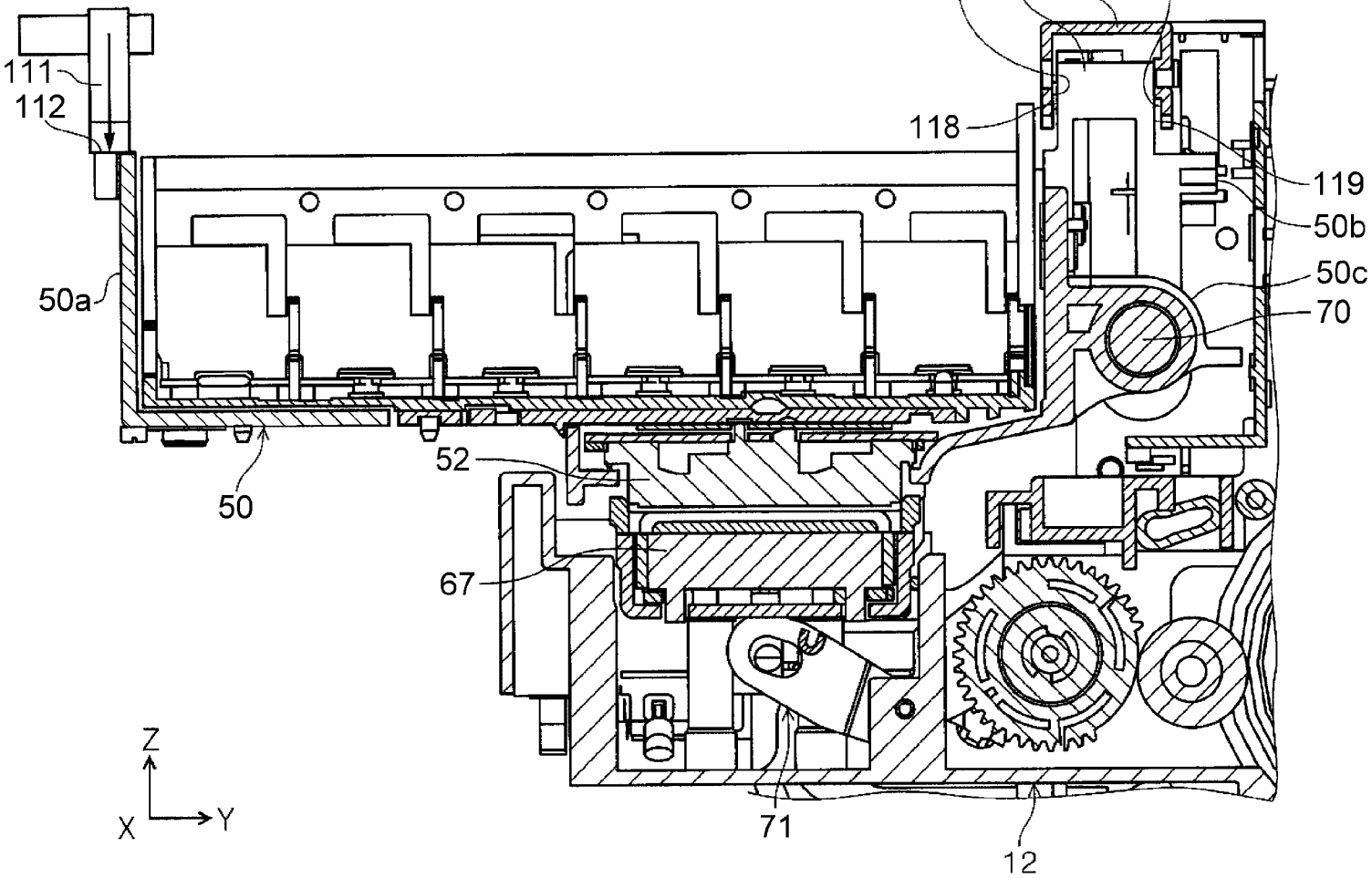
FIG. 30 is a sectional side view illustrating a state in which the press unit presses the carriage and the carriage is capped in the case where a gap PG has the maximum distance.
Figure 31:
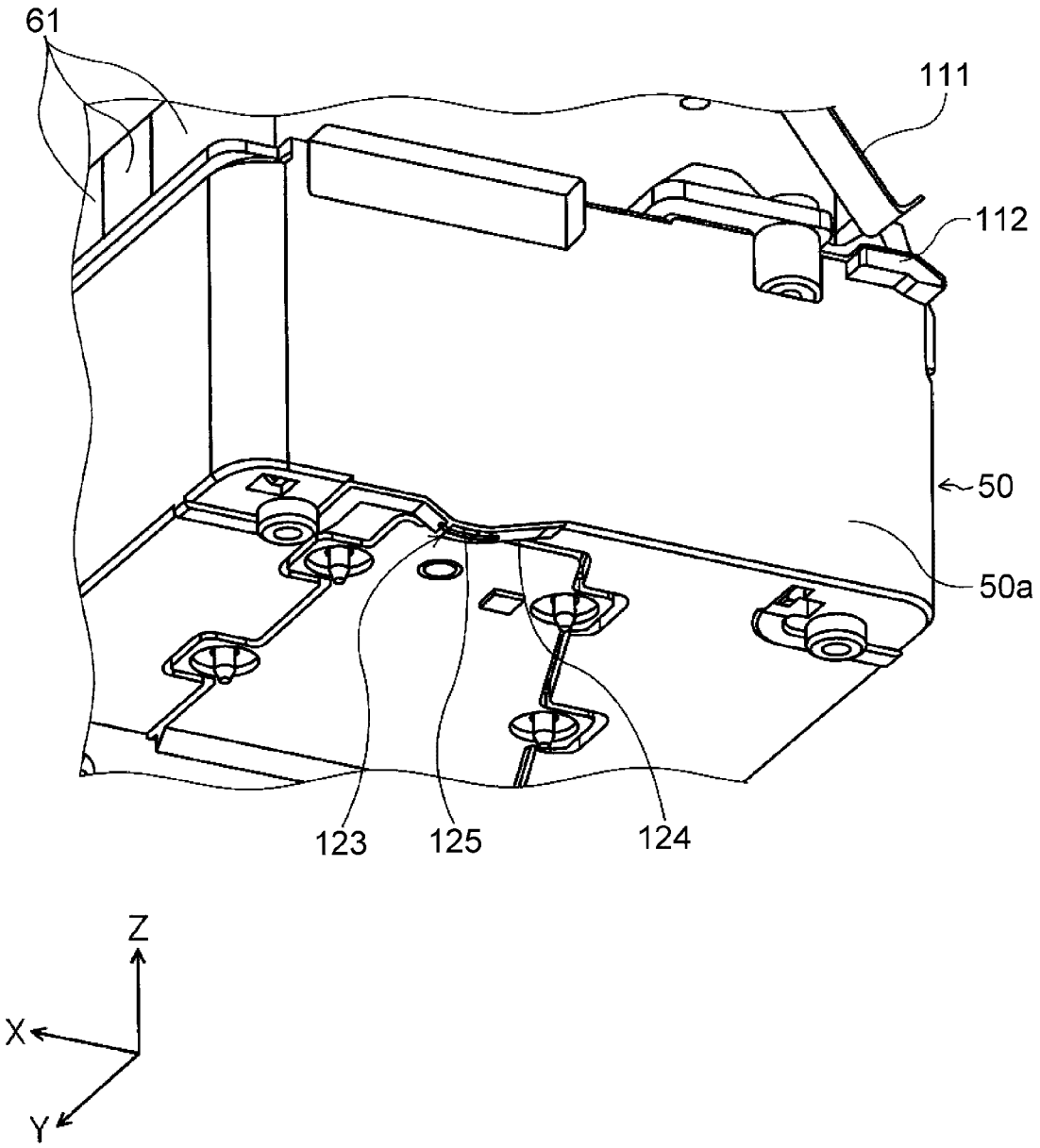
FIG. 31 is a perspective view illustrating a support target portion provided below the carriage.
Figure 32:
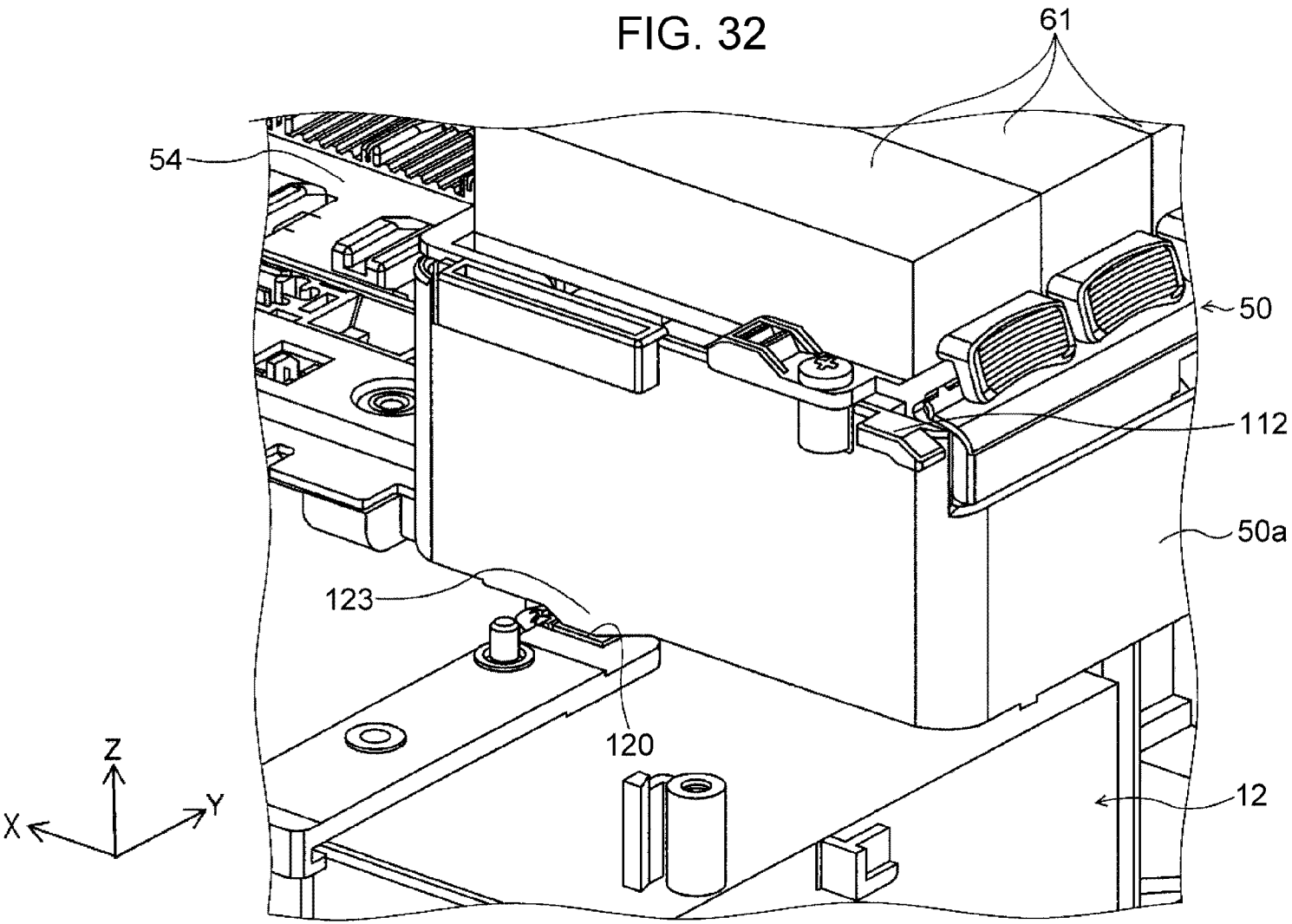
FIG. 32 is a perspective view illustrating a state in which the support portion supports the support target portion of the carriage.
Figure 33:
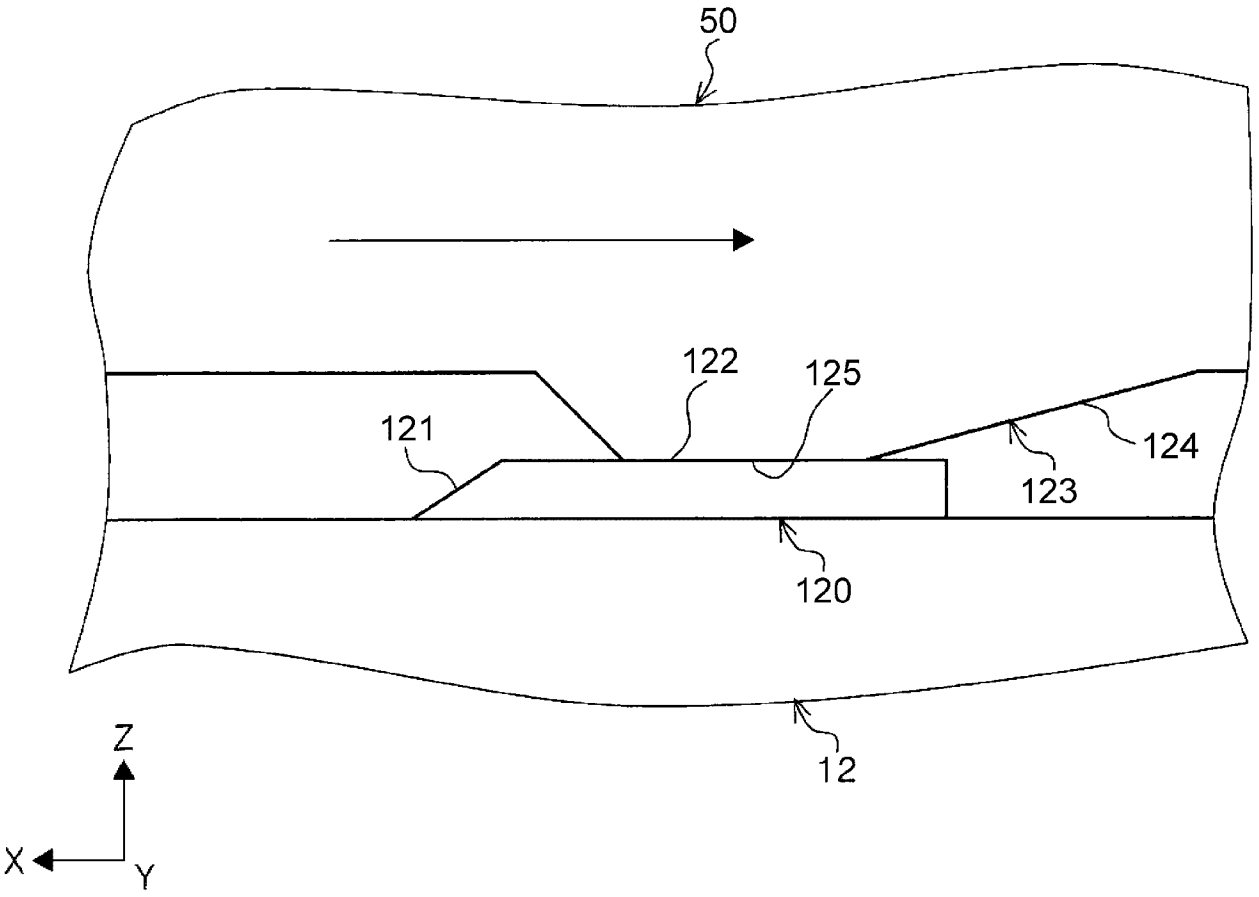
FIG. 33 is an enlarged view illustrating a state in which the support portion supports the support target portion when viewed from a front side in an apparatus-depth direction.

FIG. 30 is a sectional side view illustrating a state in which the press unit presses the carriage and the carriage is capped in the case where a gap PG has a reference distance. FIG. 31 is a perspective view illustrating a support target portion provided below the carriage. FIG. 32 is a perspective view illustrating a state in which the support portion supports the support target portion of the carriage. FIG. 33 is an enlarged view illustrating a state in which the support portion supports the support target portion when viewed from a front side in an apparatus-depth direction.

Regarding Pressing Portion

Subsequently, a press unit 111 will be described with reference to FIGS. 25 to 30. With reference to FIG. 25, the press unit 111 is configured as a leaf spring member formed by bending a plate-shaped member. Specifically, the press unit 111 extends in the apparatus-width direction and is inclined in the apparatus-height direction.

In the example, the press unit 111 is provided at a position corresponding to the home position of the carriage 50 in the apparatus-width direction as illustrated in FIG. 4. When the carriage 50 is positioned at the home position, the press unit is provided at a position overlapping a front-side end portion 112 (refer to FIG. 8) of the housing 50*a* of the carriage 50 in the apparatus-depth direction.

Specifically, in the state in which the gap PG of the carriage 50 is the maximum, the press unit 111 is configured to come into contact with the front-side end portion of the housing 50*a* of the carriage 50 (refer to FIG. 26). When the carriage 50 moves toward the home position from the left side in the apparatus-width direction in the state in which the gap P of the carriage 50 is the maximum, a front end portion 113 of the press unit 111 is brought to a stop on the front-side end portion 112 of the housing 50*a*.

As a result, the front end portion 113 of the press unit 111 configured as the leaf spring is lifted upward in the apparatus-height direction and is elastically deformed. In this manner, the press unit 111 presses the front-side end portion 112 of the housing 50*a* downward in the apparatus-height direction. In the example, when the press unit 111 comes into contact with the carriage 50 which is in the state of having the maximum gap PG, the press unit is configured to apply a predetermined bias force to the carriage 50.

Here, a capping operation timing in the carriage 50 is described with reference to FIGS. 27 to 30. FIG. 27 illustrates a case where the carriage 50 is positioned at the home position and the gap PG has a reference distance. Note that the gap PG in the example is adjustable in four levels from a state of having the minimum distance to the state of having the maximum distance between the recording head 52 to the medium guiding member 54, and the reference distance of the gap PG is set to the second level from the state of having the minimum gap PG.

Here, with reference to FIGS. 3 and 8, a posture regulating member 114 is provided above the carriage 50 on the rear side thereof in the apparatus-depth direction so as to extend in the apparatus-width direction. As illustrated in FIG. 27, the posture regulating member 114 has a shape of which a front-side end portion and a rear-side end portion in the apparatus-depth direction are bent downward and the central portion in the apparatus-depth direction is open downward. A surface of the posture regulating member 114 on the apparatus-front side, which extends downward in the apparatus-height direction and in the apparatus-width direction, is referred to as a first regulation surface 115, and a surface of the posture regulating member on the apparatus-rear side, which extends downward in the apparatus-height direction and in the apparatus-width direction, is referred to as a second regulation surface 116.

In addition, a guide target portion 117 that projects upward in the apparatus-height direction is provided at the end portion of the carriage 50 on the rear side. The guide target portion 117 is provided with a first regulation target portion 118 on the front side thereof in the apparatus-depth direction, and a second regulation target portion 119 on the rear side thereof.

In the example, at least a part of the guide target portion 117 enters the posture regulating member 114. As illustrated in FIG. 27, in a state in which the recording head 52 is not capped with the cap 67, the carriage 50 rotates with the guiding shaft 70 as the rotation center in the counterclockwise direction in FIG. 27 due to the own weight of the carriage 50; however, in this state, the first regulation target portion 118 comes into contact with the first regulation surface 115 and the rotation in the counterclockwise direction is regulated, that is, the posture of the carriage 50 is regulated. Note that, in this state, the second regulation surface 116 and the second regulation target portion 119 are separated from each other.

Here, when the carriage 50 is caused to move in the apparatus-width direction, the first regulation target portion 118 slides on the first regulation surface 115. In other words, the first regulation surface 115 functions as a sliding surface that guides the movement of the carriage 50. Hence, in a state in which the posture regulating member 114 regulates the posture of the carriage around the guiding shaft 70, the carriage 50 moves in the moving range B. In other words, since the carriage 50 is movable in the apparatus-width direction with a posture of the recording head 52 maintained with respect to the medium guiding member 54, it is possible to perform recording on the medium supported on the medium guiding member 54 with good accuracy.

Next, a capping operation of the cap 67 with respect to the recording head 52 will be described with reference to FIG. 28. In this state, the gap PG of the carriage 50 is set to the reference distance. The cap driving unit 71 is driven and the recording head 52 provided in the lower portion of the carriage 50 positioned at the home position is capped with the cap 67. Specifically, the cap 67 is caused to move upward in the apparatus-height direction from a state of being separated from the recording head 52 below the recording head 52, and is pushed to come into contact with the recording head 52.

As a result, the carriage 50 is caused to be lifted from the lower side in the apparatus-height direction by the cap 67. The carriage 50 rotates in the clockwise direction in FIG. 28 with the guiding shaft 70 as the rotating center. The first regulation target portion 118 that is in contact with the first regulation surface 115 is separated from the first regulation surface 115 in response to a rotating operation of the carriage 50. Further, when the carriage 50 rotates in the clockwise direction, the second regulation target portion 119 comes into contact with the second regulation surface 116. In other words, the rotation of the carriage 50 in the clockwise direction is regulated by the second regulation surface 116.

Subsequently, a capping operation in the case where the gap PPG is the maximum is described with reference to FIGS. 29 and 30. First, a capping operation performed in a case where the press unit 111 is not provided is described with reference to FIG. 29. When the capping operation is performed to the recording head 52 by the cap 67 in the case where the gap PG of the carriage 50 is the maximum, the carriage 50 rotates in the clockwise direction in FIG. 29 with the guiding shaft 70 as the rotating center. The second regulation target portion 119 comes into contact with the second regulation surface 116. In other words, the rotation of the carriage 50 in the clockwise direction is regulated by the second regulation surface 116.

Here, when the carriage 50 rotates, both of the recording head 52 and the carriage 50 rotate in the clockwise direction. In this manner, the end portion of the recording head 52 on the apparatus-front side in the apparatus-depth direction is lifted in the apparatus-height direction. A shifting amount L3 of the end portion of the recording head 52 on the apparatus-front side in the apparatus-height direction in the example is determined by a proportion of a distance L4 from a contact portion between the second regulation target portion 119 and the second regulation surface 116 to the center of the guiding shaft 70 and the distance L5 from the center of the guiding shaft 70 to the end portion of the recording head 52 on the apparatus-front side.

In other words, when the distance L4 is small, an amount of rotation of the carriage 50 in the clockwise direction increases, and the shifting amount L3 increases. As a result, an increase in a moving amount of the cap 67 in the apparatus-height direction results in a decrease in the size of the cap driving unit 71, and a decrease in the size of the printer 10 in the apparatus-height direction.

As illustrated in FIG. 30, in the state of having the maximum gap PG in the example, the end portion 112 of the housing 50*a* on the front side engages with the press unit 111. Since the press unit 111 presses the end portion 112 of the housing 50*a* downward in the apparatus-height direction, the rotation of the carriage 50 in the clockwise direction in FIG. 30 around the guiding shaft 70 is regulated when the recording head 52 is capped with the cap 67.

In other words, the press unit 111 can prevent the end portion of the recording head 52 on the apparatus-front side from being lifted upward in the apparatus-height direction by the capping with the cap 67. In this manner, it is possible to reduce an increase an amount of movement of the cap 67 in the apparatus-height direction. As a result, it is possible to decrease the printer 10 in size in the apparatus height direction.

In addition, since the press unit 111 as illustrated in FIG. 30 engages with the end portion, that is the end portion 112 on the front side, of the carriage 50 on a side apart from the guiding shaft 70 in the apparatus-depth direction, it is possible to reduce the bias force from the press unit 111 which is applied to the carriage 50 against the upward pressing force of the cap 67 in the apparatus-height direction.

In addition, the press unit 111 as illustrated in FIG. 4 is disposed to engage with the end portion 112 of the carriage 50 on the front side within a range in which the cap 67 comes into press contact with the recording head 52. Regarding Support Portion Subsequently, a support portion 120 is described with reference to FIGS. 25 and 31 to 33. With reference to FIG. 25, the support portion 120 is provided at the end portion of the apparatus main body 12 in the apparatus-width direction. More specifically, when the carriage 50 is positioned at the home position, the support portion 120 is positioned below the carriage 50 and faces the carriage 50. As illustrated in FIG. 33, the support portion 120 includes a guiding surface 121 that is inclined to the left side in the apparatus width direction, and a flat support surface 122 that is continuous from the guiding surface 121 and extends to the right side in the apparatus width direction.

In addition, with reference to FIG. 31, a support target portion 123 is provided on a lower portion of the housing 50*a* of the carriage 50 at the end portion of the apparatus main body 12 in the apparatus-width direction. The support target portion 123 in the example is disposed on the front side of the housing 50*a* in the apparatus-depth direction. The support target portion 123 includes a guiding target surface 124 that is inclined to the left side in the apparatus and extends downward, and a flat support target surface 125 that is continuous from the guiding target surface 124 and extends to the left side in the apparatus width direction.

As illustrated in FIG. 32, when the carriage 50 is positioned at the home position, the support portion 120 engages with the support target portion 123 of the carriage 50 and supports the carriage 50 from below in the apparatus-height direction. Note that, in the example, when the gap PG of the carriage 50 has the reference distance, the support portion 120 is set to engage with the support portion 120 and the support target portion 123.

With reference to FIG. 33, when the carriage 50 moves to the home position from the left side in the apparatus-width direction, the guiding surface 121 of the support portion 120 comes into contact with the guiding target surface 124 or the support target surface 125 of the support target portion 123. Hence, the support target portion 123 is guided to the guiding surface 121 and engages with the support surface 122 and the support target surface 125. The carriage 50 is supported by the support portion 120.

In the example, the support portion 120 supports the lower side of the carriage 50 on the front side in the apparatus-depth direction of the carriage 50 at the home position of the carriage 50. Hence, when the carriage 50 is positioned at the home position, the support portion 120 supports the front side of the carriage 50 and the guiding shaft 70 supports the rear side. In other words, the carriage 50 at the home position is supported in a bridge state by the support portion 120 and the guiding shaft 70.

When the carriage 50 moves in the moving range B from the home position, the posture is regulated in a state in which the carriage 50 is suspended by the guiding shaft 70 and the posture regulating member 114 provided on the rear side of the carriage 50.

Here, when the printer 10 is transported, the carriage 50 is positioned at the home position which is positioned outside the recording region D. When the printer 10 falls down during the transportation of the printer 10, an impact of the falling is applied to the carriage 50. In the example, the carriage 50, to which the impact of the falling is applied, is supported by the support portion 120 from below.

As a result, since the support portion 120 receives the impact applied to the carriage 50, a force from the carriage 50, which is applied to the posture regulating member 114, is reduced such that it is possible to prevent or decrease the deformation of the posture regulating member 114.

Modification Example of Example (1) In the example, the press unit 111 is configured to engage with the end portion 112 of the carriage 50 in the front side in the case of having the maximum gap PG of the carriage 50; however, instead of the configuration, a configuration, in which the press unit 111 engages with the end portion 112 on the front side even in a case where the gap PG has a distance other than the maximum, may be employed.

(2) In the example, the press unit 111 is configured to engage with the end portion 112 of the carriage 50 on the front side; however, instead of the configuration, a configuration, in which the press unit 111 engages with the carriage 50 in a range from a region in which at least the recording head 52 is provided in the apparatus-depth direction to the front side of the carriage 50, may be employed.

(3) In the example, when the press unit 111 comes into contact with the end portion 112 on the front side, the press unit is configured to apply a predetermined bias force and to prevent the recording head 52 from being lifted; however, instead of the configuration, the press unit 111 may be able to regulate the rotation of the carriage 50 around the guiding shaft 70 such that a shift of the recording head 52 in the apparatus-height direction during the capping is performed within a stroke range of the cap 67 in the apparatus-height direction.

(4) In the example, when the gap PG of the carriage 50 is the reference distance, the support portion 120 is configured to engage with the carriage 50 at the home position; however, instead of the configuration, a configuration, in which the support portion 120 engages with the carriage 50 at the home position even in a case where the gap PG has a distance other than the reference distance, may be employed.

To summarize the description above, the printer 10 includes: the carriage 50 that has the recording head 52 which performs recording on the medium and that is movable in the apparatus-width direction as the direction intersecting with the apparatus-height direction as the medium transport direction; the guiding shaft 70 that penetrates through the bearing 50*c* provided in the carriage 50, guides the carriage 50 in the apparatus-width direction as the moving direction of the carriage 50, and extends in the apparatus-width direction; a posture regulating member 114 that stops the rotation of the carriage 50 around the guiding shaft 70 at the upper position in a perpendicular direction with respect to the guiding shaft 70, and regulates the posture of the carriage 50; a medium guiding member 54 that is disposed at the position so as to be able to face the recording head 52 and guides the medium; the gap adjusting unit 80 that changes the gap PG between the recording head 52 and the medium guiding member 54; and the press unit 111 that engages with the carriage 50 and presses the carriage 50 downward in the state in which the gap PG is larger than the minimum gap.

In this configuration, since the printer 10 includes the press unit 111 that engages with the carriage 50 and presses the carriage 50 downward in the state in which the gap PG is at least larger than the minimum gap, the upward rotation of the carriage 50 is regulated by the press unit 111 such that a space for the upward rotation of the carriage 50 does not need to be secured or it is possible to decrease the space. As described above, it is possible to decrease the printer 10 in size.

The press unit 111 engages with the carriage 50 when the carriage 50 is positioned outside the recording region D in which the recording head 52 performs recording on the medium. In the configuration, the press unit 111 does not have a bad effect on a recording quality and thus it is possible to maintain a good recording quality.

The press unit 111 engages with the end portion of the carriage 50 on the side apart from the guiding shaft 70, that is, the end portion 112 thereof on the front side. In the configuration, it is possible to reduce the floating of the carriage 50 with a smaller force.

The printer 10 includes the cap 67 that comes into press contact with the recording head 52 from the lower side and seals the recording head 52. The press unit 111 engages with the carriage 50 in the apparatus-width direction as the moving direction of the carriage 50 in the range in which the cap 67 comes into press contact with the recording head 52.

In the configuration, since the press unit 111 engages with the carriage 50 in the apparatus-width direction as the moving direction of the carriage 50 in the range in which the cap 67 comes into press contact with the recording head 52, the position of the carriage 50 to which the cap 67 applies an external force is coincident with or close to the position of the carriage 50 to which the press unit 111 applies an external force in the apparatus-width direction as the moving direction of the carriage 50. In this manner, it is possible to prevent or reduce a tilt of the carriage 50.

The press unit 111 engages with the carriage 50 when the gap PG is the maximum gap. In the configuration, it is possible to prevent or reduce the floating of the carriage 50 with the gap with which the floating of the carriage 50 has the highest effect on the size (height) of the apparatus such that it is possible to reliably decrease the printer 10 in size.

The control unit 65 that controls the carriage 50 such that the control unit is capable of executing the position detecting operation of detecting the position of the carriage 50 by causing the carriage 50 to come into bump contact with the end portion in the moving direction, and the position detecting operation is performed when the gap PG is a gap other than the gap with which the press unit 111 is engageable with the carriage 50.

In the configuration, since the position detecting operation is performed with the gap PG other than the gap with which the press unit 111 is engageable with the carriage 50, during the position detecting operation, the press unit 111 can avoid having a bad effect on determination in the position detecting operation.

The printer 10 includes the support portion 120 that supports the carriage 50 from below when the carriage 50 is positioned outside the recording region D in which the recording head 52 performs recording on the medium.

For example, when the falling impact is applied to the carriage 50 during transportation thereof, the posture regulating member 114 receives the impact. Thus, there is a concern that the posture regulating member 114 will be deformed. However, in the example, since the printer includes the support portion 120 that supports the carriage 50 from below when the carriage 50 is positioned outside the recording region D in which the recording head 52 performs recording on a medium, the support portion 120 receives the impact, and thereby it is possible to prevent or reduce the deformation of the posture regulating member 114.

Figure 34:
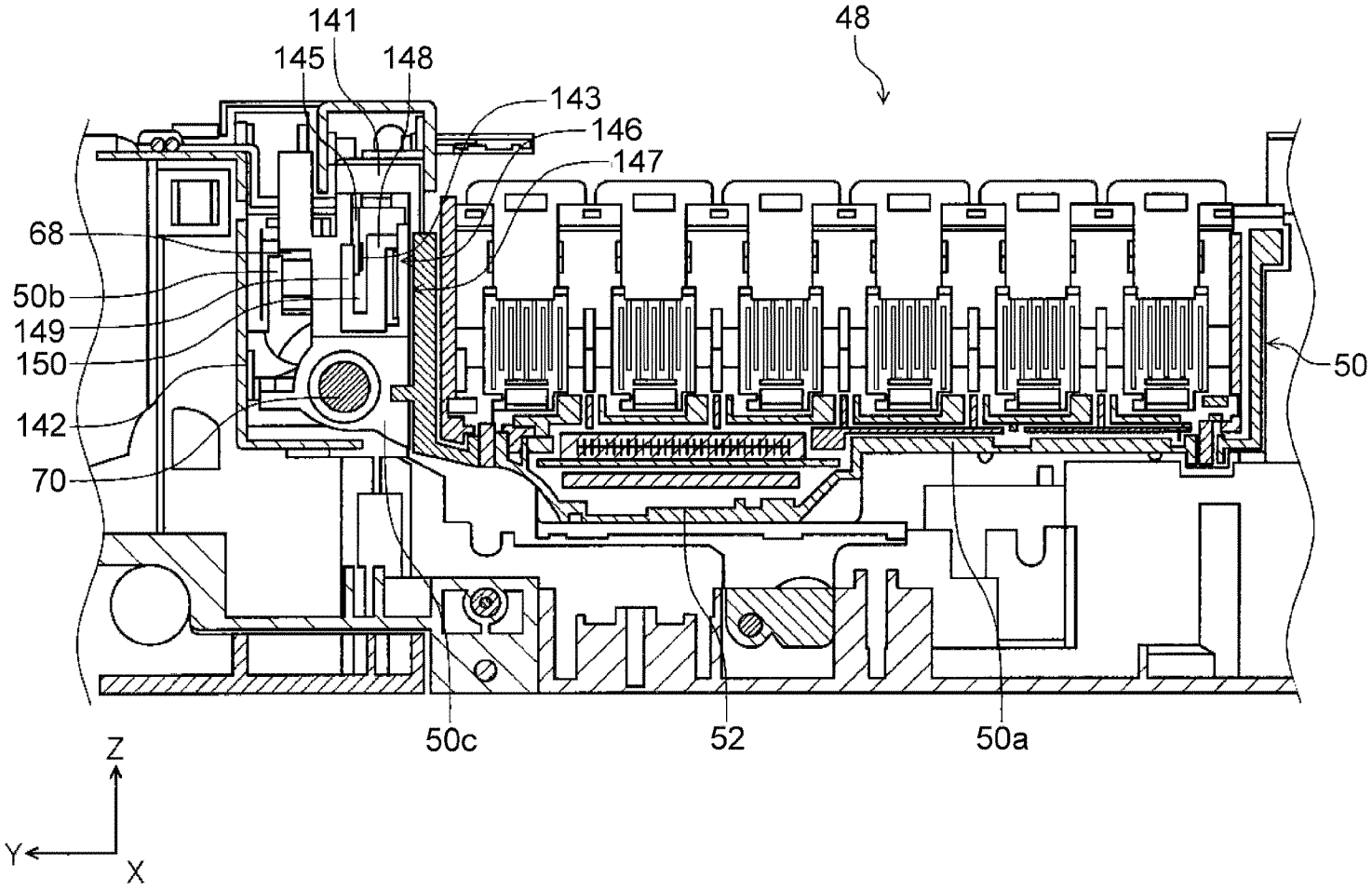
FIG. 34 is a sectional side view of the carriage in a case where the gap PG is the smallest in the carriage according to the invention.
Figure 35:
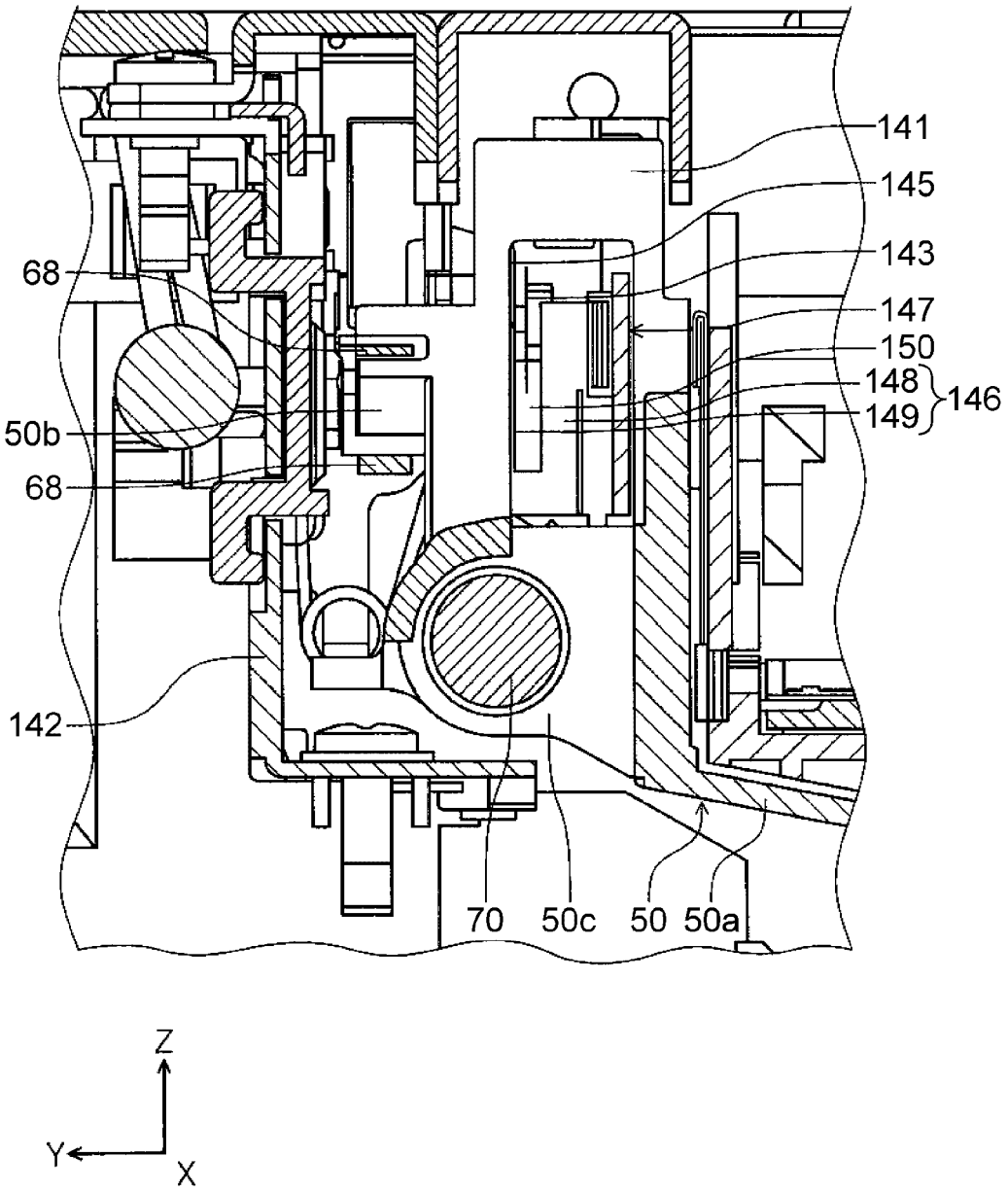
FIG. 35 is a side view illustrating a relationship between the linear scale and the sensor in the carriage in the state in FIG. 34.
Figure 36:
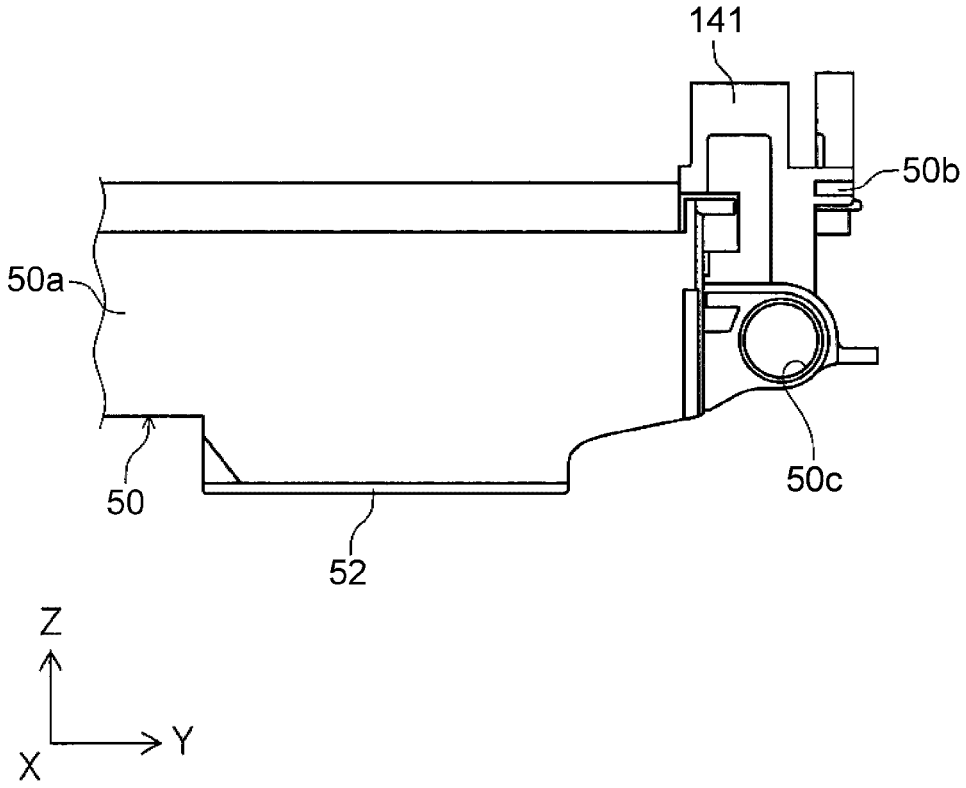
FIG. 36 is a side view illustrating a configuration of the carriage on the rear side of the apparatus according to the invention.
Figure 37:
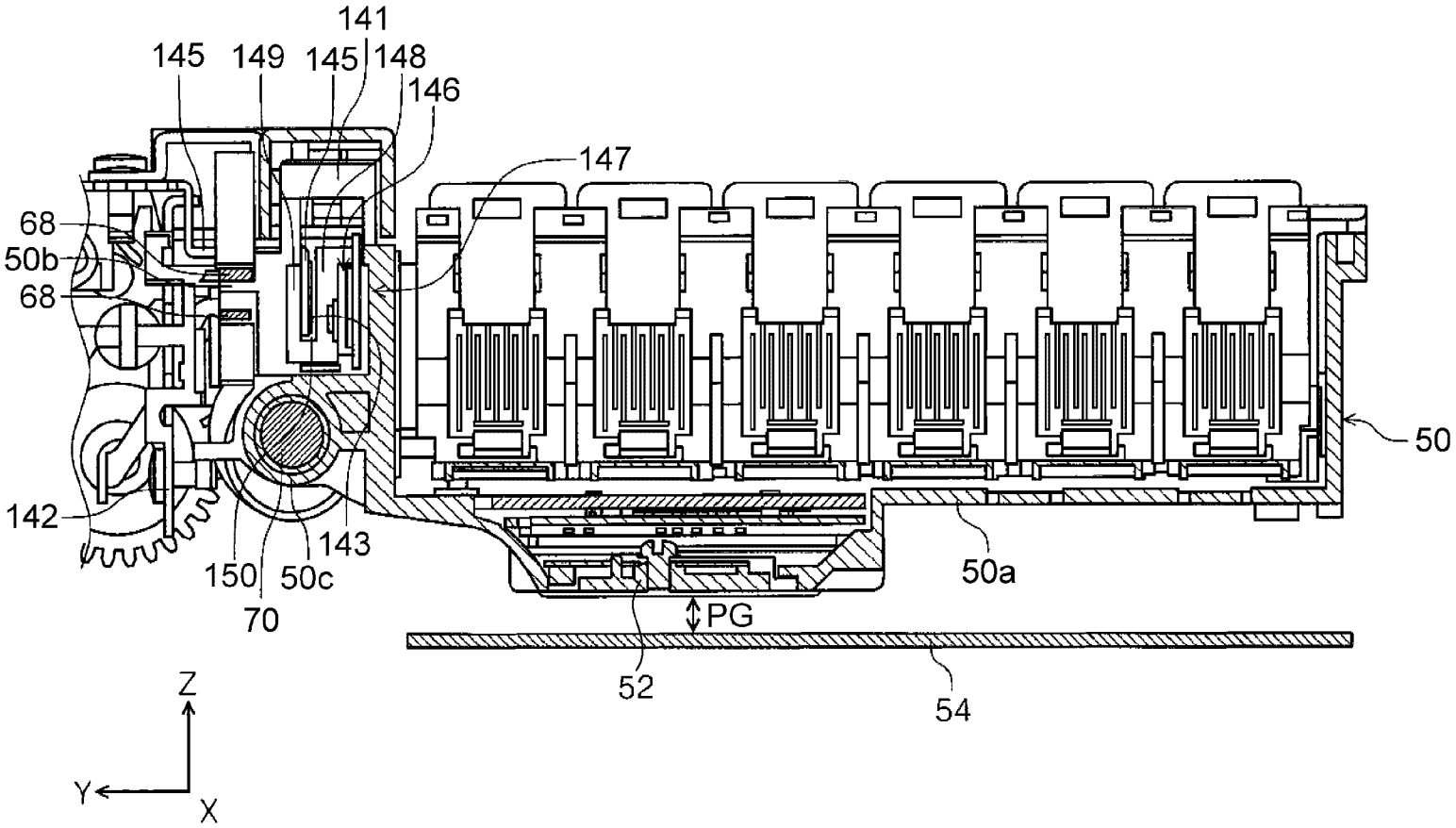
FIG. 37 is a sectional side view of the carriage in the case where the gap PG is the smallest in the carriage according to the invention.

FIG. 34 is a sectional side view of the carriage in a case where the gap PG is the smallest in the carriage according to the invention. FIG. 35 is a side view illustrating a relationship between the linear scale and the sensor in the carriage in the state in FIG. 34. FIG. 36 is a side view illustrating a configuration of the carriage on the rear side of the apparatus according to the invention. FIG. 37 is a sectional side view of the carriage in the case where the gap PG is the smallest in the carriage according to the invention.

Figure 38:
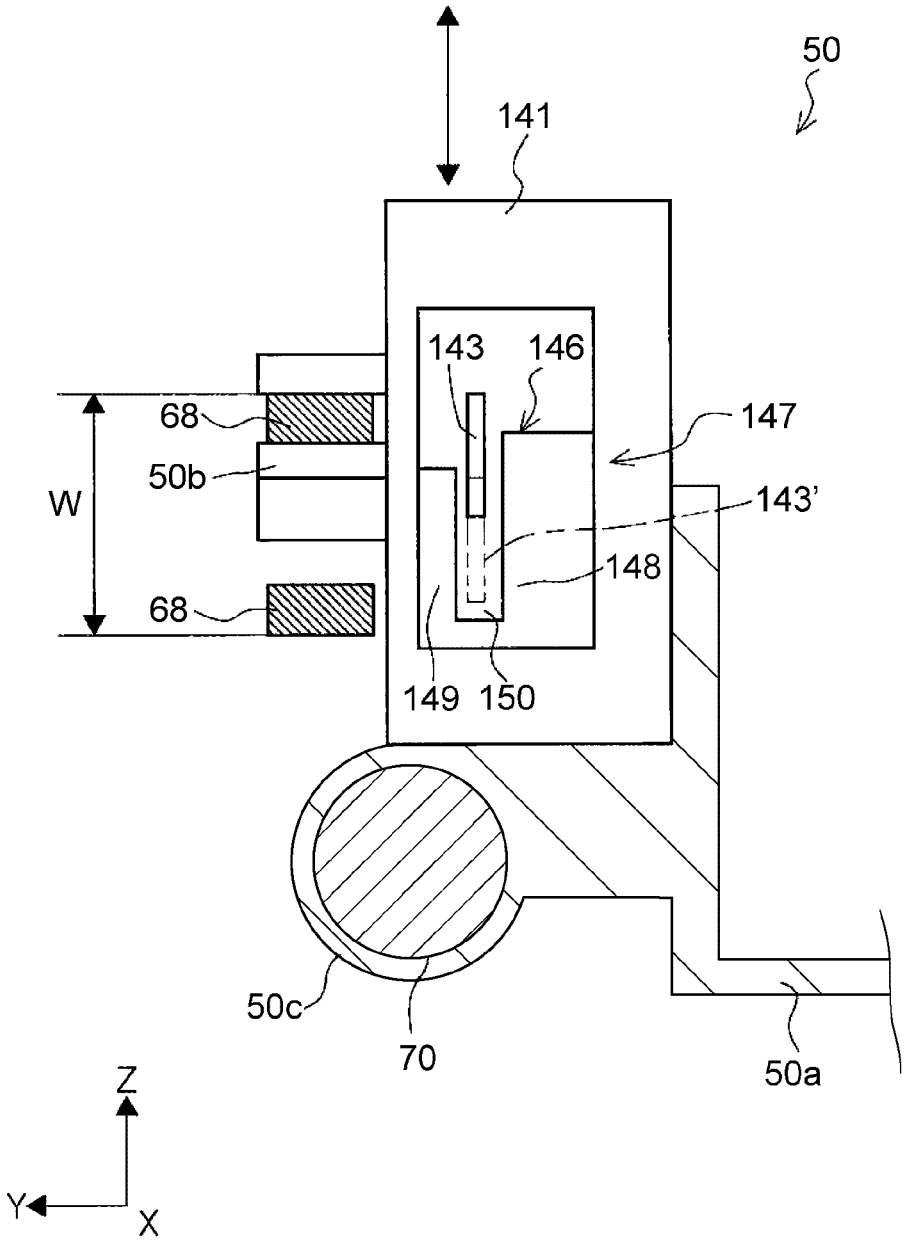
FIG. 38 is a side view illustrating a relationship between the linear scale and the sensor depending on a change in the gap PG.
Figure 39:
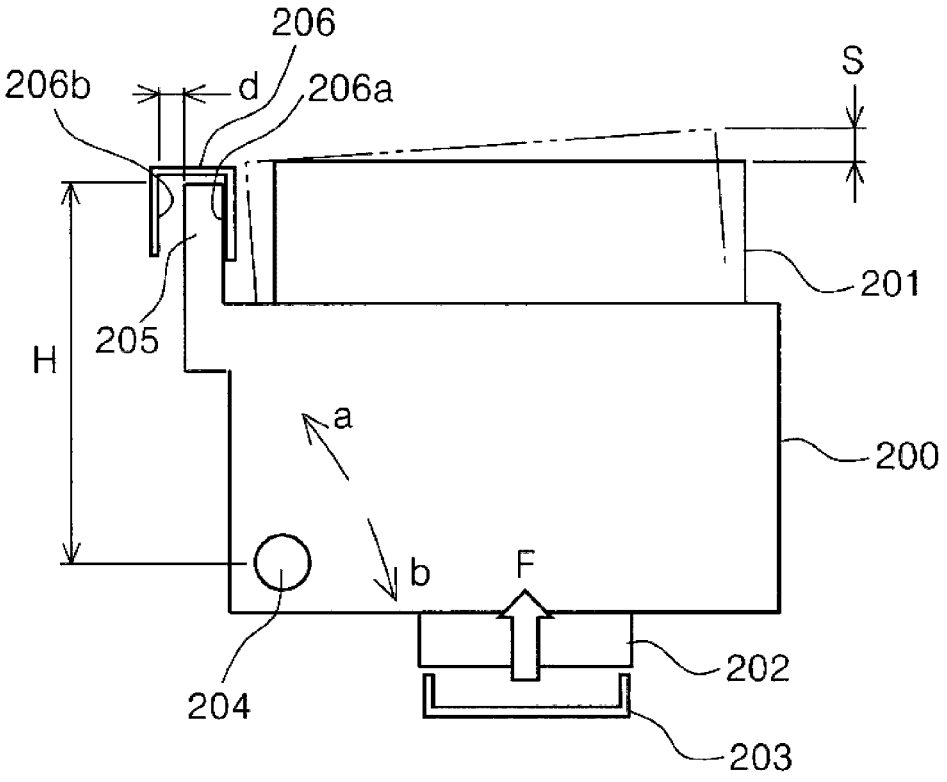
FIG. 39 is a side view of the carriage in the related art.

FIG. 38 is a side view illustrating a relationship between the linear scale and the sensor depending on a change in the gap PG.

Again, with reference to FIGS. 3, 6, and 8, the apparatus main body 12 is provided with a linear scale 143 on the rear side of the carriage 50 in the apparatus-depth direction. In the example, the linear scale 143 is configured of a flat plate-shaped member extending in the apparatus-width direction. The linear scale 143 is provided with a plurality of slits (not illustrated) at regular intervals in the apparatus-width direction.

As illustrated in FIGS. 34 and 37, the frame member 142 is provided with a scale support member 145 that projects to the front side in the apparatus-depth direction more than the frame member 142. In the example, the scale support members 145 are attached to the frame member 142 at an interval in the apparatus-width direction. A pair of scale support member 145 support both of the end portions of the linear scale 143 in the apparatus-width direction.

As illustrated in FIG. 5, the linear scale 143 enters the surrounding portion 141 provided on the rear side of the housing 50*a* of the carriage 50. The surrounding portion 141 is provided with an encoder sensor 146 as a "sensor". The encoder sensor 146 reads the slits provided on the linear scale 143 in response to the movement of the carriage 50 in the apparatus-width direction, and information thereof is transmitted to a control unit (not illustrated) provided in the apparatus main body 12.

The control unit 65 (FIG. 4) detects the position of the carriage 50 in the apparatus-width direction. In other words, the linear scale 143 and the encoder sensor 146 configure a position detecting unit 147 that detects the position of the carriage 50 in the apparatus-width direction.

Regarding Configuration of Grip Portion, Bearing, and Surrounding Portion

Subsequently, with reference to FIGS. 5 and 34 to 38, a configuration and a relationship between the grip portion 50*b*, the bearing 50*c*, and the surrounding portion 141 provided on the rear side of the housing 50*a* of the carriage 50 will be described. As illustrated in FIG. 36, the bearing 50*c* is provided to be closer to the lower portion of the housing 50*a* on the rear side of the housing 50*a*. The guiding shaft 70 penetrates through the bearing 50*c* (refer to FIG. 5). When the carriage 50 moves in the apparatus-width direction, the bearing 50*c* is configured to slide with respect to the guiding shaft 70.

As illustrated in FIG. 36, the grip portion 50*b* and the surrounding portion 141 in the example are provided above the bearing 50*c* in the apparatus-height direction. In the example, the surrounding portion 141 is provided to be closer to the housing 50*a* above the bearing 50*c* in the apparatus-height direction. In other words, the surrounding portion 141 is integrally formed with the housing 50*a* of the carriage 50. The surrounding portion 141 in the example is formed of a frame shape and is open in the apparatus-width direction, that is, in the moving direction of the carriage 50. In the example, since the surrounding portion 141 is integrally formed with the housing 50*a*, it is possible to reduce an increase in the number of components.

In the example, the encoder sensor 146 is attached to the surrounding portion 141 (refer to FIGS. 5, 34, and 35). The encoder sensor 146 in the example is configured as an optical detection sensor. With reference to FIGS. 34 and 35, the encoder sensor 146 includes a light-emitting portion 148 that emits light and a light-receiving portion 149 that receives light emitted from the light-emitting portion 148.

In the example, the light-emitting portion 148 and the light-receiving portion 149 are provided at an interval in the apparatus-depth direction. In other words, a gap 150 is provided between the light-emitting portion 148 and the light-receiving portion 149. In the example, the gap 150 is open upward in the apparatus-height direction and in the apparatus-width direction. The linear scale 143 is inserted into the gap 150.

As illustrated in FIG. 35, the surrounding portion 141 is formed to surround the linear scale 143 and the encoder sensor 146 in a vertical direction in the apparatus-height direction and in a frontward-rearward direction in the apparatus-depth direction. Since the surrounding portion 141 is formed to surround the linear scale 143, it is possible to prevent the linear scale 143 from falling from the surrounding portion 141. In addition, since the surrounding portion 141 has a shape of surrounding the periphery of the linear scale 143 in four directions, it is possible to increase a stiffness more than in a case where the surrounding portion 141 is formed to have a shape of surrounding the linear scale 143, that is, the periphery of the linear scale 143 in three directions, and thus it is also possible to endure strong impact.

In addition, as illustrated in FIG. 36, the grip portion 50*b* is formed on the rear side of the surrounding portion 141 in the apparatus-depth direction. The grip portion 50*b* is configured to grip at least a part of the driving belt 68 (refer to FIG. 5).

In the example as illustrated in FIG. 36, the grip portion 50*b*, the bearing 50*c*, and the surrounding portion 141 are integrally formed on the rear side of the housing 50*a*.

In addition, with reference to FIG. 34, to summarize a positional relationship between the driving belt 68 and the linear scale 143, at least a part of the region occupied by the driving belt 68 and at least a part of the linear scale 143 overlap, that is, are disposed at the same position. The linear scale 143 is positioned on a main body of the carriage 50 with respect to the driving belt 68, that is, to the housing 50*a* side, in the apparatus-depth direction as the direction intersecting with the apparatus-width direction as the moving direction of the carriage 50.

In addition, the driving belt 68 an the linear scale 143 are disposed with the position of the central axis of the guiding shaft 70 interposed therebetween in the apparatus-depth direction as illustrated in FIG. 35. In addition, in the apparatus-depth direction, at least a part of the linear scale 143 and the guiding shaft 70 overlap, that is, are disposed at the same position.

In the example, the grip portion 50*b* and the surrounding portion 141 are disposed side by side on the front and rear sides in the apparatus-depth direction. Here, in a configuration in which the linear scale 143 and the encoder sensor 146 are disposed above the grip portion 50*b* so as to overlap in the apparatus-height direction, the linear scale 143 and the encoder sensor 146 have to be disposed in consideration of an up-and-down movement region of the grip portion 50*b*, and thus the apparatus increases in size in the apparatus-height direction.

However, in the example, since the grip portion 50*b* and the surrounding portion 141, that is, the linear scale 143 and the encoder sensor 146, are disposed side by side on the front and rear side in the apparatus-depth direction, at least a part of the region provided with the grip portion 50*b* in the apparatus-height direction and at least a part of a region provided with the linear scale 143 and the encoder sensor 146 overlap such that it is possible to decrease the apparatus in size in the apparatus-height direction.

Regarding Relationship Between Linear Scale and Carriage During Gap Change

With reference to FIGS. 34, 35, 37, and 38, a relationship between the carriage 50 and the linear scale 143 during the change in the gap PG is described.

FIGS. 34 and 35 illustrate a positional relationship between the linear scale 143 and the encoder sensor 146 in the apparatus-height direction in a case where a distance between the recording head 52 and the medium guiding member 54, that is, the gap PG (refer to FIG. 37) is the minimum. In this state, a part of the linear scale 143 in the apparatus-height direction enters a space between the light-emitting portion 148 and the light-receiving portion 149 of the encoder sensor 146, that is, the gap 150. Even in this state, the encoder sensor 146 is set to be capable of detecting the slits provided on the linear scale 143.

Subsequently, the gap adjusting unit 80 is driven, and thereby the carriage 50 is caused to shift upward in the apparatus-height direction. FIG. 37 illustrates a positional relationship between the linear scale 143 and the encoder sensor 146 in the apparatus-height direction in the case where the gap PG is the maximum. In this state, the entire linear scale 143 in the apparatus-height direction enters the space between the light-emitting portion 148 and the light-receiving portion 149 of the encoder sensor 146, that is, the gap 150. Even in this state, the encoder sensor 146 is set to be capable of detecting the slits provided on the linear scale 143.

As illustrated in FIG. 38, even when the linear scale 143 and the encoder sensor 146 relatively move in the range from the maximum gap PG to the minimum gap in the apparatus-height direction, the encoder sensor 146 is able to detect the slits on the linear scale 143. In other words, the position detecting unit 147 is capable of detecting the position of the carriage 50 in the apparatus-width direction, that is, in the moving direction of the carriage 50, even when the gap PG changes. Note that a portion in a solid line to which reference sign 143 is assigned in FIG. 38 represents the linear scale 143 in the case where the gap PG is the minimum, and a portion in a two-dot chain line to which reference sign 143' is assigned represents the linear scale 143 in the case where the gap PG is the maximum.

Note that the size of the surrounding portion 141 in the apparatus-height direction is set to a size with which relative movement of the linear scale 143 and the encoder sensor 146 is allowed as illustrated in FIGS. 35 and 37.

Modification Example of Example (1) The example employs the configuration in which only the linear scale 143 and the encoder sensor 146 are disposed in the surrounding portion 141; however, instead of the configuration, a configuration, in which the grip portion 50*b* is further provided in the surrounding portion 141 and the driving belt 68 passes through the grip portion, may be employed. In the configuration, it is possible to not only reduce an occurrence of falling of the linear scale 143, but also it is possible to reduce an occurrence of falling of the driving belt 68.

(2) In the example, the encoder sensor 146 is configured as the optical sensor; however, instead of the configuration, the encoder sensor 146 may be configured to be appropriately changed to a magnetic detection type or the like.

(3) The example employs the configuration in which the grip portion 50*b*, the bearing 50*c*, and the surrounding portion 141 are integrally formed with the housing 50*a*; however, instead of the configuration, a configuration, in which at least one of the grip portion 50*b*, the bearing 50*c*, and the surrounding portion 141 is separately formed from the housing 50*a*, may be employed.

To summarize the description above, the printer 10 includes: the carriage 50 that has the recording head 52 which performs recording on the medium and that is movable in the apparatus-width direction as the direction intersecting with the apparatus-height direction as the medium transport direction; the driving belt 68 that pulls the carriage 50 in the moving direction of the carriage 50; and the linear scale 143 that configures the position detecting unit 147 which detects the position of the carriage 50 and that is provided to extend in the moving direction of the carriage 50. At least a part of the linear scale 143 and at least a part of the region (range represented by reference sign W in FIG. 38) occupied by the driving belt 68 overlap in the apparatus-height direction.

In the configuration, since at least a part of the linear scale 143 and at least a part of the region occupied by the driving belt 68 overlap in the apparatus-height direction, the region occupied by the linear scale 143 and the region occupied by the driving belt 68 do not overlap entirely in the apparatus-height direction such that it is possible to decrease the size in the apparatus-height direction.

In the printer 10, the linear scale 143 is positioned on the housing 50*a* side of the carriage 50 with respect to the driving belt 68 in the apparatus-depth direction as the direction intersecting with the apparatus-width direction as the moving direction of the carriage 50.

The printer 10 includes the guiding shaft 70 that guides the carriage 50 in the apparatus-width direction as the moving direction. The linear scale 143 and the driving belt 68 are positioned to interpose the central position of the guiding shaft 70 therebetween in the apparatus-depth direction as the direction intersecting with the apparatus-width direction as the moving direction of the carriage 50.

In the printer 10, the linear scale 143 overlaps the guiding shaft 70 in the apparatus-depth direction as the direction intersecting with the apparatus-width direction as the moving direction of the carriage 50. In the configuration, the region occupied by the linear scale 143 and the region occupied by the guiding shaft 70 do not overlap entirely in the apparatus-depth direction as the direction intersecting with the apparatus-width direction as the moving direction of the carriage 50 such that it is possible to decrease the apparatus in size in the apparatus-depth direction as the direction intersecting with the apparatus-width direction as the moving direction.

The carriage 50 includes the encoder sensor 146 that detects the linear scale 143 and configures the position detecting unit 147, and the surrounding portion 141 that surrounds the encoder sensor 146 and the linear scale 143 and is open in the apparatus-width direction as the moving direction of the carriage 50. In this configuration, it is possible to reduce an occurrence of a problem in that the linear scale 143 is detached from the encoder sensor 146 when a user touches the linear scale 143.

The surrounding portion 141 covers the rights, lefts, tops and bottoms of the encoder sensor 146 and the linear scale 143 when viewed in the moving direction of the carriage 50, that is, in the vertical direction in the apparatus-height direction and in the frontward-rearward direction in the apparatus-depth direction. In the configuration, it is possible to more reliably reduce the occurrence of the problem in that the linear scale 143 is detached from the encoder sensor 146, and it is difficult for the user to touch the encoder sensor 146 such that it is possible to protect the encoder sensor 146.

The surrounding portion 141 is integrally formed with the housing 50*a* of the carriage 50. In the configuration, it is possible to configure the surrounding portion 141 at low costs.

The grip portion 50*b* that grips the driving belt 68 in the carriage 50 is integrally formed with the surrounding portion 141. In the configuration, it is possible to configure the grip portion 50*b* at low costs.

In addition, in the example, the carriage 50 according to the invention is applied to an ink jet printer as an example of the recording apparatus; however, the carriage can be applied to another common liquid ejecting apparatus.

In addition, in the example, the press unit 111 and the support portion 120 according to the invention are applied to the ink jet printer as an example of the recording apparatus; however, the press unit and the support portion can be applied to another common liquid ejecting apparatus.

In addition, in the example, the grip portion 50*b* and the surrounding portion 141 according to the invention are applied to the ink jet printer as an example of the recording apparatus; however, the grip portion and the surrounding portion can be applied to another common liquid ejecting apparatus.

Here, examples of the liquid ejecting apparatus are not limited to a recording apparatus such as a printer, a copy machine, a facsimile, and the like in which an ink jet type recording head is used, an ink is discharged from the recording head, and recording is performed on a recording medium, but include an apparatus in which, instead of the ink, a liquid corresponding to an application is ejected from a liquid ejecting head corresponding to the ink jet type recording head on a ejecting medium corresponding to the recording medium and the liquid is attached to the ejecting medium.

Examples of other liquid ejecting heads include, in addition to the recording head, a color material ejecting head that is used in manufacturing a color filter of a liquid crystal display or the like, an electrode material (conductive paste) ejecting head that is used in forming electrodes of an organic EL display, a field emission display (FED), or the like, a bioorganic material ejecting head that is used in manufacturing a biochip, a sample ejecting head as an accuracy pipette, or the like.

Note that the invention is not limited to the examples, various modifications can be performed within a range of the invention described in the claims, and it is needless to say that the modifications are also included in the range of the invention.

The entire disclosure of Japanese Patent Application No. 2016-035331, filed Feb. 26, 2016, No. 2016-035332, filed Feb. 26, 2016 and No. 2016-035340, filed Feb. 26, 2016 are expressly incorporated by reference herein.

What is claimed is:

1. A recording apparatus comprising: a carriage that has a recording head which performs recording on a medium and that is movable in a first scanning direction and a second scanning direction opposite to the first scanning direction; and a gap adjusting unit that causes the carriage to shift in a direction in which a gap between a medium and the recording head changes depending on rotation of a cam, wherein, in a state in which the carriage is positioned at an end portion in a moving range in the first scanning direction, at least a part of the carriage and at least a part of the cam overlap in a moving direction of the carriage and the cam does not project beyond the carriage in the first scanning direction.

2. The recording apparatus according to claim 1, further comprising:

a guiding shaft that guides the carriage in the moving direction, wherein the cam has a shape in which a distance from the rotating center to an outer circumference changes in a circumferential direction, and is provided at an end portion of the guiding shaft, wherein the gap adjusting unit has a cam follower that comes into contact with an outer circumferential surface of the cam.

3. The recording apparatus according to claim 1, wherein the gap adjusting unit has a gear group that transmits rotational torque of a power source to the cam, and wherein, in the state in which the carriage is positioned at the end portion in the moving range in the first scanning direction, the gear group does not project beyond the carriage in the first scanning direction.

4. The recording apparatus according to claim 1, wherein the cam does not project beyond the top portion of the carriage in the direction in which the gap changes.

5. The recording apparatus according to claim 1, wherein the cam is positioned to be near an end portion in the moving range of the carriage on the second scanning direction side, and wherein, in the state in which the carriage is positioned at the end portion in the moving range in the second scanning direction, the cam does not project with respect to the carriage in the second scanning direction.

6. The recording apparatus according to claim 1, further comprising: a power transmitting mechanism that transmits power of a driving source to a transport unit which transports a medium and that is disposed on an end portion side in the moving range of the carriage in the second scanning direction, wherein, in the state in which the carriage is positioned at the end portion in the moving range in the second scanning direction, the power transmitting mechanism does not project beyond the carriage in the second scanning direction.

7. The recording apparatus according to claim 1, wherein the carriage has a plurality of ink cartridges that contain liquids that are discharged from the recording head, and wherein the plurality of ink cartridges are arranged in the carriage in a direction intersecting with the moving direction of the carriage.

8. The recording apparatus according to claim 1, further comprising:

a press unit that engages with the carriage and presses the carriage downward in a state in which the gap is at least larger than the smallest gap.

9. The recording apparatus according to claim 8, wherein the press unit engages with the carriage when the carriage is positioned outside a recording region in which the recording head performs recording on a medium.

10. The recording apparatus according to claim 9, wherein the press unit engages with an end portion of the carriage on a side apart from the guiding shaft.

11. A recording apparatus comprising: a carriage that has a recording head which performs recording on a medium and that is movable in a first scanning direction and a second scanning direction opposite to the first scanning direction; a gap adjusting unit that causes the carriage to shift in a direction in which a gap between a medium and the recording head changes depending on rotation of a cam; and a press unit that engages with the carriage and presses the carriage downward in a state in which the gap is at least larger than the smallest gap, wherein, in a state in which the carriage is positioned at an end portion in a moving range in the first scanning direction, at least a part of the carriage and at least a part of the cam overlap in a moving direction of the carriage.

12. The recording apparatus according to claim 11, wherein the press unit engages with the carriage when the carriage is positioned outside a recording region in which the recording head performs recording on a medium.

13. The recording apparatus according to claim 12, wherein the press unit engages with an end portion of the carriage on a side apart from the guiding shaft.

* * * * *